US009782817B2

(12) United States Patent
Chapin

(10) Patent No.: US 9,782,817 B2
(45) Date of Patent: Oct. 10, 2017

(54) SYSTEM AND METHOD OF VARYING DWELL TIME IN A HONEYCOMB PLATE PRESS

(71) Applicant: William K Chapin, Cumby, TX (US)

(72) Inventor: William K Chapin, Cumby, TX (US)

(73) Assignee: Getter Dunn Technologies, LLC, Fort Worth, TX (US)

( * ) Notice: Subject to any disclaimer, the term of this patent is extended or adjusted under 35 U.S.C. 154(b) by 246 days.

(21) Appl. No.: 14/609,429

(22) Filed: Jan. 30, 2015

(65) Prior Publication Data

US 2015/0352620 A1 Dec. 10, 2015

Related U.S. Application Data

(60) Provisional application No. 62/010,281, filed on Jun. 10, 2014, provisional application No. 62/022,194, filed on Jul. 8, 2014.

(51) Int. Cl.

| | |
|---|---|
| ***B21D 33/00*** | (2006.01) |
| ***B30B 15/12*** | (2006.01) |
| ***B21D 13/10*** | (2006.01) |
| ***B30B 1/00*** | (2006.01) |
| ***B21D 13/02*** | (2006.01) |
| ***B21D 47/00*** | (2006.01) |
| ***B30B 1/42*** | (2006.01) |
| ***B30B 15/14*** | (2006.01) |

(Continued)

(52) U.S. Cl.

CPC ..... *B21D 33/00* (2013.01); *B21D 13/02* (2013.01); *B21D 13/10* (2013.01); *B21D 47/00* (2013.01); *B30B 1/00* (2013.01); *B30B 1/42* (2013.01); *B30B 15/12* (2013.01); *B30B 15/142* (2013.01); *B30B 15/16* (2013.01); *B41F 16/006* (2013.01); *B41F 16/0046* (2013.01); *B44B 5/0052* (2013.01); *B44B 5/0071* (2013.01)

(58) Field of Classification Search

CPC ..... B30B 1/00; B44B 5/0071; B21D 13/10; B21D 33/00; B31B 1/20; B31B 1/88

See application file for complete search history.

(56) References Cited

U.S. PATENT DOCUMENTS

| | | | |
|---|---|---|---|
| 2,622,525 | A | 12/1952 | Kluge et al. |
| 2,788,739 | A | 4/1957 | Gillis |

(Continued)

FOREIGN PATENT DOCUMENTS

| | | |
|---|---|---|
| GB | 614524 | 12/1948 |

*Primary Examiner* — R. K. Arundale
*Assistant Examiner* — Pradeep C Battula
(74) *Attorney, Agent, or Firm* — Morani Patent Law, PC

(57) ABSTRACT

A system and method of increasing a dwell time in a foil stamping press is provided. The dwell time is readily adjusted on the fly by the user for a given operating rate. A timer is used to adjust the press to stop on top dead center with changes in images per hour. An air clutch and an original equipment air brake are used in tandem to provide the desired dwell time. A pair of timers governs a pneumatic switch for control of the air clutch and the air brake. The present system and method increase die image area capacity as compared to conventional foil stamping presses. The increased dwell time press yields a flawless foil stamped image for an impression pressure less than that required in a conventional machine for a given die, mounted at a given height upon a stationary platen, and at a given temperature.

9 Claims, 46 Drawing Sheets

(51) Int. Cl.

| | |
|---|---|
| ***B41F 16/00*** | (2006.01) |
| ***B44B 5/00*** | (2006.01) |
| ***B30B 15/16*** | (2006.01) |

(56) References Cited

U.S. PATENT DOCUMENTS

| | | | | |
|---|---|---|---|---|
| 3,412,678 | A | 11/1968 | Biron | |
| 4,416,198 | A | 11/1983 | Rasenberger | |
| 6,668,992 | B2 * | 12/2003 | Shimizu | B30B 15/10 192/18 A |
| 6,935,228 | B2 | 8/2005 | Brandtjen et al. | |
| 8,042,375 | B2 * | 10/2011 | Suzuki | B21D 24/10 72/16.1 |
| 9,579,706 | B2 * | 2/2017 | Chapin | B21D 33/00 |

* cited by examiner

VIEW B-B

VIEW A-A

SYSTEM AND METHOD OF VARYING DWELL TIME IN A HONEYCOMB PLATE PRESS

CROSS REFERENCE TO RELATED APPLICATIONS

This application is a Continuation application of and claims priority to U.S. application Ser. No. 14/609,429, filed 30 Jan. 2015, which claims priority to U.S. Provisional Application No. 62/010,281, filed 10 Jun. 2014, the contents of which are incorporated herein by reference, and to U.S. Provisional Application No. 62/022,194, filed 8 Jul. 2014, the contents of which are incorporated herein by reference.

FIELD OF THE INVENTION

The present invention relates generally to pressing in honeycomb plate presses and more particularly to foil stamping on automatic presses.

BACKGROUND OF THE INVENTION

Conventional foil presses provide a constant and brief contact period of the honeycomb plate to the die, which is mounted on the platen. This period of high pressure contact, dwell time, is conventionally very brief, less than 0.25 seconds. Conventional foil stamping and embossing presses such as a 14×22 EHD (KLUGE, St. Croix Falls, Wis., US), for example, may have two possible press configurations, where each configuration yields a constant and short dwell time. Exemplary conventional dwell times are a first dwell time in a first configuration of less than 0.2 seconds and a second dwell time commensurate with the second configuration adding less than 0.2 seconds to the first less than 0.2 seconds.

FIG. 1A shows a conventional 14×22 EHE press with computer control from a right front perspective view. The entire press is driven from a single motor connected to a drive shaft via a belt and pulley. Cams, cranks, gears, chains, arms, belts, pulleys, valves, and solenoids are used to move different parts of the press assembly at the desired time and are driven from and/or timed from the aforementioned motor driven shaft. The press also employs a source of compressed air, which drives various suction and blowing devices on the press. Activation of pneumatic devices is also timed with or activated from the drive shaft and coordinated with the press's moving parts. A typical air pressure requirement is 90 PSI and a regulator assures the desired PSI is supplied to the press's pneumatic parts. Turning to FIG. 1A, guard plates 110 and grills 111 cover many of the key components in such a press, and these components are not visible in FIG. 1A. An automatic feed assembly 115 is shown at a top in the front 121 of the press 100 with pair of drive chains 141. Controls and indicators 117 are shown in the left front 120 foreground. Opposite the front 121 of the press a small portion of the back 121 of the press is visible. An exemplary air pressure regulator 131 is shown with associated pneumatic hoses 132.

FIG. 1B shows a left perspective view of a conventional 14×EHE. Safety grills 111 and safety guards 110 are shown spanning the left side from back 121 to front 120 of a conventional press 100. User controls 117 are provided in the foreground. And the feed system 115 is shown, again, here in the top front 120.

FIG. 1C shows a representative drawing of a conventional drive shaft and its two end flywheels, in accordance with a conventional press. A contrast between a conventional drive shaft, FIG. 1C with a drive shaft assembly in accordance with an embodiment of the present invention, shown in FIG. 12B, is described below. Turning to FIG. 1C, the drive belt 157 rests in the circumferential channel 156 of the left most 151 flywheel and serves as the drive flywheel 150. The far right 152 shows another flywheel upon which a pneumatic brake 162 is mounted. This brake 162 is applied to this far right 152 flywheel 160 when the stop button, not shown, is depressed by the user or if triggered for safety. The far right 152 flywheel 160 connects to the drive shaft 155 but does not connect to any pulleys or cams.

FIGS. 2A-2C show the feed assembly early in a cycle and the delivery assembly in an early and late part of a given cycle, respectively, from a top perspective view in a conventional 14×22 EHD press. The entire press cycle is driven, coordinated, and timed from the motor driven single drive shaft, Turning first to FIG. 2A, A blank 2-150 is retrieved from the feed magazine 2-115. More particularly, feed heads 2-130 attach to a feed bar 2-110 and move in parallel. Suction cups 2-140 attach to the heads 2-130 and pick up the blank 2-150. Air lines 2-120 apply and release suction to the heads 2-140. The heads 2-130 and the bar 2-110 move via pivot feed arm 2-170. A blank 2-150 is picked from the magazine 2-115 and the pivot feed arm 2-170 moves to bring the blank along trajectory 2-164. This trajectory 2-164 is shown in the blank 2-150 path and relative to the directions X-Y-Z 160, 161, 162, and 160. In accordance with a conventional press, the blank moves along the X-Z plane 2-161, 2-163 as a blank 2-150 is loaded on die mounted to the platen, not shown, and suction releases. In practice, foil rests on the honeycomb surface, not shown. The honeycomb closes on the die mounted on the platen, not shown, stamping the blank with foil in the desired die pattern.

FIG. 2B shows an early state of delivery in a given pressing cycle with the delivery system over the platen and the feed system just starting its approach with a blank to the platen. The feed heads 2-130, air lines 2-120, and feed suction heads 2-140 are shown with a subsequent blank 2-150-1. The feed bar, 2-110 shown in FIG. 2A, is not shown in FIG. 2B. Air lines 2-125 attach to delivery heads 2-135 and the heads have moved forward across the open platen 2-175. A delivery bar 2-117 attaches to the heads 2-135 and the heads move in parallel. FIG. 2C shows a late state of delivery in a given pressing cycle, the foil stamped blank already retrieved from the platen. Delivery heads 2-135 have rescinded from over the platen 2-175-*f*. Suction delivery heads 2-145 are shown at the end of the delivery heads 2-145 and grasp a foil stamped blank 2-155. The delivery arm 2-170 has moved over the platen face 2-175-*f*.

FIGS. 3A to 3C show a front perspective view of a conventional press under a foil stamping application. FIG. 3A shows the honeycomb plate just about to close on the platen. FIG. 3B shows the honeycomb plate closed on the platen and FIG. 3C shows the honeycomb lifted back off the platen. A blank is fed from the feeder, shown in FIG. 2A, and slid to butt against a mounting strip on the platen face 2-175-*f*, shown in FIG. 2B. Turning to FIG. 3A, the honeycomb 3-190-*a* rotates and translates forward with the drive shaft and its face 3-190-*f* comes to press upon the platen face, where FIG. 3A shows the back of the platen 3-175-*b*. Foil 3-160 rotates across the face 3-190-*f* of the honeycomb plate. Guards 3-111 are shown in the foreground. The platen remains stationary.

The speed and precision of a conventional foil stamping press is rapid and exacting. The foil supply rests upon the honeycomb surface facing the platen. The die for the desired stamp is secured to the platen, facing up. The blank is positioned upon the die and as the honeycomb closes upon the platen, the foil contacts the blank and as pressure is applied, the foil stamps onto the paper in die form. The honeycomb retracts and a delivery arm 2-117, shown for example in FIG. 2B, retrieves the stamped image clearing the platen surface 2-175-*f*, also shown in FIG. 2B. This high speed and precision of a conventional press will add to the challenge of altering a given cycle. A conventional 14×22 EHx, where x may be E, D, or F, can be equipped with three foil rewind clutches. The conventional foil system provides reliable foil draws with accuracy for image spacings across blanks of 0.125 inches.

Turning to FIG. 3B, the honeycomb plate has closed upon the platen plate, where the top of the honeycomb top 3-190-*t* is shown with the back of the platen 3-175-*b*. Guard rails 3-11 are shown in the foreground and the foil supply 3-160 disappears from view between the honeycomb top 3-190-*t* and the platen 3-175-*b*. In FIG. 3C, the honeycomb 3-190-*a* has opened up from the platen and the platen face 3-175-*f* and the honeycomb face 3-190-*f* are shown. The foil supply 3-160 is shown here against the face of the honeycomb 3-190-*f* and extending from the honeycomb top 3-190-*t*. Guard rails 3-111 are shown in the foreground.

It may be desirable to decrease a necessary impact and pressure for a given die size under foil stamp operation. It may be desirable to increase the service life of these large, heavy, costly presses. It may be desirable to enable foil stamping with a large die size, e.g. greater than 40 inches squared, on a 14×22 EHD press.

In a conventional 14×22 press, the reconfiguration to achieve the increased dwell time may take a user in excess of one-half of one manhour. Although newer conventional KLUGE machines, such as Brandjten enabled machines described below, may take less time to reconfigure to the longer dwell time, the additional dwell time is less than 0.2 seconds. The dwell time is set by the press configuration and cannot be varied for a given press configuration. The impact force, is also relatively constant across a first configuration and a second increased dwell configuration.

An adjustable dwell time is also taught by Brandtjen, Jr., et al. (U.S. Pat. No. 6,935,228). Brandtjen teaches parallel movable arms on either side of a moveable platen plate, or honeycomb plate, and a stationary fixed platen plate. Springs in parallel with the axis of each respective movable arm absorb translation energy of the driven arms to enable the movable honeycomb plate and the stationary platen to remain in contact under compression for a period of time slightly longer than the dwell time afforded in the absence of compressible springs. The springs on a 14×22 EHD can double the dwell for a given run speed in the absence of using said springs. Such conventional springs are briefly shown in and described below in relation FIG. 4. As a particular example, a 3000 image per hour (IPH) non-spring enabled cycle can be extended by 61 milliseconds in the presence of compressible springs. Brandtjen teaches a typical 1 ton per die square inch for satisfactory foil stamping and a maximum tensile strength on a honeycomb connecting arm approaching 45 tons. This maximum compression force of 45 tons a would yield a maximum die image size of 45 inches squared on a medium [14×22] press. The 14×22 EHD can double the dwell time by using the springs without decreasing the IPH, the running speed. As another example, the dwell time for 1500 IPH may be 0.12 seconds.

FIG. 4 shows one of two parallel moveable arms 4-400 in a conventional no dwell state, where the springs 4-410 neither compress nor expand during pressing as the framed space, spring window 4-415, is secured across the cylindrical spacer 4-420. The spring window 4-415 is reduced in height 4-425*c*, Z direction 4-206, by a block 4-470. In turn, both cylindrical spacer 4-420 and parallel springs 4-410 span the height 4-425*c* of the window 4-415, forming a solid arm. An adjustment 4-430 readily reconfigures the arm 4-400 into a spring compressible position. Raising 4-422 the cylindrical spacer to position 4-421, the springs 4-410 extend past the spacer 4-420. Conventionally, an extended spring configuration can increase the dwell time in a conventional foil press as described above.

Still other conventional presses have attempted to increase dwell time on a foil stamping press by using a clutch and brake system. Biron (U.S. Pat. No. 3,412,678) teaches a mounting plate to which a die is mounted and a platen plate onto which a blank is fed with dual magnetic clutches.

Conventional presses can also provide adjustable temperature settings to facilitate a desired foil stamp design, foil type, or press speed. Changing the heat/temperature of the die alone in a conventional 14×22 EHx may have only a small effect on a typical foil stamping result.

It may be desirable to increase the working life of a given press. It may be desirable to be able to increase the die image size that can be created on an existing automatic foil stamping press. A given press would be more versatile if the range of die sizes that can be foil stamped is increased. It would be desirable if any user made adjustments to a press in field applications were user friendly.

SUMMARY OF THE INVENTION

The present invention addresses some of the issues presented above by providing a system and method for increasing the dwell time in a medium sized automatic honeycomb press during foil stamping. More particularly, the subject invention increases the dwell time of a 14×22 die press, such as an EHD, EHE, or an EHF (KLUGE, St. Croix Falls, Wis., US), while affording operation of the same in standard non-dwell mode. The present invention provides a reliable and increased dwell time that limits wear, impact, and torsion on the given press. The present invention increases the die square inches that can be finely foil stamped. Aspects of the present invention are provided for summary purposes and are not intended to be all inclusive or exclusive. Embodiments of the present invention may have any of the aspects below.

One aspect of the present invention is the accommodation of ambient conditions by use of a drift timer.

Another aspect of the present invention is to provide the ability to stop on top dead center by, for example, using a trigger delay timer.

Another aspect of the present invention is use of a single timer to account for both drift and trigger delay.

Another aspect of the present invention is the increase or decrease of the drift and delay trigger timer by the user on the fly to adjust to a different operating speed, IPH.

Another aspect of the present invention is to provide user controlled dwell time.

Another aspect of the present invention is the ability for the user to readily vary the dwell time as needed or as desired.

Another aspect of the present invention is an improved foil stamped image with increasing dwell time.

Another aspect of the present invention is its user friendly operation in industrial applications.

Yet another aspect of the present invention is implementation on a conventional 14×22 platen sized die press.

Yet another aspect of the present invention may be the ability to foil stamp at a lower temperature with an increased dwell time.

Another aspect of the present invention is an apparent increase in a rated maximum tonnage or die size in accordance with an exemplary embodiment of the present invention as compared to a conventional machine by at least 1.5 times.

Another aspect of the present invention is that embodiments of the present invention can foil stamp die surface areas in excess of 80 inches squared (8 by 10). Another aspect of the present invention is the ability to increase effective die area.

Another aspect of the present invention is the ability to greatly reduce the impact across the honeycomb to die.

Another aspect of the present invention may be the increased serviceable life of the press due to reduced impact.

Another aspect of the present invention is the use of an inline switch to activate the dwell system.

Another aspect of the present invention is the use of a single pole double throw pneumatic switch for simultaneous deactivation of the clutch and activation of the brake.

Another aspect of the present invention is the use of an exhaust valve for relief of clutch pressure upon pneumatic switch activation to deactivate the clutch.

Another aspect of the present invention is the use of a brake motor.

Another aspect of the present invention is the use of off the shelf in combination with custom parts.

Another aspect of the present invention is the customization of the belt driven flywheel for application of the clutch.

Another aspect is the use of the original press brake as mounted on the flywheel opposite of the belt driven flywheel.

Another aspect of the present invention is that the conventional electronics and safety operations are still functional.

Another aspect of the present invention is to maintain the functionality of the conventional system when the dwell system is not engaged.

Another aspect of the present invention is the use of a limit switch to enable braking at top dead center while accounting for ambient conditions.

Another aspect of the present invention is the use of conventional springs in synergy or in cooperation with the flywheel brake.

Conventionally, the flywheel brake (on a KLUGE) is just for an emergency stop or a user initiated stop. Both emergency and user-initiated stop by depressing, for example, a stop button, kill power to the motor.

In accordance with embodiments of the present invention, another aspect of the present invention is the use of the original equipment flywheel brake to brake the honeycomb plate as it closes upon the platen.

In embodiments of the present invention, another aspect is that the flywheel brake is now applied in combination with other components to stop the drive shaft on top dead center.

Another aspect of the present invention is that the honeycomb and the die/platen meet at top dead center.

Another aspect of the present invention is to maintain the safety features of the press in non-dwell mode.

Another aspect of the present invention is to provide equivalent safety features in dwell mode.

Another aspect of the present invention is that in non-dwell mode, emergency stop kills power to the motor and applies the flywheel brake, as in conventional mode. Emergency stop is triggered by, for example, opening of a safety gate. Alternately, the same stopping procedure, killing power to the motor and applying the flywheel brake, is performed if the user presses the stop button in conventional mode.

In accordance with embodiments of the present invention, another aspect is that in dwell mode an emergency stop, kills power to the motor, disengages the clutch, applies the flywheel brake, and applies the motor brake. As in non-dwell mode, a gate opening can trigger an emergency stop. And also as in the non-dwell mode, pressing the stop button initiates the same stopping procedure, killing power to the motor, disengaging the clutch and applying both the original flywheel brake and the motor brake.

Another aspect of the present invention may be an increased diameter size of drive shaft to accommodate any induced torsion from the dwell operation starting and stopping rotation of the shaft, which is driven at one end and braked at the opposite end of the shaft. In contrast, non-dwell operation has a continuous rotation with each foil press application. In the dwell mode the clutch disengages the drive wheel on one end of the drive shaft and brakes the free flywheel on the opposite shaft end with each foil application.

Still another aspect of the present invention is maintaining reliability of the motor mount shaft by welding the shaft to preclude any non-rotational displacement, in contrast to the conventional motor mount shaft which is secured with collars and ⅛ inch pins.

Another aspect of the present invention is the placement of the 5, or greater, gallon air tank within the conventional press footprint. In accordance with another embodiment the 5 gallon tank is mounted exterior to the press.

Another aspect of the present invention is the modification of the original drive flywheel to accommodate mounting of the pneumatic clutch on the same.

Still another aspect of the present invention is to disengage the clutch and to use conventional mounted springs in arms, shown for example in FIG. 4, to absorb impact energy of the now non-driven honeycomb onto the die in dwell mode. In contrast, in non-dwell mode and as on a conventional press, if the springs are used, they are employed to absorb compression forces as the honeycomb continues to be driven into the die.

Those skilled in the art will further appreciate the above-noted features and advantages of the invention together with other important aspects thereof upon reading the detailed description that follows in conjunction with the drawings.

BRIEF DESCRIPTION OF THE FIGURES

FIGS. 15C-15D are stamped with increasing dwell time, in accordance with an exemplary embodiment of the present invention;

FIG. 22C shows the desired stamp result using an exemplary embodiment of the present invention;

DETAILED DESCRIPTION OF THE INVENTION

For more complete understanding of the features and advantages of the present invention, reference is now made to the detailed description of the invention along with the accompanying figures. The present invention uses the conventional feed system and the conventional delivery system on a foil stamping press. Braking the drive shaft and uncoupling the drive flywheel from the drive shaft, maintains the press timing and coordination of the different operating systems while providing an increased dwell time and an increased die load stamping capacity. The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Parallel reference numbers across figures may refer to like elements for ease of reference. Reference numbers may also be unique to a respective figure or embodiment.

Figure 4:
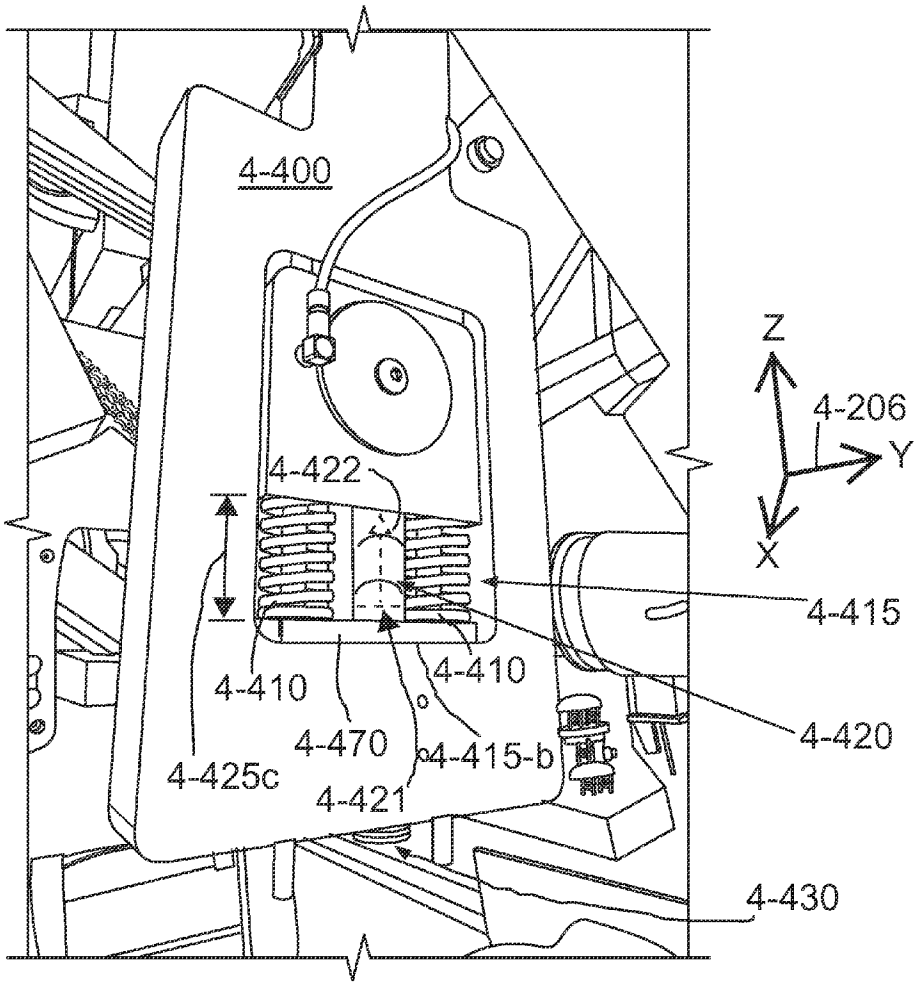
FIG. 4 shows a moveable arm with spacer and springs, in accordance with an original equipment arm of an exemplary embodiment of the present invention.

FIG. 4 shows one of two parallel moveable arms 4-400 in a conventional no dwell state, where the springs 4-410 neither compress nor expand during pressing as the framed space, spring window, 4-415 is secured across the cylindrical spacer 4-420, in accordance with an exemplary embodiment of the present invention. The spring window 4-415 is reduced in length 4-425*c* by a reducer 4-470. In turn, both spacer 4-420 and parallel springs 4-410 span the height, Z direction 4-206, 4-425*c* of the window 4-415. In the field, in accordance with an exemplary embodiment of the present invention, the cylindrical spacer 420 can be raised 4-422 so it extends only to line position 4-421. The spacer remains in its X-Y position and the springs 4-410 are now in a compressible configuration within the arm 4-400. In accordance to an exemplary embodiment, in the field, an adjustment 4-430 readily reconfigures the arm 4-400 into a spring compressible configuration by raising 4-422 the cylindrical spacer 4-420. In accordance with exemplary embodiments of the present invention, using the cylindrical spacer and springs takes advantage of original equipment. In accordance with alternate embodiments, an alternate shock or impact absorber may be used. Or an alternate means of allowing the springs 4-410 to extend past the spacer 4-420 and within the window 4-415 may be employed. Spring function is further described below with brief reference to FIG. 23A.

Figure 5A:
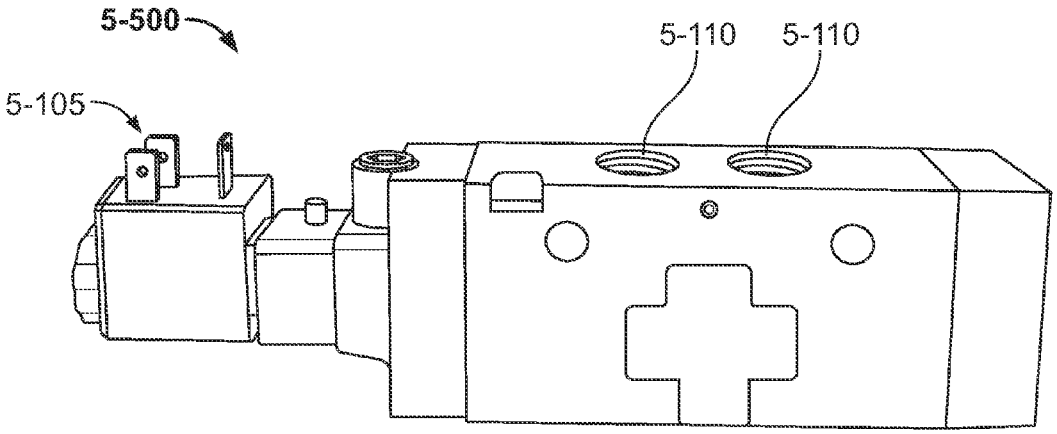
FIGS. 5A and 5B show an air intake side and an output side of a pneumatic single pole double throw switch, respectively, in accordance with an exemplary embodiment of the present invention.
Figure 5B:
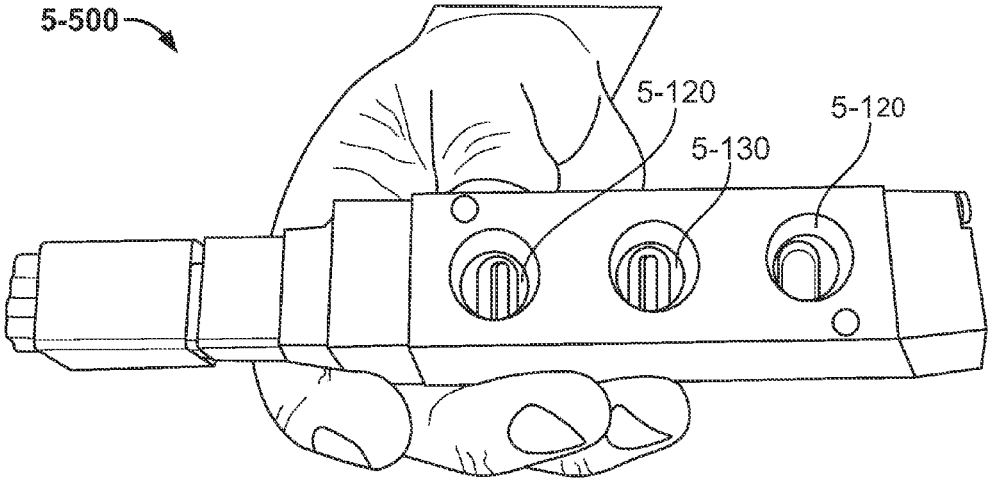

FIGS. 5A and 5B show an air intake and output side and a bottom side of the pneumatic single pole double throw switch that releases the clutch, free wheeling the drive shaft, and engages the original equipment brake on the right flywheel, the non-drive flywheel, in accordance with an exemplary embodiment of the present invention. In accordance with an alternate embodiment the brake on the non-driven flywheel is a compatible non-original equipment air brake. Pneumatic switch 5-500, such as a 145 psi size that is CE marked, has output ports 5-110 and electrical contacts 5-105 to signal the pneumatic switch. One of ports 5-110 provides the input to the clutch and the other provides the input to the brake. Turning to FIG. 5B, the exhaust ports 5-120 flank the regulator air port 5-130 are shown. One exhaust port 5-120 is for the brake and the other exhaust port 5-120 is for the clutch.

Figure 6:
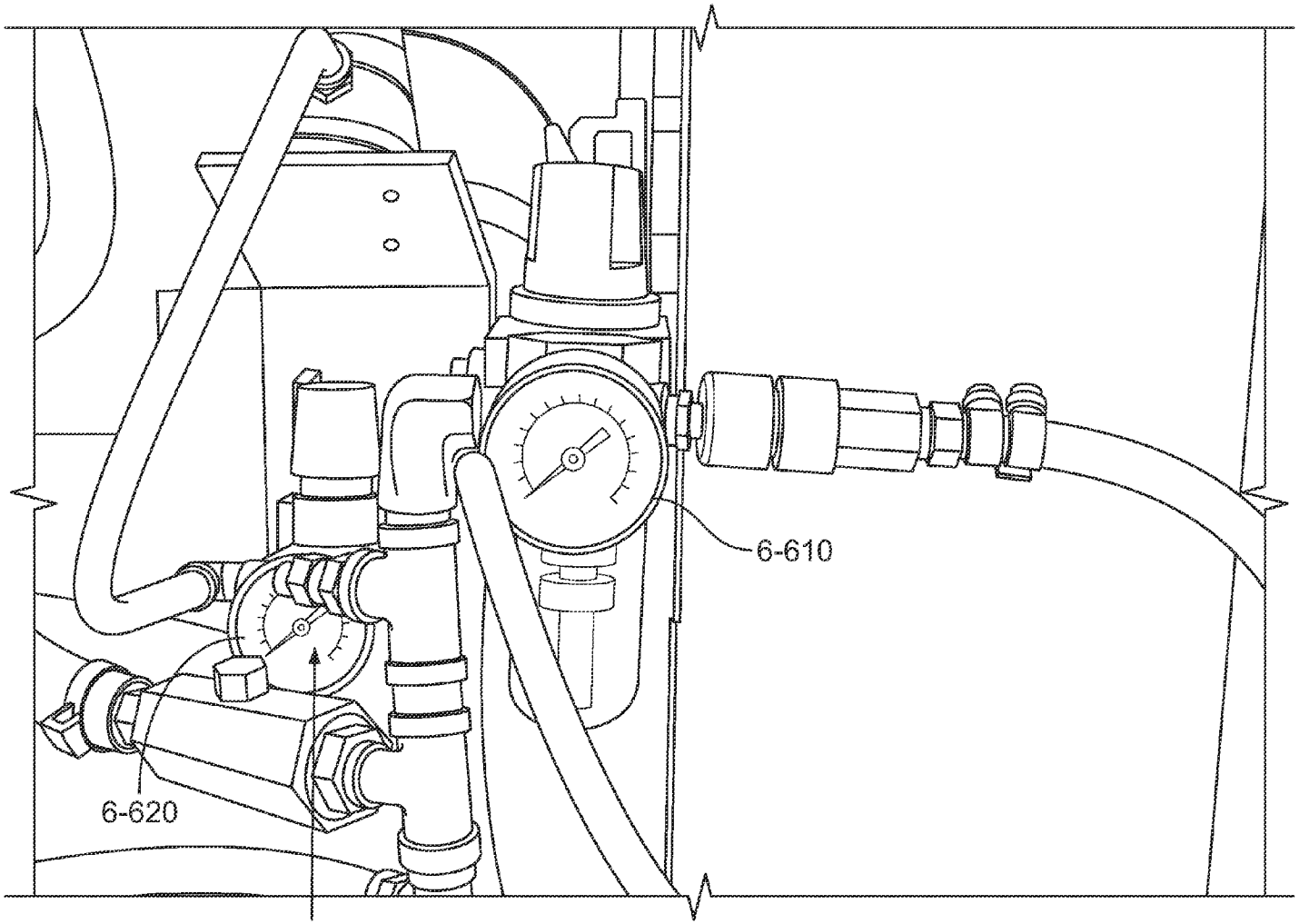
FIG. 6 shows an existing equipment main pneumatic regulator and an auxiliary regulator, in accordance with an exemplary embodiment of the present invention.

FIG. 6 shows an existing equipment main pneumatic regulator and an auxiliary regulator, in accordance with an exemplary embodiment of the present invention. The main pressure regulator 6-610 maintains pressure for the convention pneumatic operating system for the press. This regulator is employed on a conventional press and is used in accordance with embodiments of the present invention to ensure air pressure is maintained at desirable operation levels both in dwell and non-dwell mode. The main regulator 6-610 maintains 90 psi for the press system, even when activating the switch in FIGS. 5A and 5B. The back regulator 6-620 in FIG. 6 is for the air nozzles for separation of the spent foil supply from the stamped image sheet, shown for example in FIG. 18. A third regulator, not shown, down stream of the press regulator 6-610, regulates pressure to the clutch and, in turn, may be independently regulated. Further, a 6 gallon pressurized air tank boosts the air supply to the switch such that the system supply is held constant, tank not shown, in accordance with an exemplary embodiment of the present invention. Field operations verify constant main pressure at 90 psi at the main regulator 6-610 with employment of the booster tank during clutch and brake switching in dwell mode. In accordance with an exemplary embodiment the booster tank is mounted within the original footprint of a conventional press.

Figure 7:
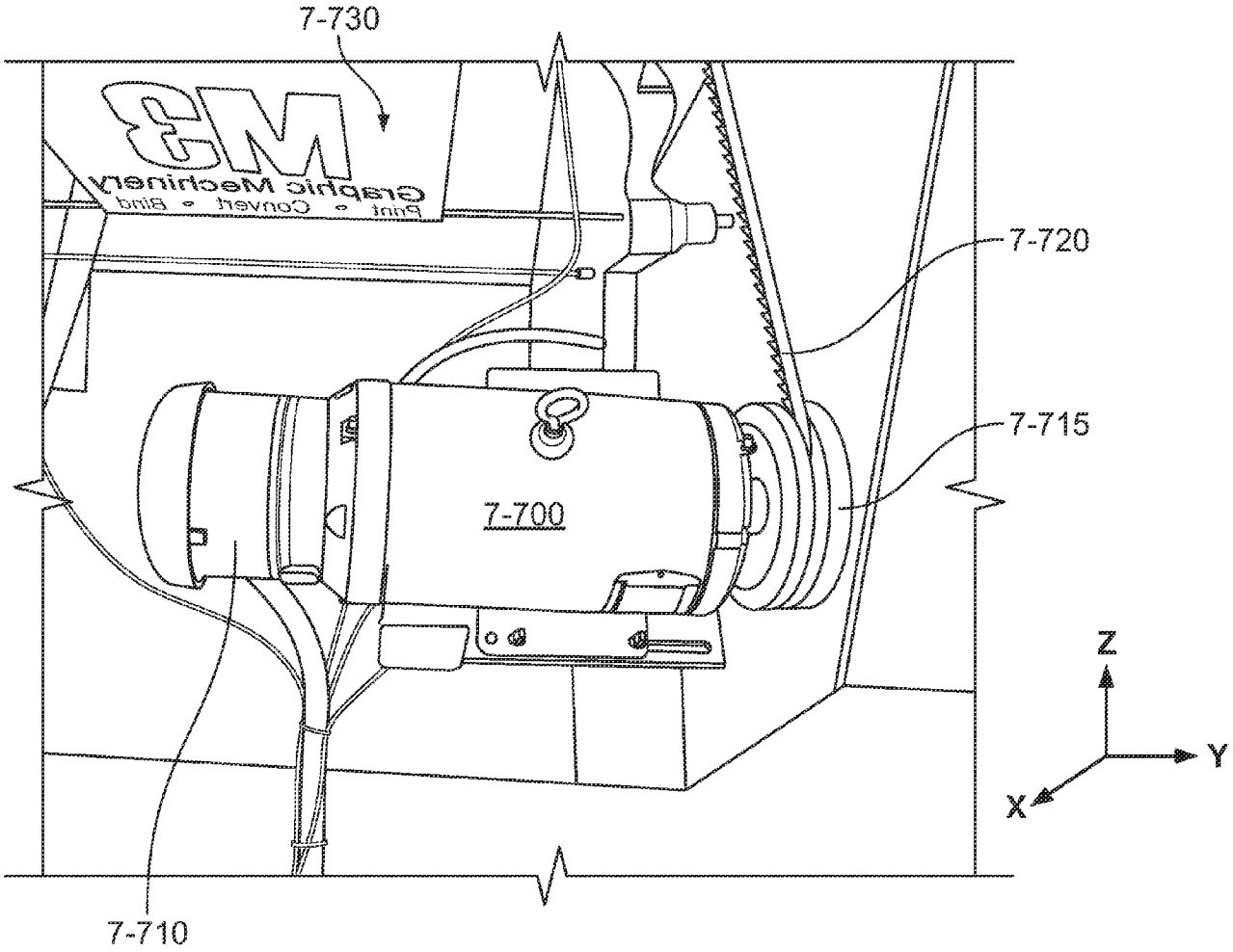
FIG. 7 shows a 5 horsepower (HP) drive motor with brake, in accordance with an exemplary embodiment of the present invention.

FIG. 7 shows a 5 HP drive motor with brake, in accordance with an exemplary embodiment of the present invention. Motor 7-700 is installed at the conventional drive motor location with the 7-715 pulley in conventional position relative to the XZ and YZ plane. Drive belt 7-720, shown in FIG. 7 is exemplary and may have in alternate configuration in alternate embodiments. Belt 7-720 connects to the drive fly wheel via one or more pulleys, not shown. The drive flywheel and its flywheel belt are shown, for example in FIG. 9B. Conventionally, a foil press, such as a 14×22 EHD, may be driven by a 3 HP motor. In addition to the larger motor, a motor brake is 7-710 is added to the drive source, in accordance with exemplary embodiments of the present invention. In accordance with an exemplary embodiment of the present invention a larger starter sized to accommodate the 5 HP motor is also installed, starter not shown. Also shown is the takeup of spent foil supply 7-730.

Figure 8:
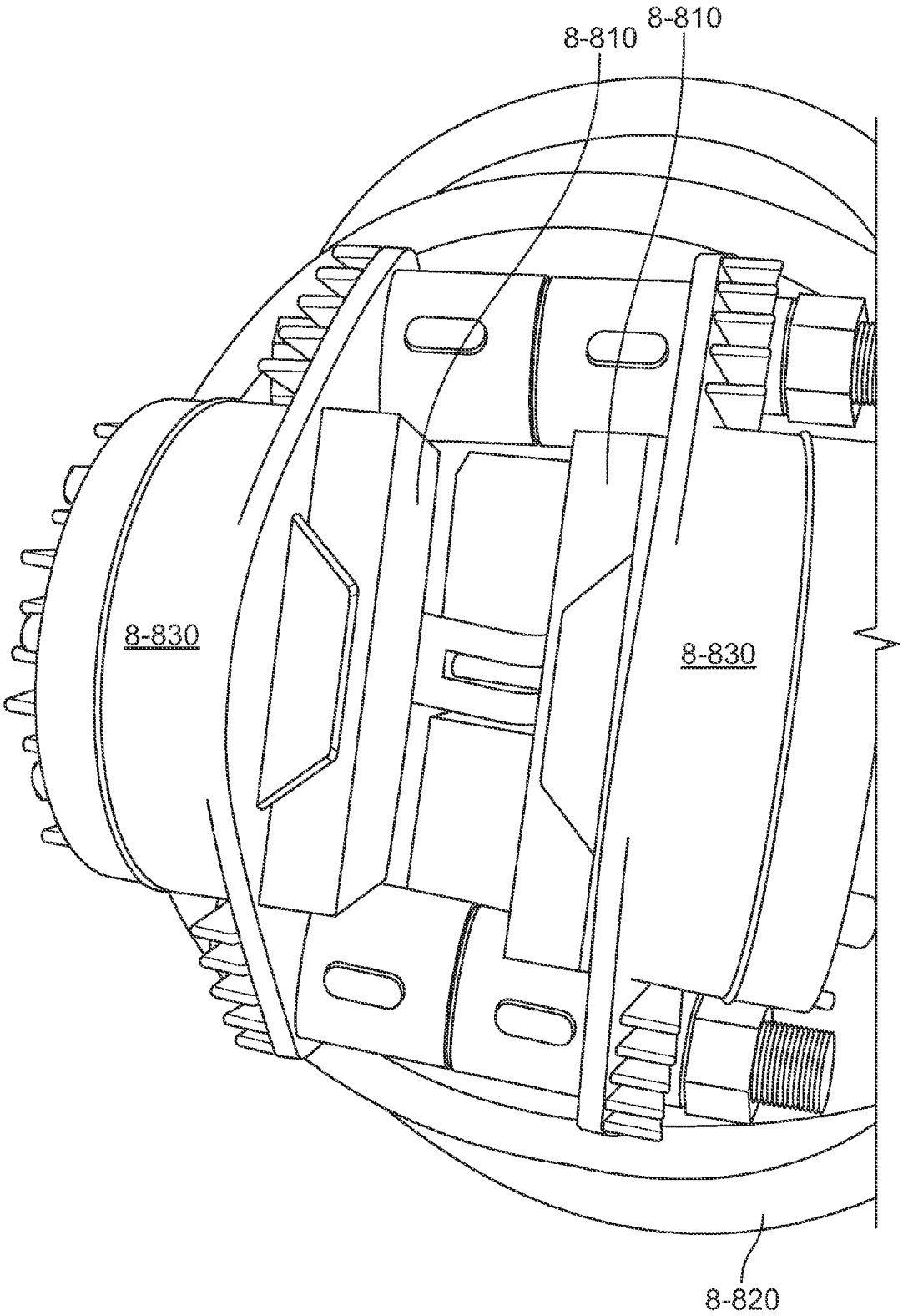
FIG. 8 shows an original equipment brake, which is applied to the free flywheel, in accordance with an exemplary embodiment of the present invention.

FIG. 8 shows an original equipment brake 8-162, unmounted, which is applied to the free flywheel, in accordance with an exemplary embodiment of the present invention. Referring briefly again to FIG. 1C, This brake 162 is applied to this far right 152 flywheel 160 when the stop button, not shown, is depressed by the user or if triggered for safety. The far right 152 flywheel 160 connects to the drive shaft 155 but does not connect to any pulleys or cams. Referring again to FIG. 8, brake pads 8-810 will be mounted on either side of the free flywheel. A single pneumatic hose 8-820 connects to the brake. Brake diaphragm and caliper housings 8-830 flank respective brake pads 8-810. Operation of the brake in dwell mode is further described below.

Figure 9A:
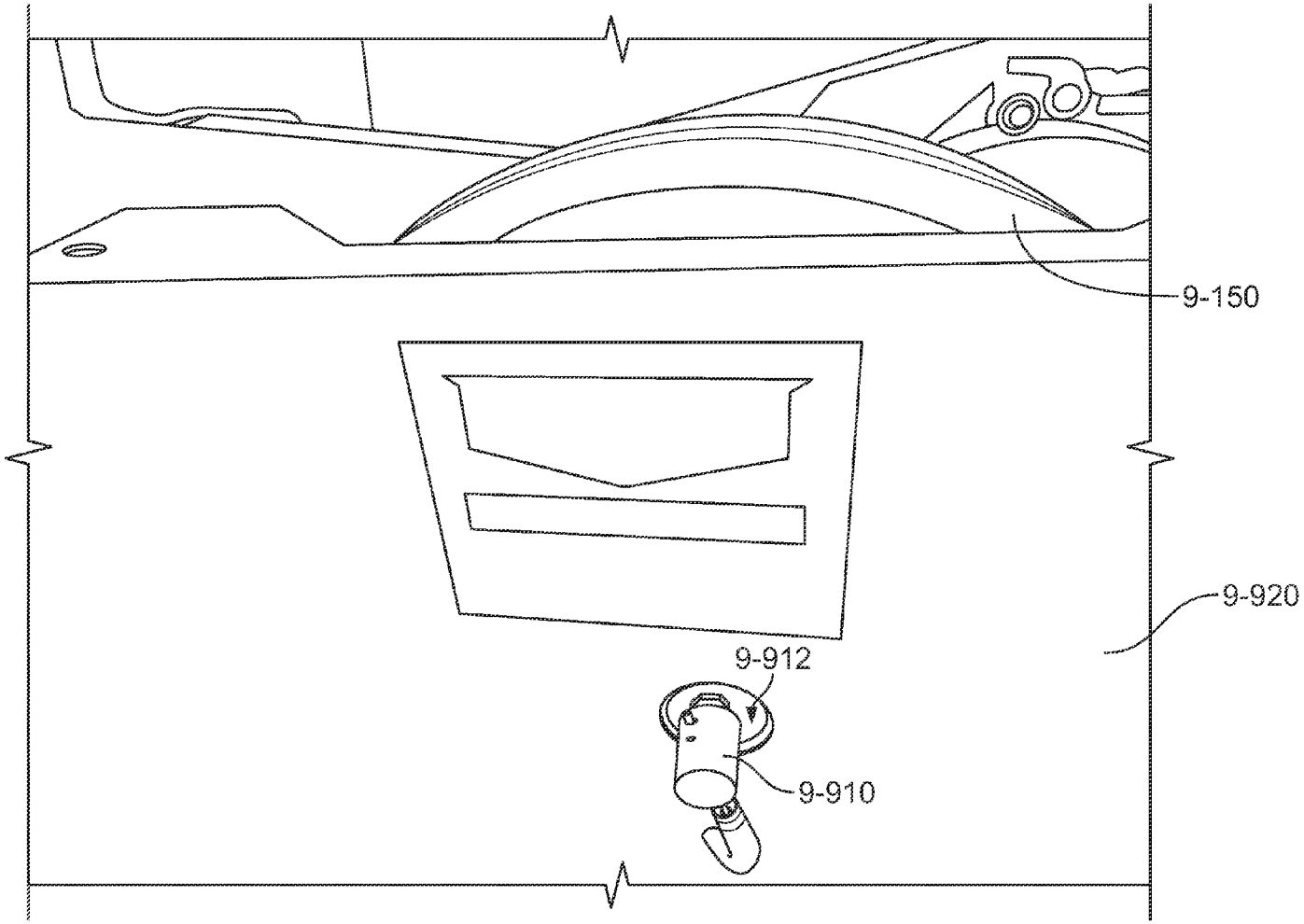
FIG. 9A shows a front perspective view of an air connection side of a clutch mounted on the driving flywheel, extending from an opening in a side guard.

FIG. 9A shows front perspective view of an air connection side of a clutch mounted on the driving flywheel, extending from an opening in a side guard. Turning to FIG. 9A, air connection 9-910 extends from an opening 9-912 in a side guard 9-920. In accordance with an exemplary embodiment this connection is also surrounded by a clutch guard during operation of the press, clutch guard not shown. The drive flywheel 9-150 is shown at the top of the figure.

Figure 9B:
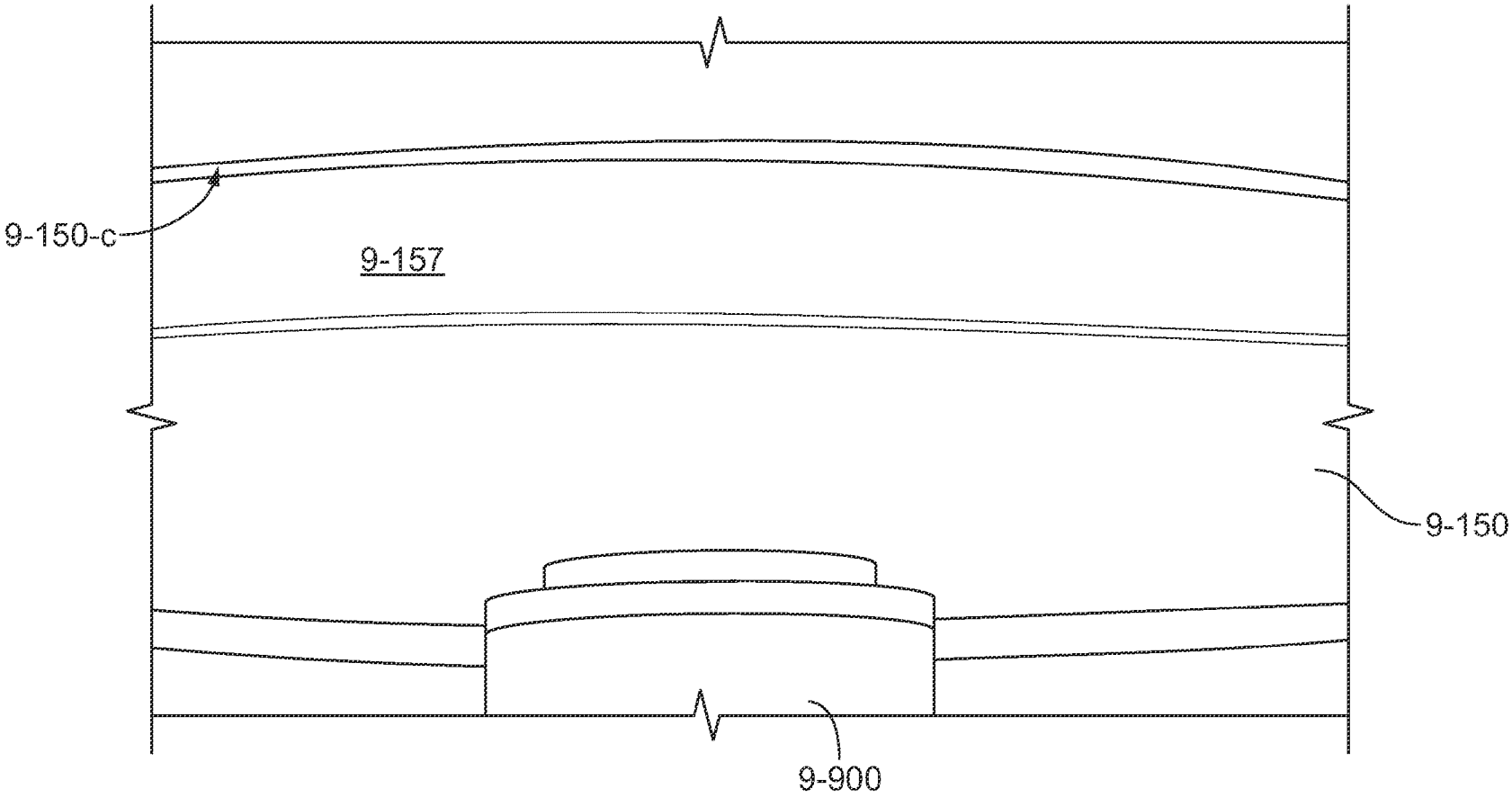
FIG. 9B shows a top perspective view of the clutch mounted on the same belt driven flywheel, in accordance with an exemplary embodiment of the present invention.

FIG. 9B shows a top perspective view of the clutch mounted on the same belt driven flywheel, in accordance with an exemplary embodiment of the present invention. The drive belt 9-157 on the drive flywheel 9-150 can be seen sitting in the drive flywheel channel 9-150-*c*. And a top of the pneumatic clutch 9-900 is shown mounted on the flywheel 9-150. Operation of the clutch in dwell mode in accordance with an exemplary embodiment of the present invention is described below.

Figure 10:
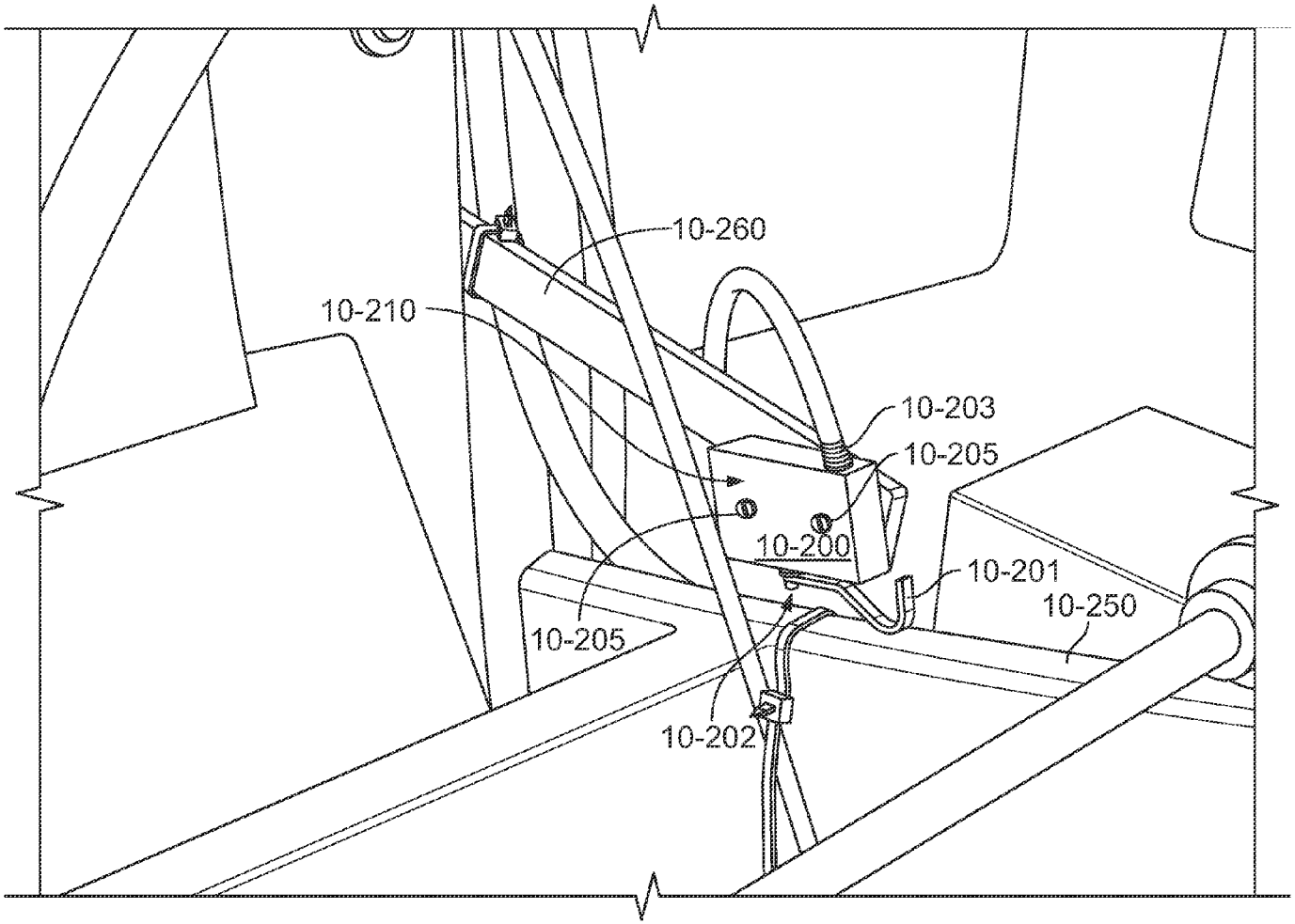
FIG. 10 shows a limit switch mounted on the foot of the frame, in accordance with an exemplary embodiment of the present invention.

FIG. 10 shows a limit switch mounted on the foot of the frame and triggered by the rocking of the bed, in accordance with an exemplary embodiment of the present invention. The switch 10-200 is mounted on a stationary arm 10-260. The limit switch sensor 10-201 rests atop the bed 10-250. A screw or other fastener 10-202 secures the sensor 10-201 to the sensor housing 10-210. An electrical connector 10-203 is shown connecting to the top of the limit switch 10-200. Fasteners 205 secure the limit switch housing 10-210 to the stationary arm 10-260.

Figure 13A:
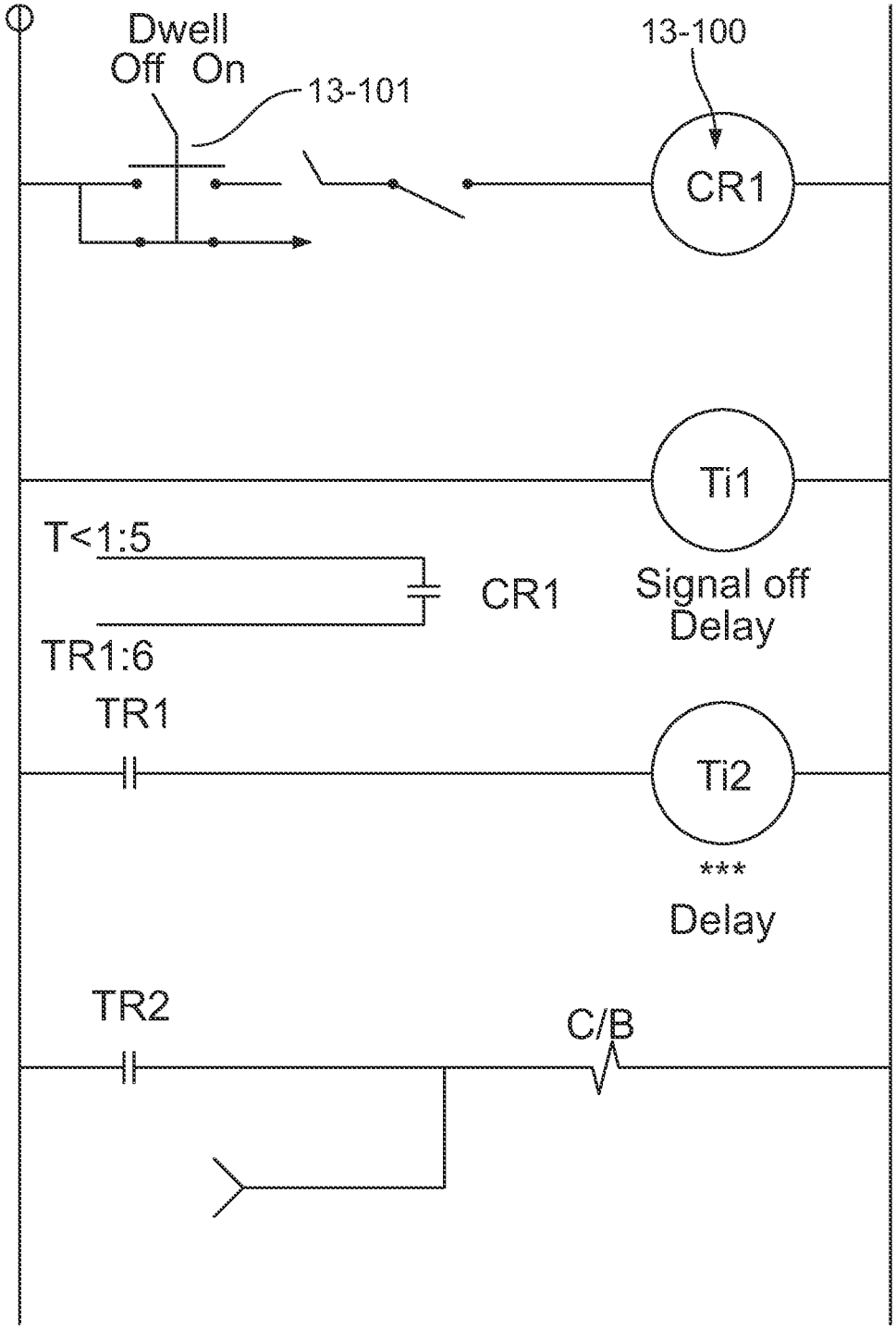
FIG. 13A is a summary diagram of the added circuitry, in accordance with an exemplary embodiment of the present invention.
Figure 13B:
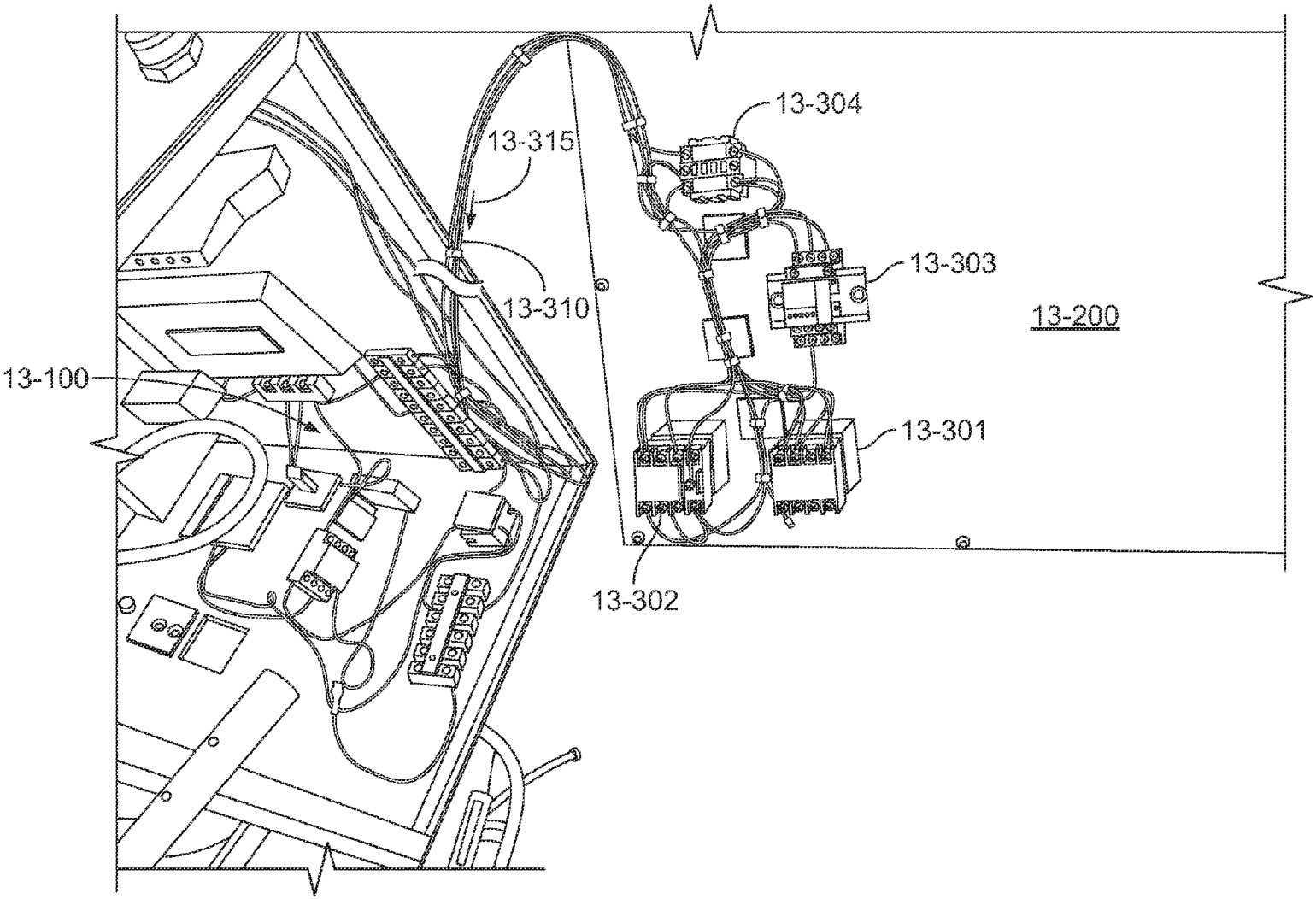
FIG. 13B is a view of the components of FIG. 13A, as wired into a press, in accordance with an exemplary embodiment.

This limit switch 10-200 triggers timer T1, shown for example in FIGS. 13A-13B, to set the delay for triggering the pneumatic switch to disengage the clutch on the driven flywheel and activate the brake on the non-drive right flywheel, in accordance with an exemplary embodiment of the present invention. This limit switch may function as a drift switch and can be adjusted to account for the ambient conditions in field applications, in accordance with an exemplary embodiment of the present invention. At field installation, timer T1 will be adjusted up or down to achieve clutch off and brake on at top dead center as further described in reference to FIGS. 11A and 11B. During operation, the time T1 is readjusted when the user changes the IPH operating speed of the press.

Figure 11A:
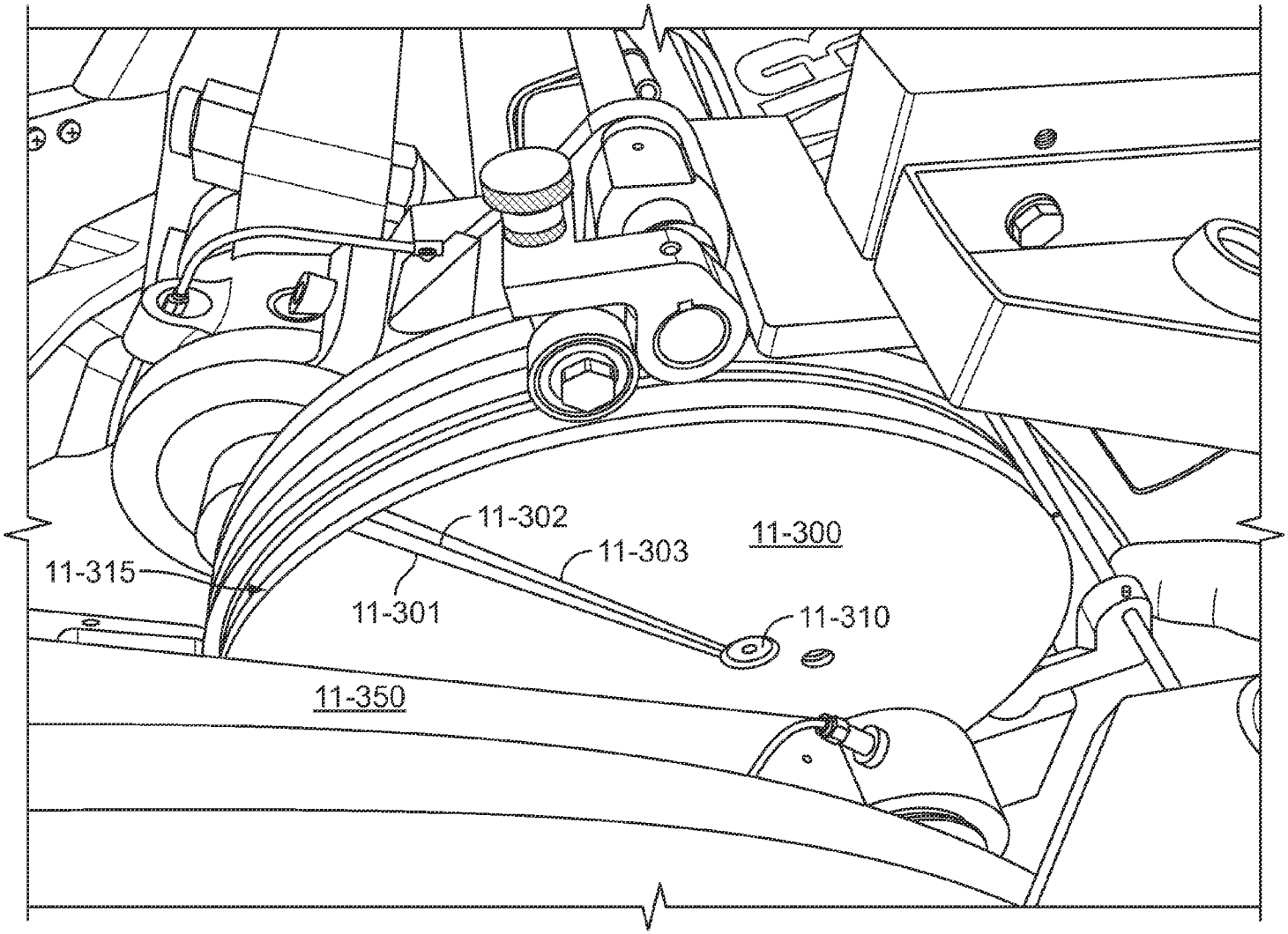
FIG. 11A shows a front to perspective view of the markings on a head cam for identifying top dead center, in accordance with an exemplary embodiment of the present invention.
Figure 11B:
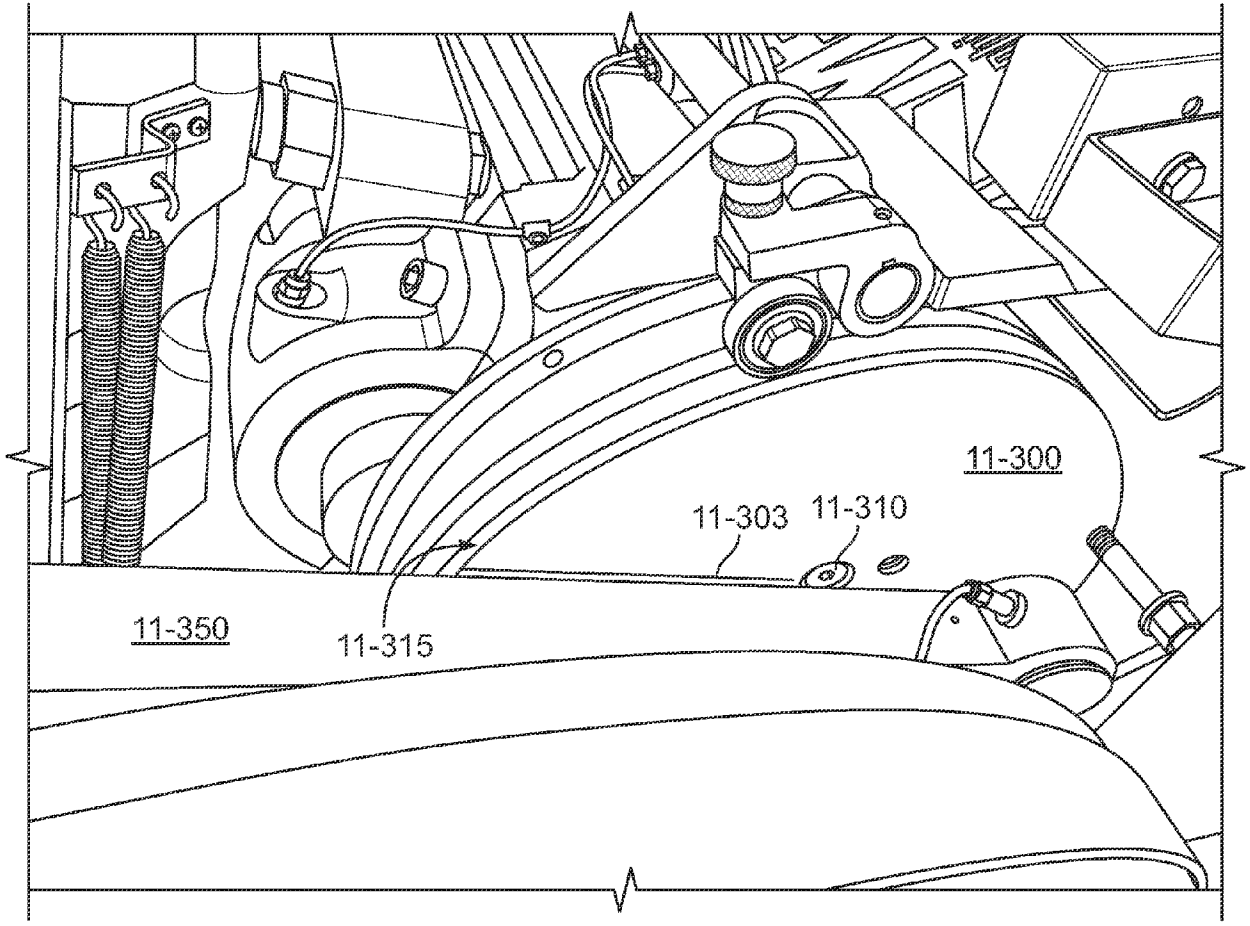
FIG. 11B shows a front top perspective view the cam of FIG. 11A, stopped at top dead center, the point of impact of the honeycomb on the platen, in accordance with an exemplary embodiment of the present invention.

FIG. 11A shows markings on a head cam for identifying top dead center, the point of initial impact of the honeycomb upon the die mounted platen, in accordance with an exemplary embodiment of the present invention. Turning to FIG. 11A, the head cam 11-300 has a center 11-310 from which three lines 301, 302, and 303 radiate to the cam circumference 11-315. Line 11-302 corresponds to top dead center, where the honeycomb plate meets the platen, honeycomb and platen shown for example in FIG. 1C. Lines 11-301, 11-303 represents a range for capturing top dead center, in accordance with an exemplary embodiment of the present invention. Referring again to FIG. 11A, press arm 11-350 is stationary and will be the reference point for the markings 11-301-11-303. FIG. 11B shows the cam of FIG. 11A, stopped at top dead center 11-303, the point of impact of the honeycomb on the platen, in accordance with an exemplary embodiment of the present invention. The clutch has been disengaged, uncoupling the drive flywheel from the shaft and the brake has stopped the drive shaft and the honeycomb is still in its approach to the platen, in accordance with an exemplary embodiment of the present invention.

Timer T1, shown for example in FIGS. 13A and 13B, is adjusted to increase the delay or decrease the delay until the marking 11-303 on the head cam 11-300 aligns with the adjacent press arm 11-350, as shown in FIG. 11B. In practice, a user will adjust T1 with each change in press IPH, operating speed. The markings on the head cam will be readily visible with the safety guards present, in accordance with an exemplary embodiment of the present invention. In accordance with another exemplary embodiment top dead center lines are on the circumferential rim 11-315 of the head cam 11-300, so that alignment with top dead center can be seen from the front of the press, where the front is shown for example in FIG. 1A 121. The adjustment knob for time T1, in accordance with an exemplary embodiment, is on a front plate of the press, see FIG. 21. The adjustments to T1 are made on the fly, while the press is running at the desired IPH, in accordance with an exemplary method.

Figure 12A:
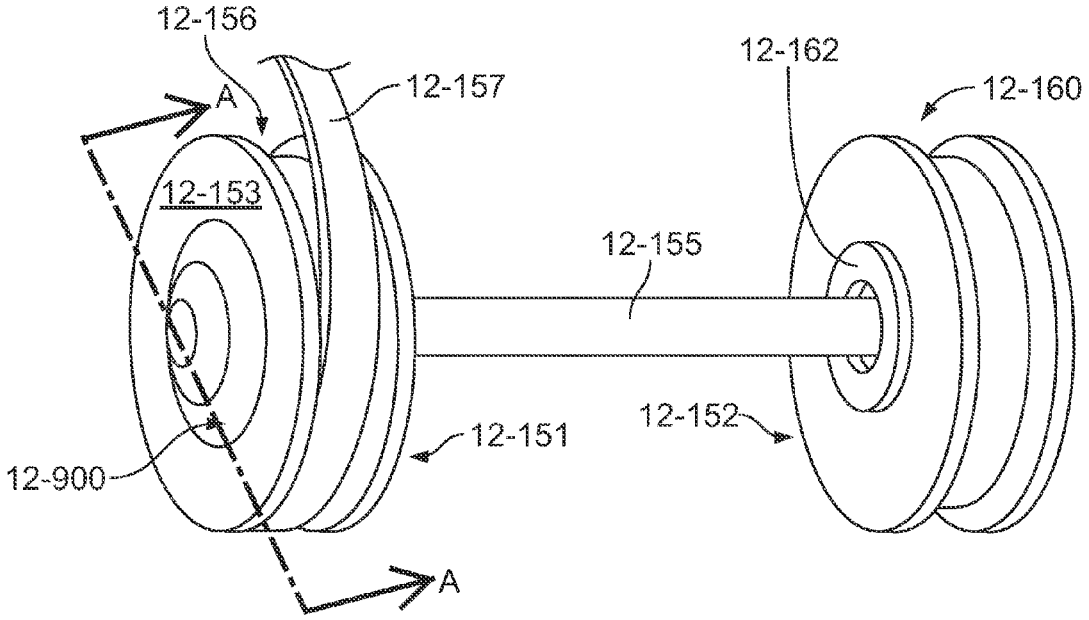
FIG. 12A is a block view of the drive shaft, drive flywheel, free flywheel, brake and clutch, in accordance with an exemplary embodiment of the present invention.

FIG. 12A is a block view of the drive shaft, drive flywheel, free flywheel, brake and clutch, in accordance with an exemplary embodiment of the present invention. FIG. 12A shows drive shaft 12-155 with a left side 12-151 and a right side 12-152. The drive flywheel 12-153 is connected to a left side 12-151 of the shaft 12-155 and the free, or non-driven, flywheel 12-160 is connected to the right end 12-152 of the shaft 12-155. A pneumatic clutch 12-900 is mounted on the drive flywheel 12-153. The drive belt 12-157 rides in channel 12-156. The original equipment brake 12-162 is mounted on the free wheel 12-160. Also shown in FIG. 12A is cross sectional view line A-A, said view shown in FIG. 14B.

Figure 12B:
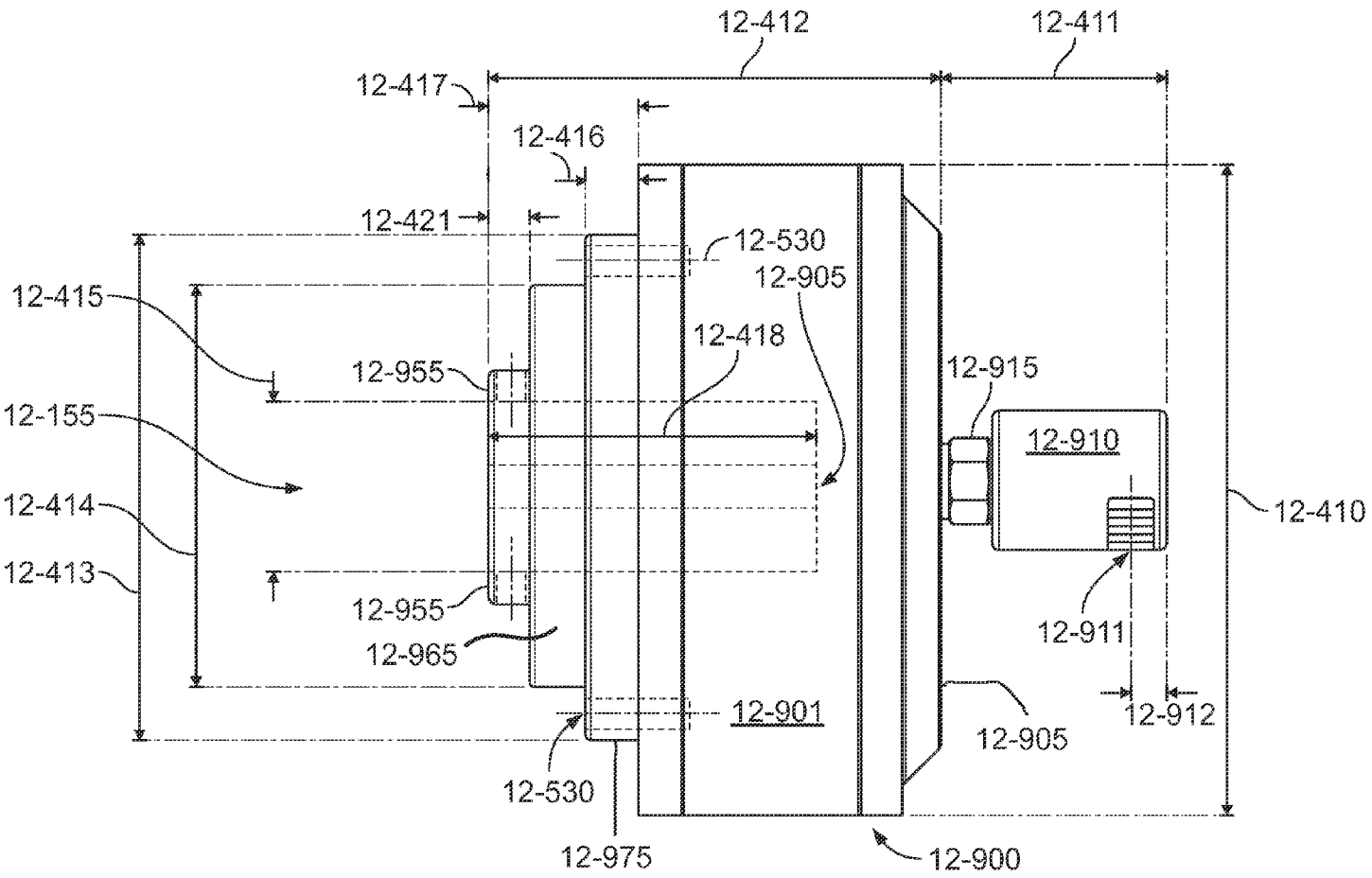
FIG. 12B is a top view of a clutch with dimensions and bore holes superimposed, in accordance with an exemplary embodiment of the present invention.

FIG. 12B is a top view of a clutch with dimensions and bore holes superimposed, in accordance with an exemplary embodiment of the present invention. The air connection 12-910 has its pneumatic inlet 12-911 and is secured to clutch 12-900 via, at least, fitting 12-915. In accordance with an exemplary embodiment, the distance from air inlet 12-911 center to the edge of the air connection 9-912 may be about 0.50 inches. Clutch 12-900 mounts on the drive flywheel and is secured 12-955 to the drive shaft 12-155. In addition, in according to an exemplary embodiment, the following dimensions are provided: clutch housing 12-901 diameter 12-410 of about 8.0 inches, depth 12-411 of 2.65 inches of the air connection 12-910; and a clutch assembly depth 12-412 of 5.4 inches of the clutch 12-900 from its outer edge to a securing ring 12-955, which may be a shrink disc, in accordance to an exemplary embodiment. Two tap holes 12-530 for mounting the clutch 12-900 on the drive flywheel 12-155 are shown as hidden lines. In accordance with an exemplary embodiment, there are six tap holes evenly spaced with an inside diameter of separation of 12-414 of 4.75 inches and an outer edge diameter 12-413 of 5.97 inches. In an alternate embodiment, the diameter from center to center may have a diameter separation of 5.375 inches. The hollow cylindrical center 12-905 for fitting to the drive shaft 12-155 is shown in hidden lines. The depth 12-418 of the hollow cylindrical center 12-905 has an exemplary depth 12-418 of 3.875 inches and a diameter 12-415 of 2.0 inches. Dimensions of the clutch are exemplary and relative to working prototypes, other clutch dimensions may be utilized in accordance with the present invention. An exemplary depth 12-416 of the clutch diameter 12-965 that slips into the drive flywheel bore, not shown, is 0.65 inches. An exemplary depth 12-421 of the securing disc 12-955 to the clutch housing 12-901 is 0.5 inches. The clutch depth extending from the housing 12-417 can be near 1.8 inches. Mounting screws attach from the backside of the drive flywheel into 12-530

Referring again to FIG. 12A, as in FIG. 1D, the drive belt rests in the circumferential channel 12-156 of the left 12-151 most flywheel 12-153 and serves as the drive flywheel 12-153. The far right 12-152 shows another flywheel 12-160 upon which a pneumatic brake 12-162 is mounted. This brake 12-162 is applied to this far right flywheel 12-160 in emergency conditions or when the stop button is depressed by the user. The far right flywheel 12-160 connects to the drive shaft 12-155 but does not connect to any driven pulleys or cams. The original equipment brake 12-162 on the right flywheel 12-160 is used to hold top dead center in accordance with exemplary embodiments of the present invention in combination with uncoupling of the drive flywheel 12-153 to the shaft 12-155 by the clutch 12-900. Even when non-dwell operation is selected by the user, in accordance with embodiments of the present invention, the clutch 12-900 is pressurized and grabbing/coupling the flywheel 12-153 to the drive shaft 12-155, then, when dwell mode is selected, as timer 2, T2, triggers the pneumatic switch, the brake 12-162 engages the right flywheel 12-160 and the clutch 12-900 depressurizes, releasing/uncoupling the drive flywheel 12-153 from the drive shaft 12-155.

FIG. 13A is a diagram of electrical components of the added circuitry, in accordance with an exemplary embodiment of the present invention. The diagram shows four main branches, from the top a user switch 13-301 for Dwell Off and Dwell On is shown upstream of a limit switch followed by control relay CR1. The circuit has two timers and timer 1 relay TR1 is shown above timer 2 relay, TR2. Up from the timer 2 relay, TR2 is TR1*c*, timer relay 1 contact. The timer 2 relay contact TR2*c* feeds into the solenoid C/B used to trip the pneumatic switch to the clutch and brake. Terminal 5 TR1:5 on the timer 1 relay and terminal 6 TR1:6 on the timer 1 relay are isolated contacts, internally powered. Timer 2 sets the dwell time; expiration of timer 2 triggers the solenoid C/B to release the brake and engage the clutch. Expiration of timer 1 triggers the dwell time, set by timer 2.

FIG. 13B is a view of the components of FIG. 13A, as wired into a press, in accordance with an exemplary embodiment. A back side of the user panel 13-200 is shown with a push button, Dwell Off/Dwell On 13-304 switch mounted above control relay 13-303. At the bottom left, timer 13-302 and a second timer 13-301 are mounted. The timers and push button are within easy user reach when the press is in operation. Electrical connections 13-310 of the user dwell panel 13-200 lead 13-315 to connect to the conventional electronics of the press 13-100, in accordance with an exemplary embodiment of the present invention. Mounted within the conventional electronics housing is a larger starter for the 5 HP motor, as compared to the starter for the 3 HP conventional motor.

Figure 14A:
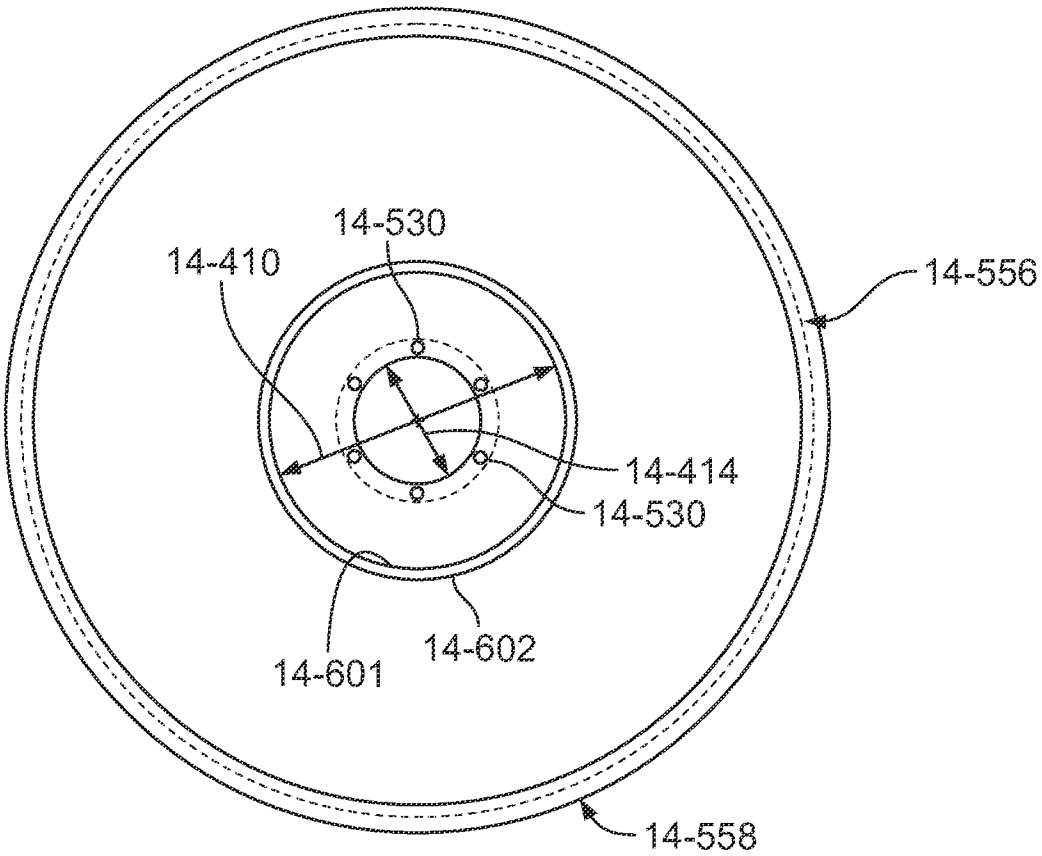
FIG. 14A is a front view of the drive flywheel showing the modifications to the original flywheel, in accordance with an exemplary embodiment of the present invention.

FIG. 14A is a front view of the drive flywheel 14-153' showing modifications to the original flywheel, in accordance with an exemplary embodiment of the present invention. In accordance with an exemplary embodiment 6 holes 14-530 are tapped for mounting of the clutch. The diameter 14-414 is near 4.75 inches, in accordance with an exemplary embodiment. The diameter for the drive shaft is not shown. Referring briefly to FIG. 12B, collar 12-440 of the clutch 12-900 secures the drive shaft to the clutch 12-900. Referring again to FIG. 14A, the outer circumference 14-558 and a ghost line indicates the channel 14-556 in the outer edge of the drive flywheel. Diameter 14-410 is about 6.5 inches, in accordance with an exemplary embodiment. The outer edge 14-602 shows the outermost sidewall of the clutch housing. While inner circle 14-601 shows a circumference of an exemplary clutch top, shown in FIG. 12B 12-905, outer circle 14-602 shows an exemplary outer wall circumference of the clutch housing 12-901, shown in FIG. 12B.

Figure 14B:
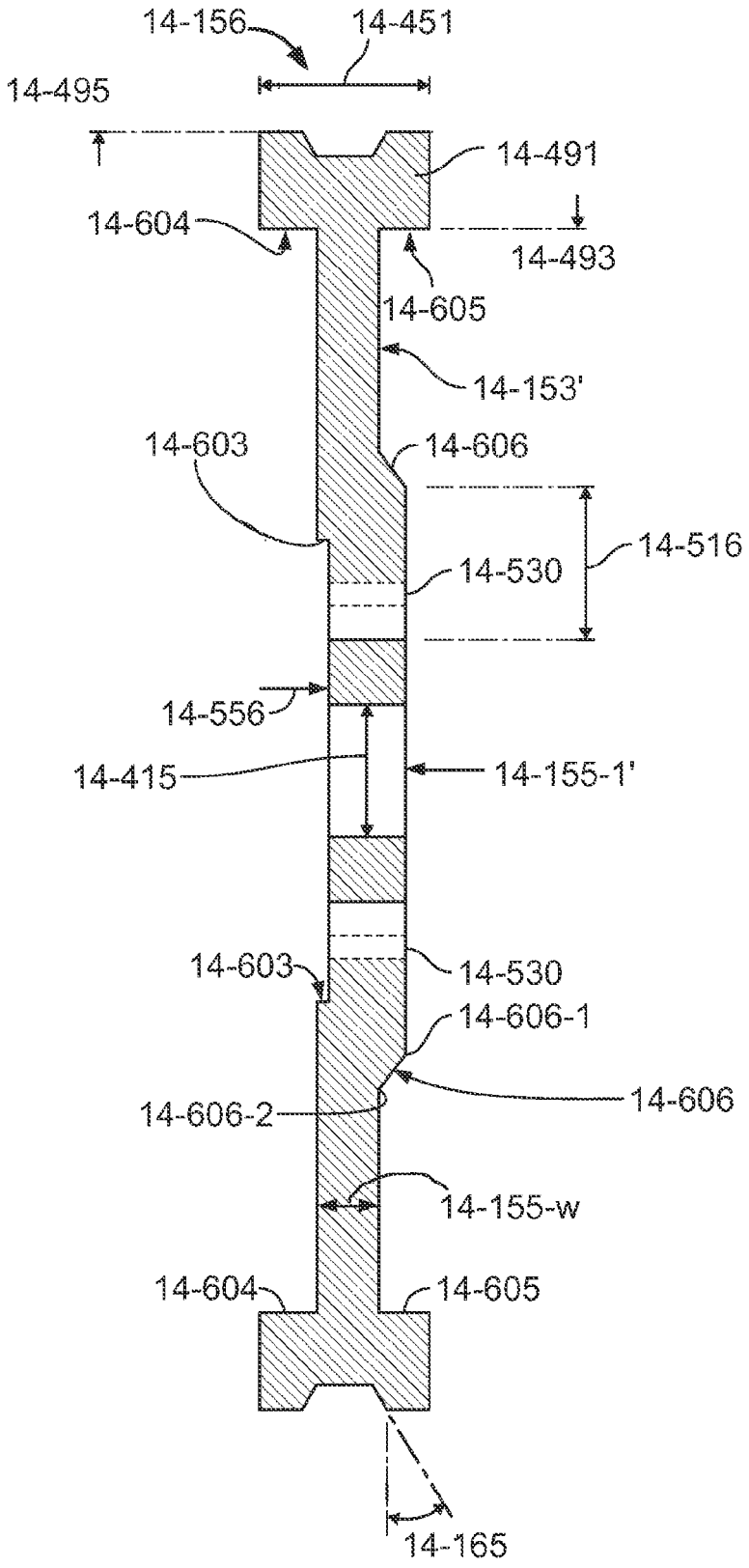
FIG. 14B shows a cross section of the original drive flywheel as modified in accordance with an exemplary embodiment of the present invention.

FIG. 14B shows a cross section of an original drive flywheel 14-153' taken along line A-A in FIG. 12B, as modified with tap holes, in accordance with an exemplary embodiment. Two of six the tap holes 14-530 are shown in this cross sectional view. In accordance with an exemplary embodiment, holes are tapped and have a minor diameter near 13/32 inches. The width 14-451 of the outer rim 14-163 may be about 2.75 inches. Formed into the drive flywheel rim 14-163 is channel 14-156 with an angle 14-165 of 12 degrees. From the rim 14-163 moving towards axial center, the cross sectional width steps 14-604, 14-605 down 14-155-*w*, in accordance with an exemplary embodiment of the present invention, using an original equipment drive flywheel. Still moving towards axial center 14-155' the cross section ramps 14-606-2, 14-606-1 outwards 14-606. Another decreasing step 14-603 before tap holes 4-530 defines the clutch mount area. Width 14-556 may be near 0.85 inches, in accordance with an exemplary embodiment using an original equipment drive flywheel. The drive shaft center hole 14-155-1' may be near a 2.0 inch diameter 14-415, in accordance with an exemplary embodiment using an original equipment drive flywheel. The diameter across step 14-605 may be 28.5 inches, in accordance with an exemplary embodiment. An original equipment drive flywheel is modified with tap holes 14-530 to accommodate mounting of the clutch but may be otherwise maintained in original equipment form, in accordance with an exemplary embodiment of the present invention.

Figure 15A:
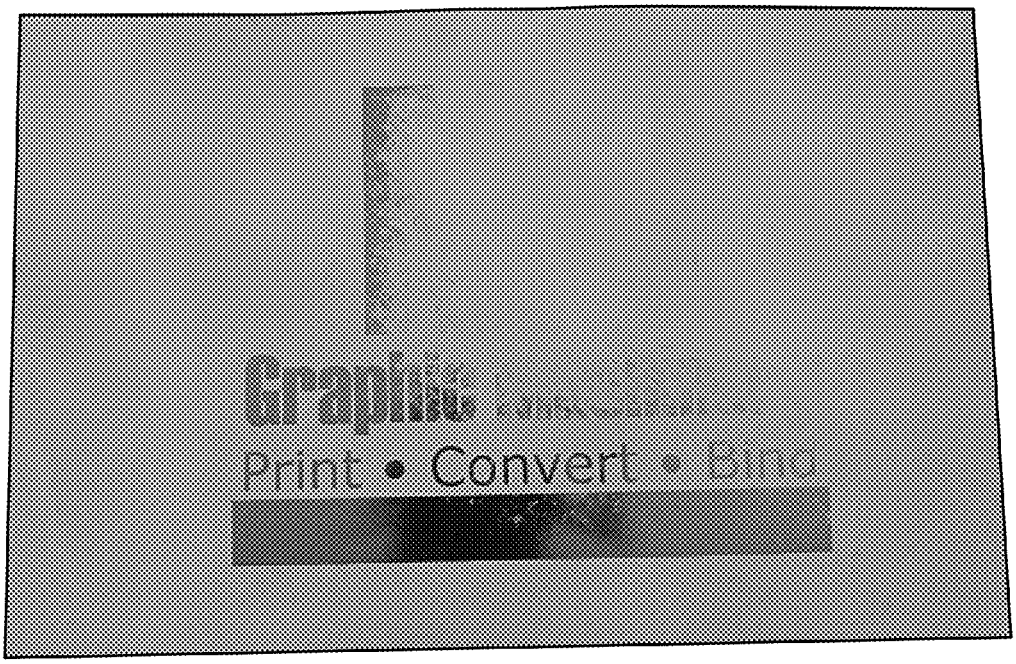
FIGS. 15A-15D are foil stamped images using a same die with respective increasing dwell times.
Figure 15B:
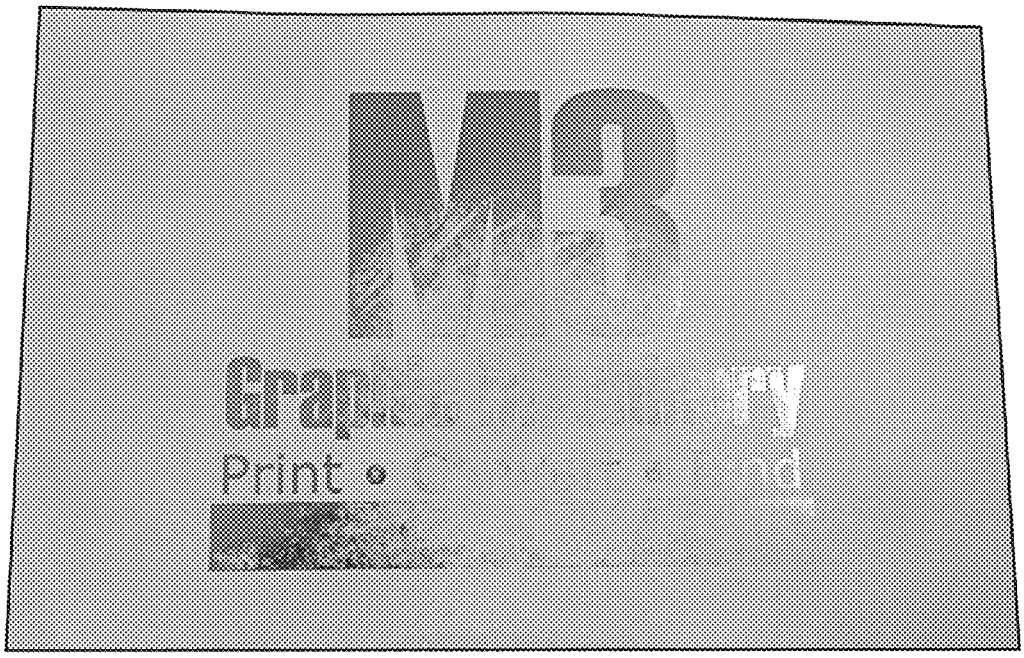

FIGS. 15A-15D show a series of foil stamped images using a same die, where FIG. 15A is made under non-dwell conditions with the drive wheel constantly engaged with the shaft and no brake applied. FIG. 15B is still in non-dwell mode but releases the springs to enable Brandjten dwell, taught for example in U.S. Pat. No. 6,935,228. FIGS. 15A-15D are foil stamped with respective increasing dwell times, with FIGS. 15C-15D having increasing dwell times in accordance with an exemplary embodiment of the present invention. The operating speed, IPH, remains constant across FIGS. 15A to 15D. There is only a 10 degree increase in temperature in FIG. 15D. The image size spans 9.75 by 12 inches. The die manufacturer rated the subject die at 80 tons.

Figure 15C:
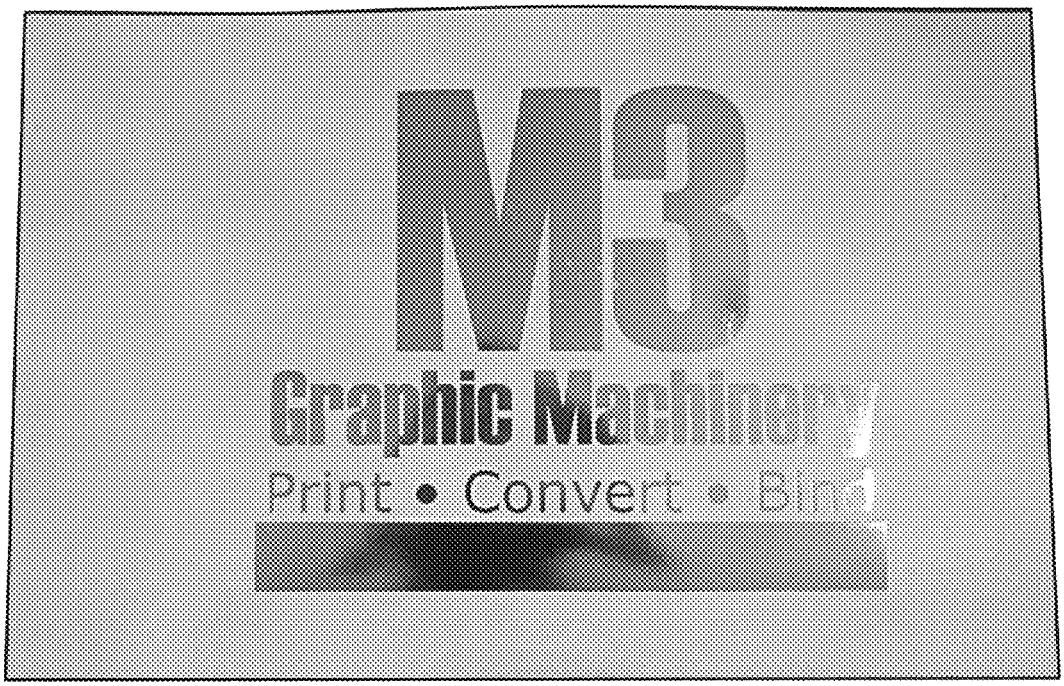
Figure 15D:
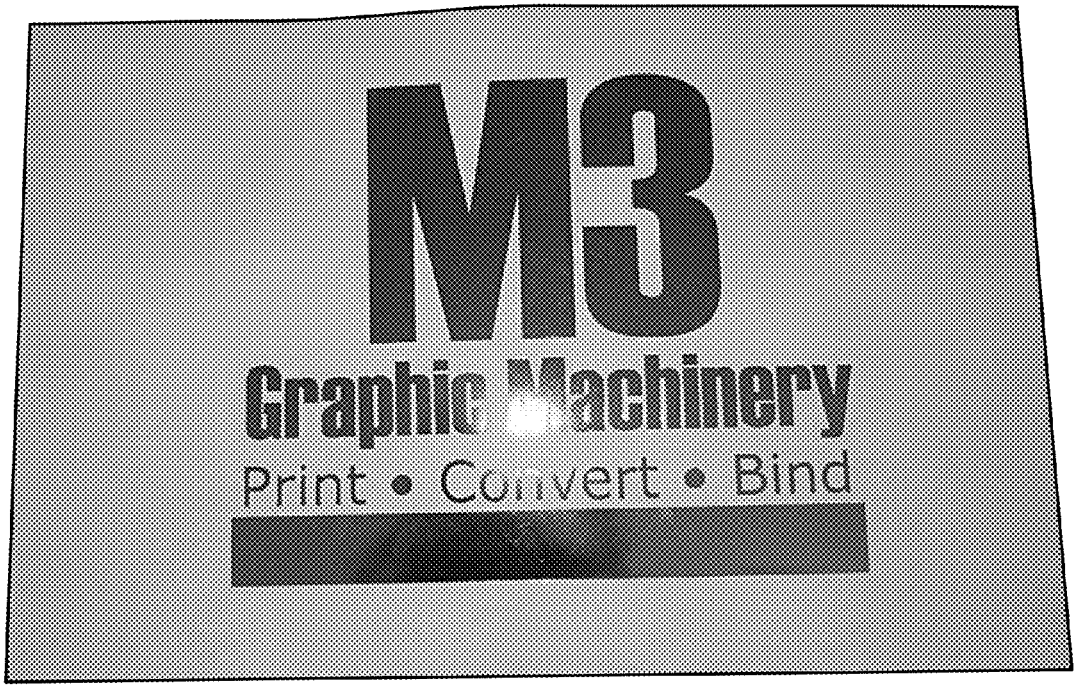

In FIG. 15A, the image is barely visible and is run under conventional-type non-dwell conditions without the springs enabled for the Brandtjen dwell, and without a dwell in accordance with an exemplary embodiment of the present invention. In FIG. 15B, the image is improved and now discernable with an added Brandtjen dwell via the enablement of the springs by releasing the springs about the spacer. There is no means to increase the dwell time further at the given operating speed in a conventional press. Then in FIG. 15C the press is switched over to activate the clutch dwell in accordance with the system and method of the present invention. A simple turn of the switch on the front panel switches to Clutch Dwell mode. As seen from the image in FIG. 15C, the die stamped image continues to improve with an increasing dwell time via a system and method in accordance with an exemplary embodiment of the present invention. The dwell time in FIG. 15C is near 0.5 seconds. Die stamped images continue to increase with increasing dwell time, in accordance with the present invention. And finally in FIG. 15D, the foil stamped image is without blemish, the dwell time has increased slightly over 15C and the temperature is at 280 degrees. 15D corresponds to a dwell of less than 3 seconds. Field tests show that a dwell time increase of about 0.5 seconds improves the stamped image until the image is essentially flawless, as shown in FIG. 15D.

Figure 16:
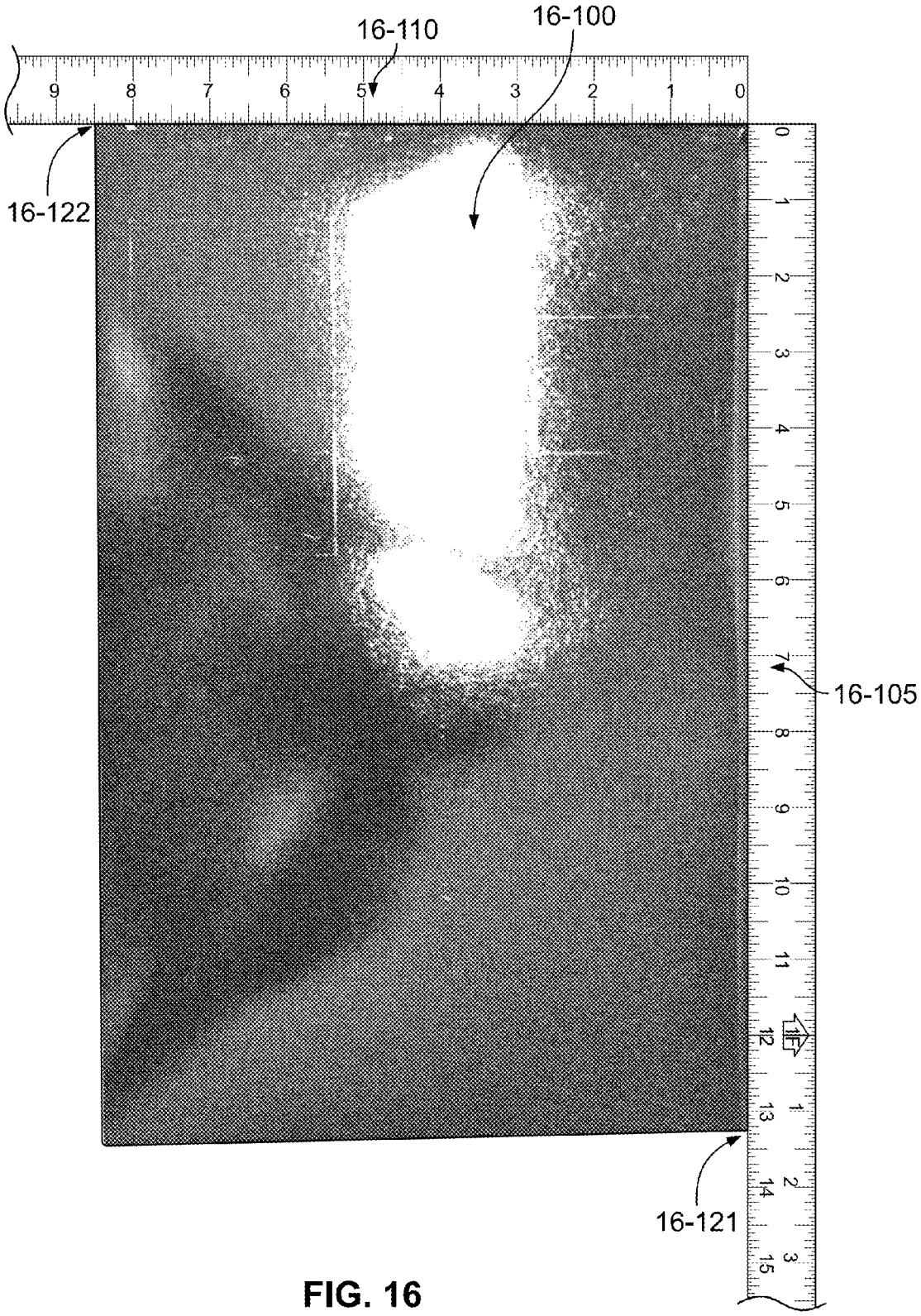
FIG. 16 shows an 8 by 13.25 inch rectangular foil stamped image, using an exemplary embodiment of the present invention.

FIG. 16 shows an 8 by 13.25 inch rectangular foil stamped image, using an exemplary embodiment of the present invention. The die used to create this foil stamped image is a plate of steel of the same dimensions. The image 16-100 is a solid rectangle. Tape measures 16-105, 16-110 are aligned to show the length and width. The width 16-121 is 13.25 inches and the length is 16-122 is 8.5 inches.

Figure 17:
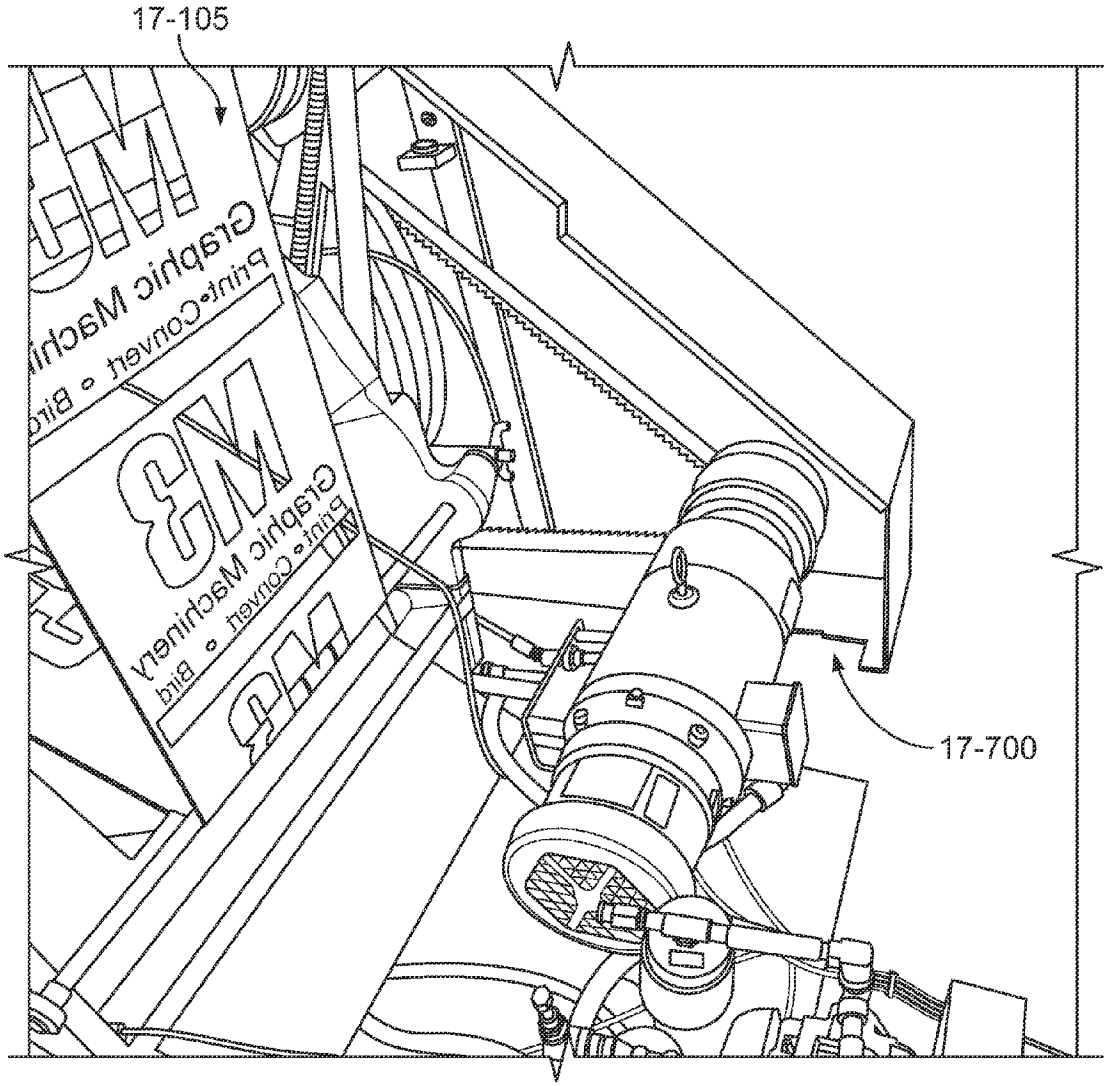
FIG. 17 shows the takeup of the foil supply after stamping, the foil rewind after stamping, in accordance with an exemplary embodiment.

FIG. 17 shows the take-up of the foil supply after stamping, the foil rewind after stamping, in accordance with an exemplary embodiment. The spent foil 17-105 winds up at the back of the press just in front of the drive motor 17-700. Embodiments of the present invention maintain the conventional accurate timing and foil translation across dwell and non-dwell modes for proper stamping and take-up of the spent foil supply.

Figure 18:
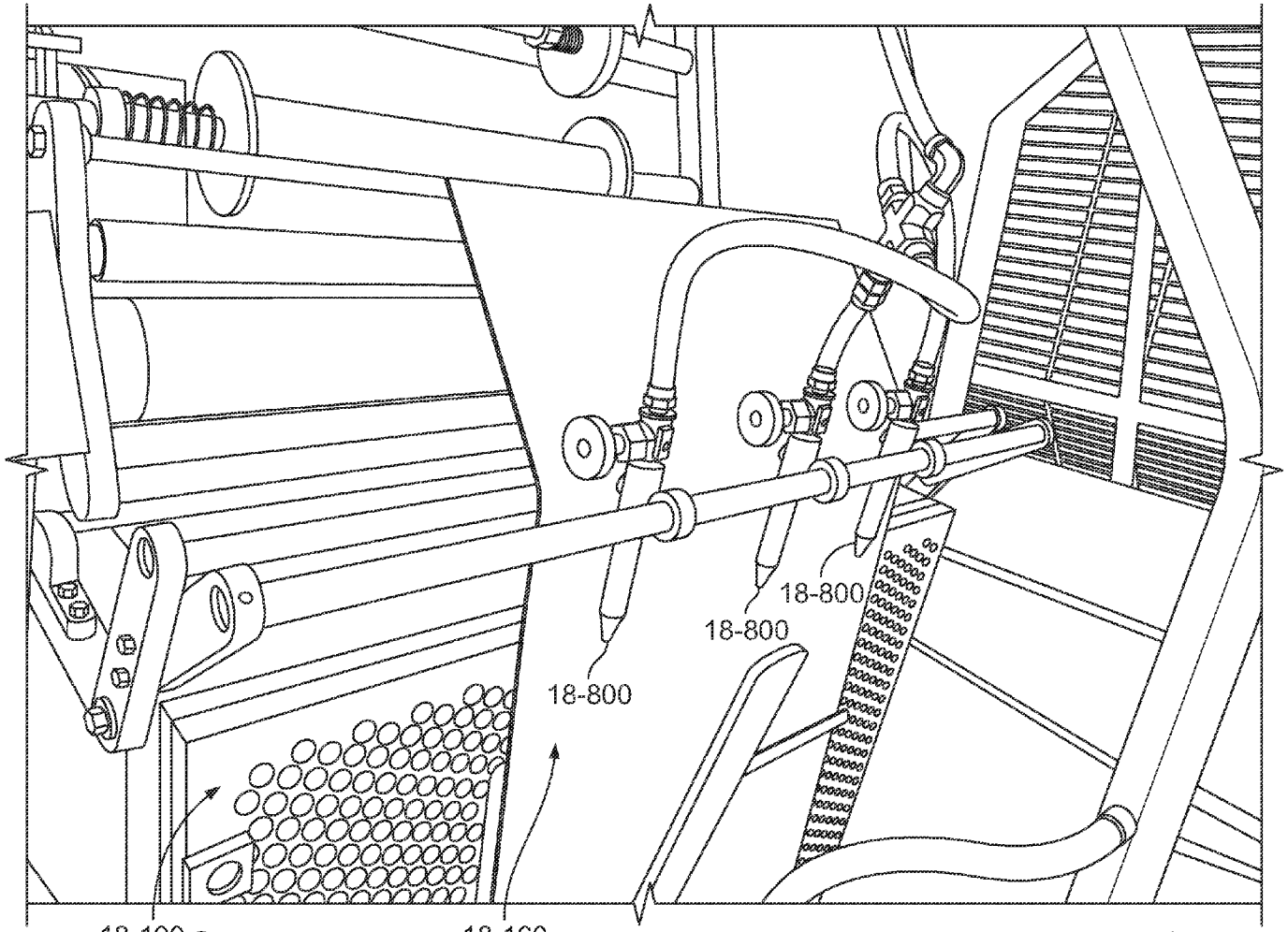
FIG. 18 shows the original equipment air nozzles which assist in separating the foil supply from the foil stamped sheet, in accordance with an exemplary embodiment.

FIG. 18 shows the original equipment air nozzles which assist in separating the foil supply from the foil stamped sheet, in accordance with an exemplary embodiment. Foil supply 18-160 winds down across the face 18-190-*a* of the honeycomb plate and the air nozzles 18-800 for separation of the spent foil supply from the stamped image sheet.

Figure 19:
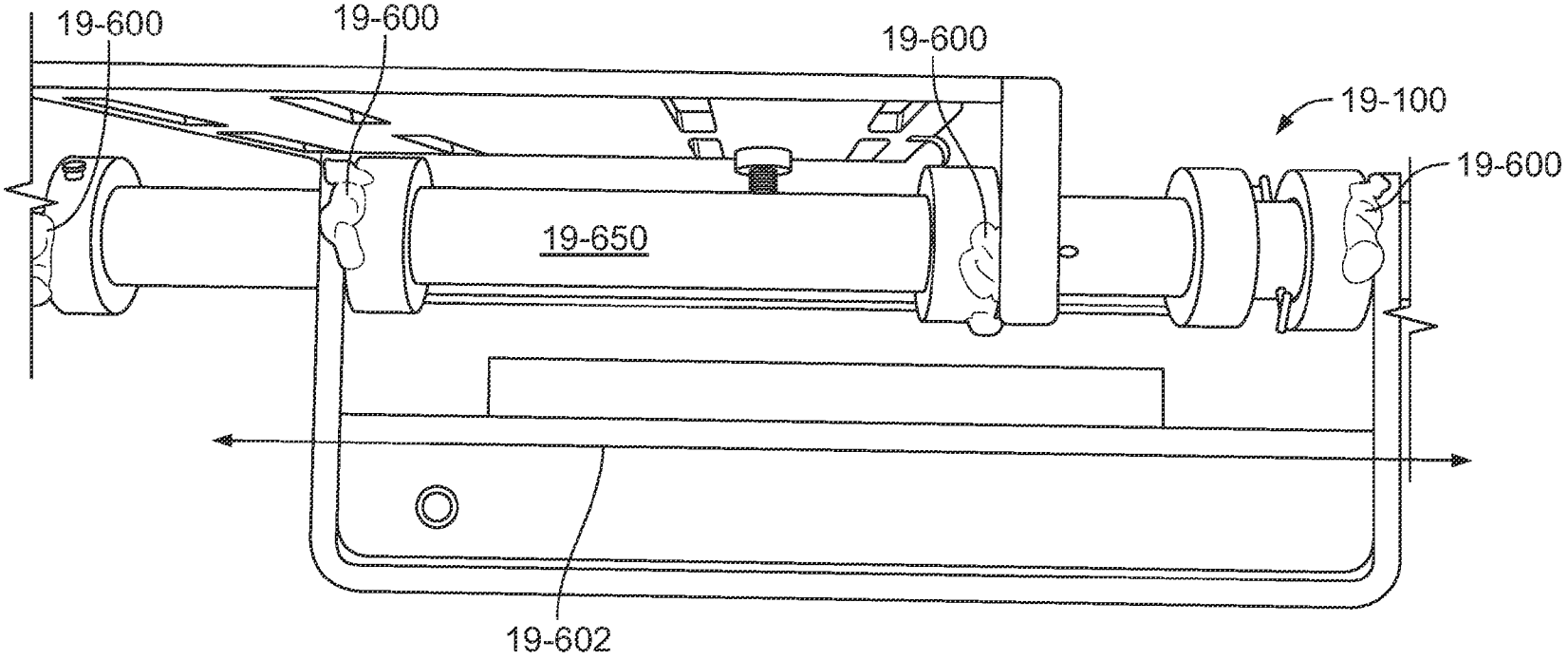
FIG. 19 shows a motor mount, in accordance with an exemplary embodiment.

FIG. 19 shows a motor mount 19-100, in accordance with an exemplary embodiment. Reliability of the motor mount shaft is maintained, in accordance with exemplary embodiments of the present invention, at least in part by welding 19-600 the mount shaft 19-650 to preclude any shaft displacement lengthwise, in contrast to the conventional motor mount shaft which is secured with collars and 1/8 inch pins. The motor stays locked down and the mount is better able to withstand vibration over the long term. Serviceability of the press may be extended. The mount, in accordance with embodiments of the present invention will be tight when the 5 HP starts, stops, and comes under load during a dwell cycle.

Figure 20A:
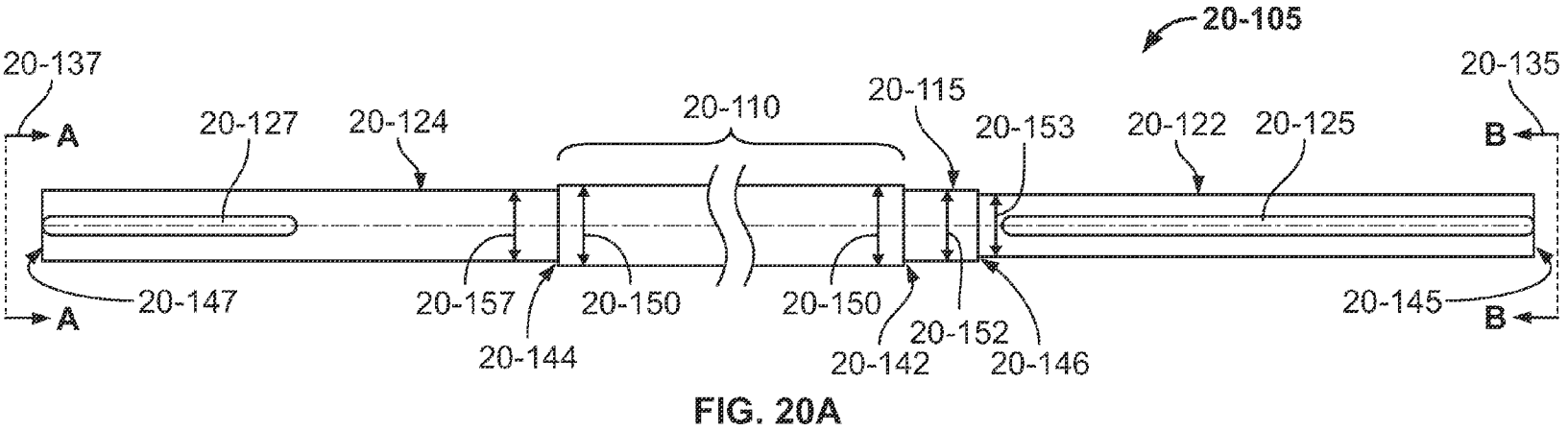
FIG. 20A shows a length-wise top view of a drive shaft, in accordance with an exemplary embodiment.
Figure 20C:
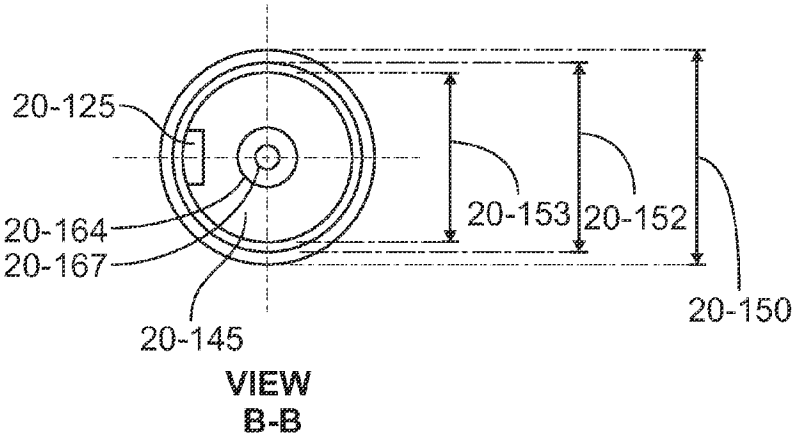
FIGS. 20B and 20C show a first and second end view of the shaft of FIG. 20A.
Figure 20B:
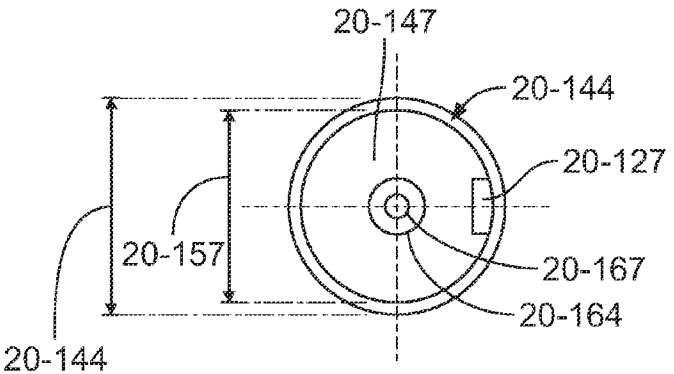

FIG. 20A shows a length-wise top view of a drive shaft, in accordance with an exemplary embodiment; FIGS. 20B and 20C show a first and second end view of the shaft of FIG. 20A. In accordance with an exemplary embodiment, bearings still mount at two diameter step downs from shaft center, and the bearings can remain conventional original equipment. Turning to FIG. 20A, in accordance with another embodiment, an inner most diameter 20-157 from the left end 20-147 step 10-149 increases from 2 inches to three inches. From the opposite end 20-145 the inner most diameter 20-153 steps 20-146 to a second diameter 20-152. And then a second step 20-142 increases the diameter of the shaft to its center diameter 20-150. The increase in center diameter 20-150 may withstand and resist a larger torsion than the conventional smaller inner diameter of the drive shaft. Also on each shaft end is a cut slot 20-127 and 20-125, respectively. In accordance with an exemplary embodiment the width and depth of the slots are the same, while the length of 20-125 is greater than the length of 20-127. FIG. 20B shows an end view 20-137 A-A of end 20-147, the slot 20-127 is shown and the diameter step from a first diameter 20-157 to a larger diameter 20-150 is shown. FIG. 20C shows an end view 20-135 B-B of end 20-145, the slot 20-125 is shown and the diameter step from a first diameter 20-153 to a larger diameter 20-155, and the third largest diameter 20-150 is shown. End 20-145 is the clutch and drive flywheel side of the shaft 20-105, FIG. 20C. While opposite end 20-147 is the free flywheel side of the shaft 20-124, FIG. 20B. Center line of the shaft 20-164, 20-167 are present across the length of the shaft and at both ends, as shown in FIGS. 20B and 20C.

Figure 21:
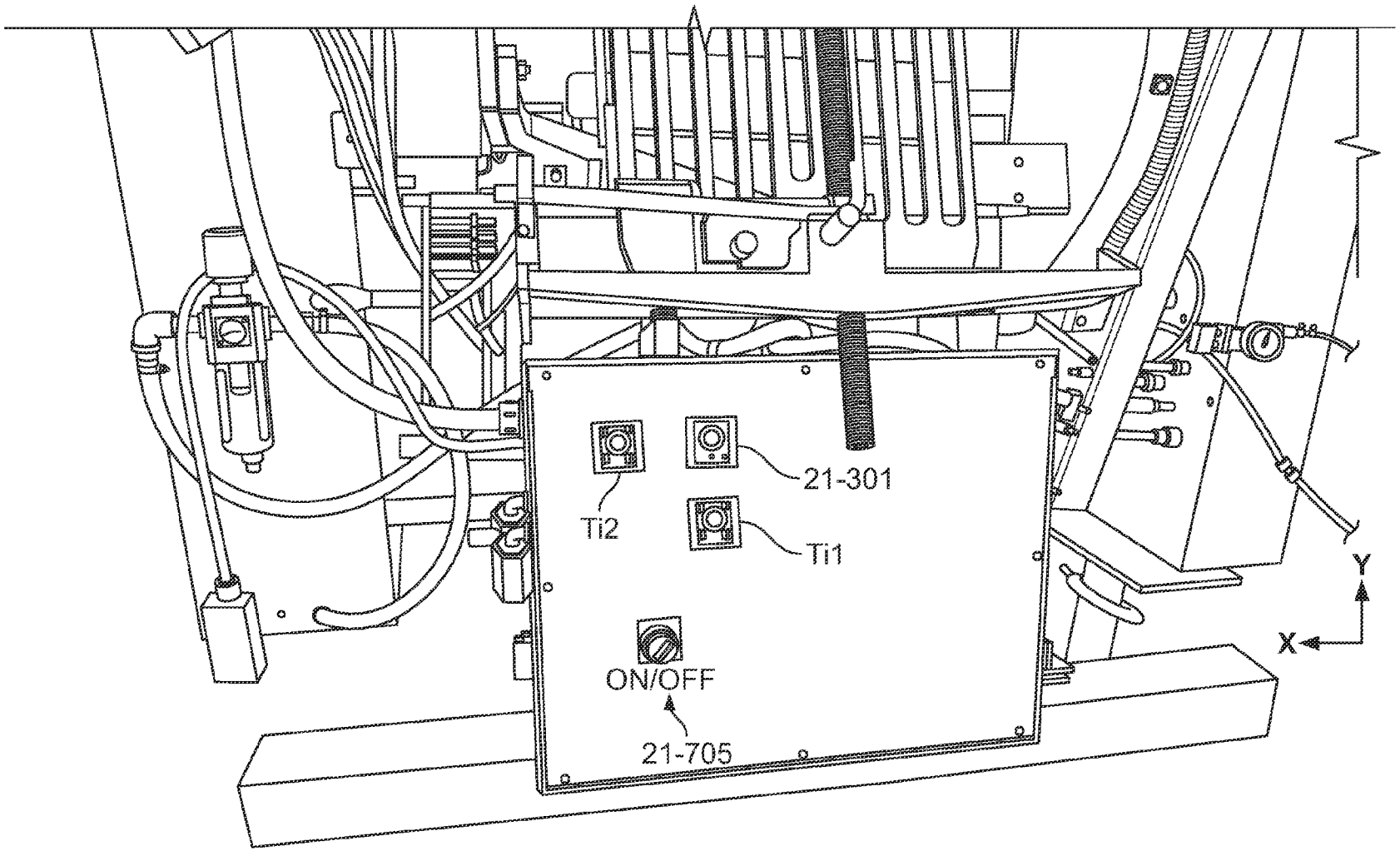
FIG. 21 shows a user interface in accordance with an exemplary embodiment of the present invention.

FIG. 21 shows a user interface in accordance with an exemplary embodiment of the present invention. The user interface includes the two adjustable timers and a switch 21-301 to change the press over from non-dwell to clutch dwell and vice versa. The actual position of the elements of the user interface may vary. Timer, Ti2, the dwell timer is shown upper left. And just right of the dwell timer is the switch to turn the press into dwell mode, in accordance with the present invention. The bottom most button, is a manual on/off or manual emergency stop of the press 21-705. Timer Ti1 is shown midlevel in the Y direction and is adjusted while the press is running by the user to attain closing of the honeycomb plate to the platen plate concurrently with stopping of the drive shaft at top dead center for the duration of dwell time, set by Ti2.

To create an acceptable foil stamp on a conventional press, one can add pressure by putting a make ready, increasing the thickness, raising the position height of the die relative to the platen on which it mounts bringing it closer to the honeycomb plate for a given honeycomb plate position. Conventionally, a sheet of paper adds just 1/1000 of an inch.

FIGS. 15A to 15D show an M3 Graphics foil stamping, which requires an increase squared stamp area of greater than 50% of the maximum rating on a conventional 14×22 EHD press. While the conventional system may be able to stamp a foil stamp of this size, such operation would be expected to damage the machine over time.

Another image of die size, which a conventional system could not create, is the 8.5 by 13.25 inches rectangle shown in FIG. 16, which equals 126.25 tons due to the square inch die image size In contrast, in accordance with an exemplary embodiment of the present invention, the large rectangular die size is well accommodated by the increased dwell time.

Figure 22A:
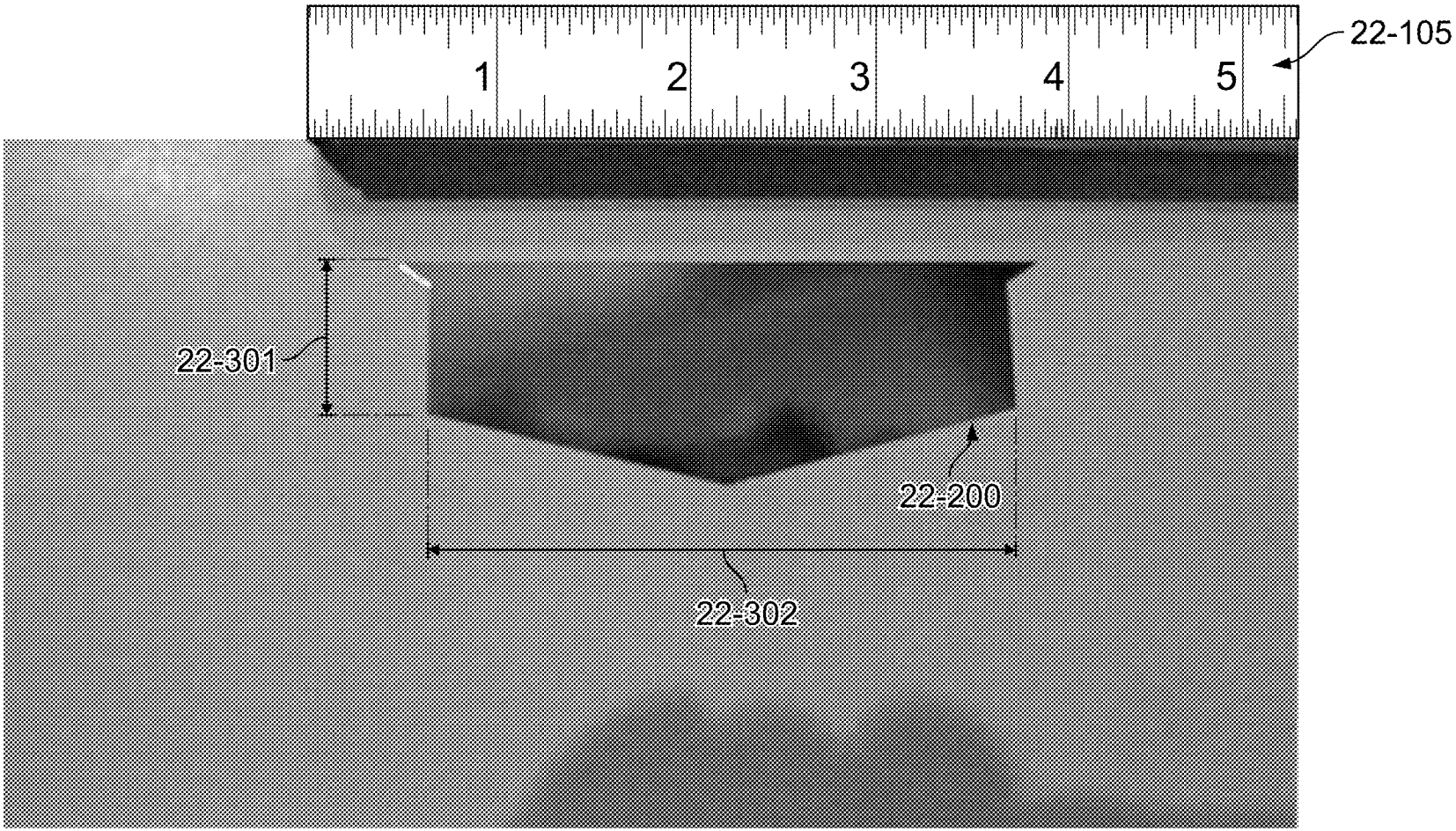
FIGS. 22A-22C show a series of stamps from a given die at constant die height, a constant temperature, and a constant operating IPH speed, where
Figure 22B:
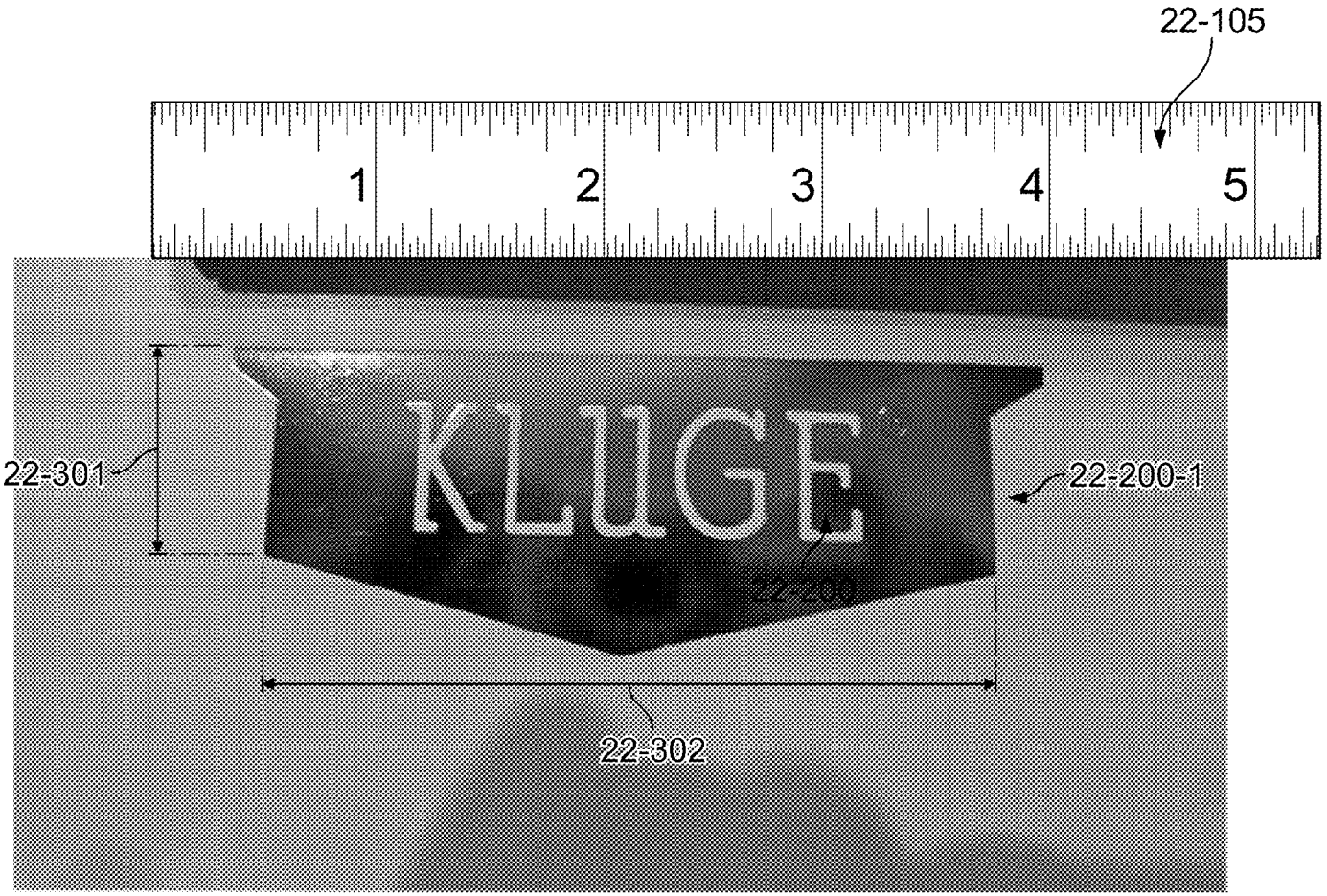
Figure 22C:
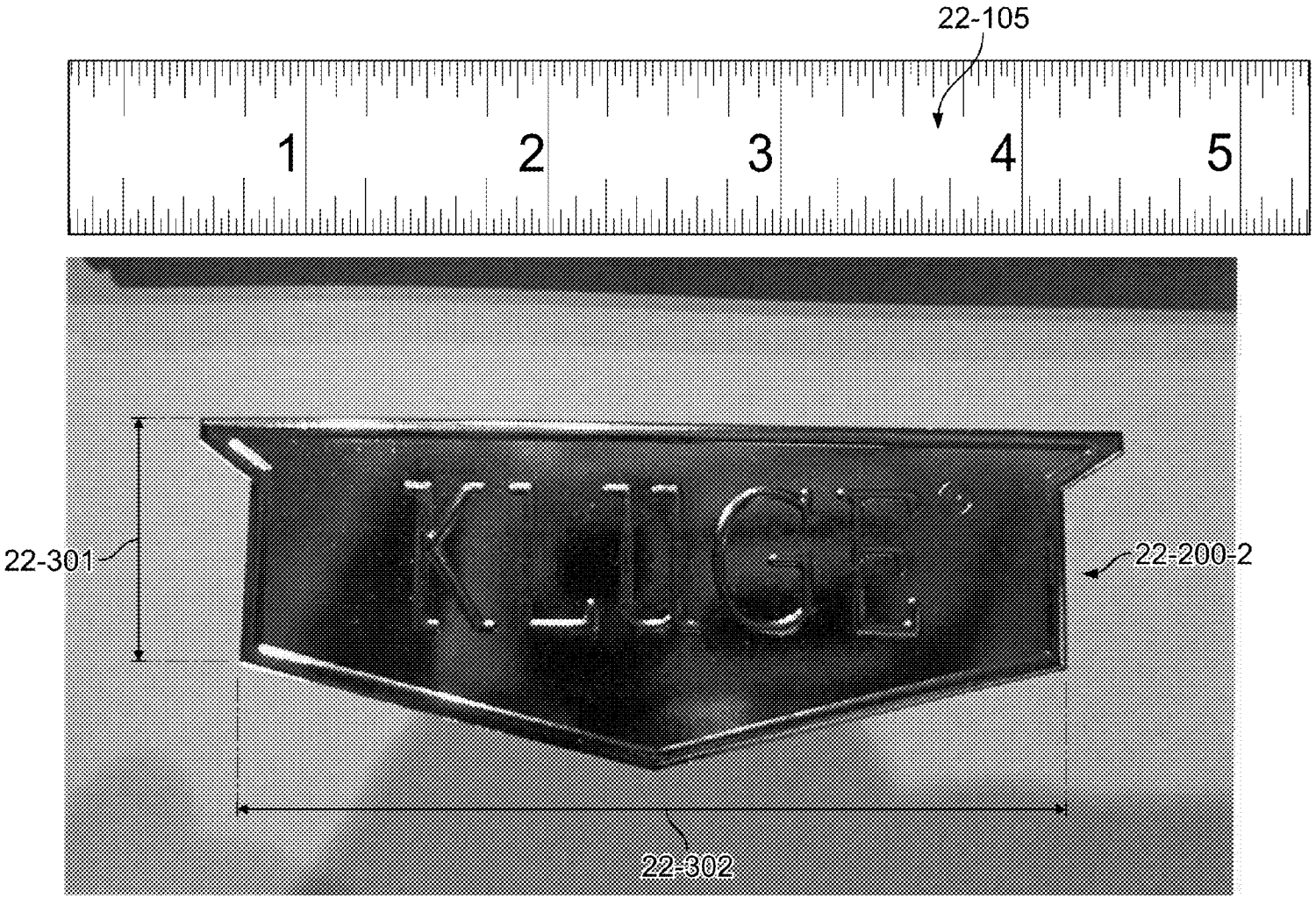

FIGS. 22A to 22C show three KLUGE stamps, at a press operating speed of 1100 IPH. FIG. 22A shows a flat foil stamp. Second, FIG. 22B shows KLUGE broken out of the resulting stamp. And third, in FIG. 22C the foil stamp image is perfect, showing a raised edge framing the image and KLUGE is also raised. A conventional machine should be able to handle the KLUGE die image size, and does when the die is raised with shims. However, the series of foil stamping in FIGS. 22A to 22C are made at a constant low die height and at a constant temperature. The temperature is within the normal operating range of foil stamping. As discussed above, raising the die height, with the platen position staying constant and the trajectory and speed of the honeycomb plate being constant increases the pressure on the die. The honeycomb continues to push towards the original platen height. The foil stamping images of FIGS. 22A to 22C show that the present invention can effectively foil stamp at an impact force and pressure less than that required in conventional foil stamping presses and methods. FIG. 16 at its large die inches squared area suggests this decreased impact force and pressure associated with exemplary embodiments of the present invention. And FIGS. 22A to 22C show that an insufficient impact, FIG. 22A, can be overcome by increasing nothing but the dwell time, FIG. 22C.

Referring again to FIGS. 15A to 15D, the die was manufacture-rated at 80 tons, well past the recommended maximum impression pressure of the 14×22 EHD. This result also suggests an impact force and stamping pressure, in accordance with exemplary embodiments of the present invention, much less than that utilized in a conventional press. Further, releasing the brake but keeping the clutch disengaged so that the drive flywheel can free wheel, a user can turn the press by hand through to the end of a complete cycle from the release of the brake with the honeycomb at top dead center. This was determined experimentally following the foil stamping of the die in FIGS. 15A to 15D under the conditions used to create image FIG. 15D.

Figure 2A:
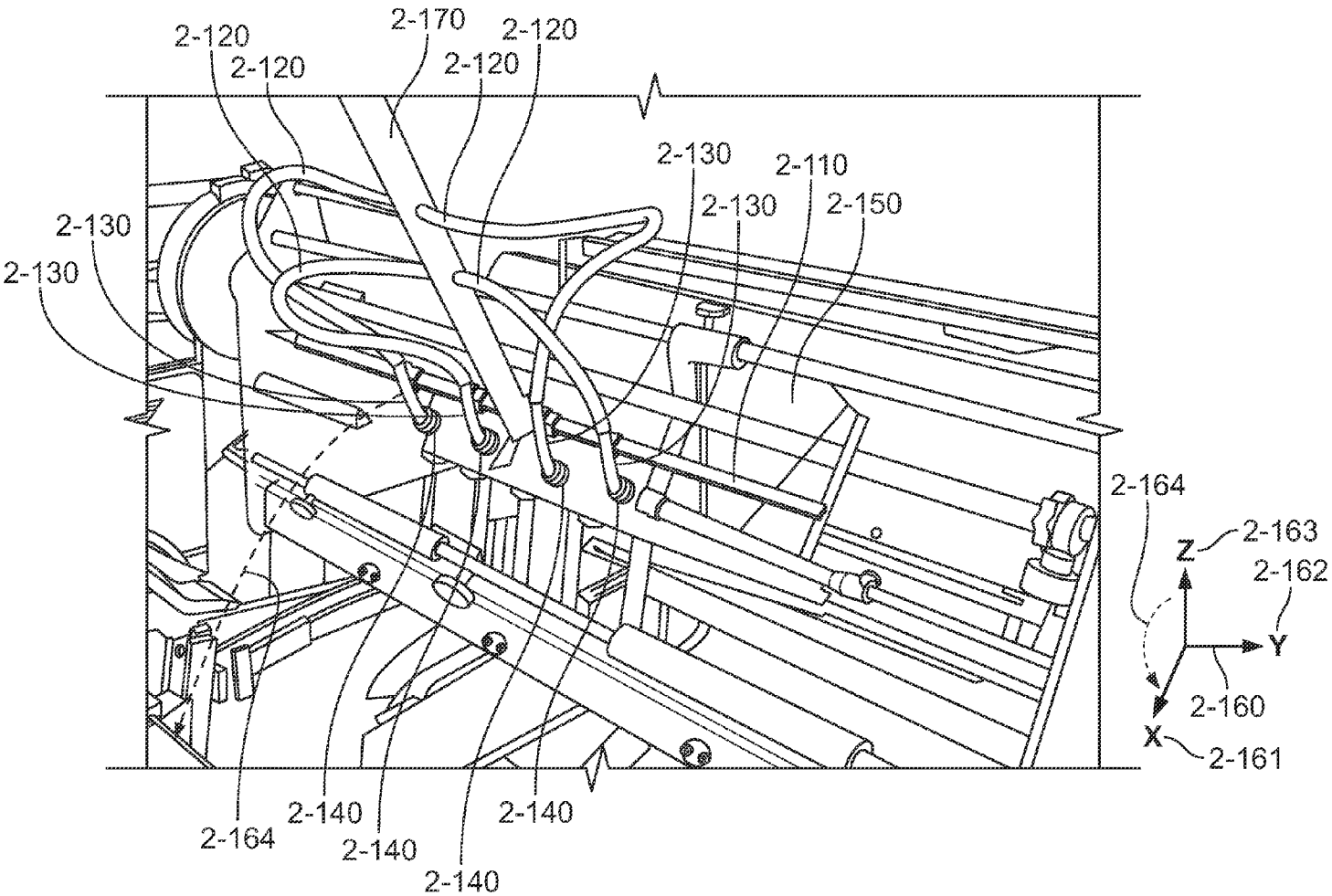
FIGS. 2A-2C show the feed assembly early in a cycle and the delivery assembly in an early and late part of a given cycle, respectively, from a top perspective view in a conventional 14×22 EHD press.
Figure 2B:
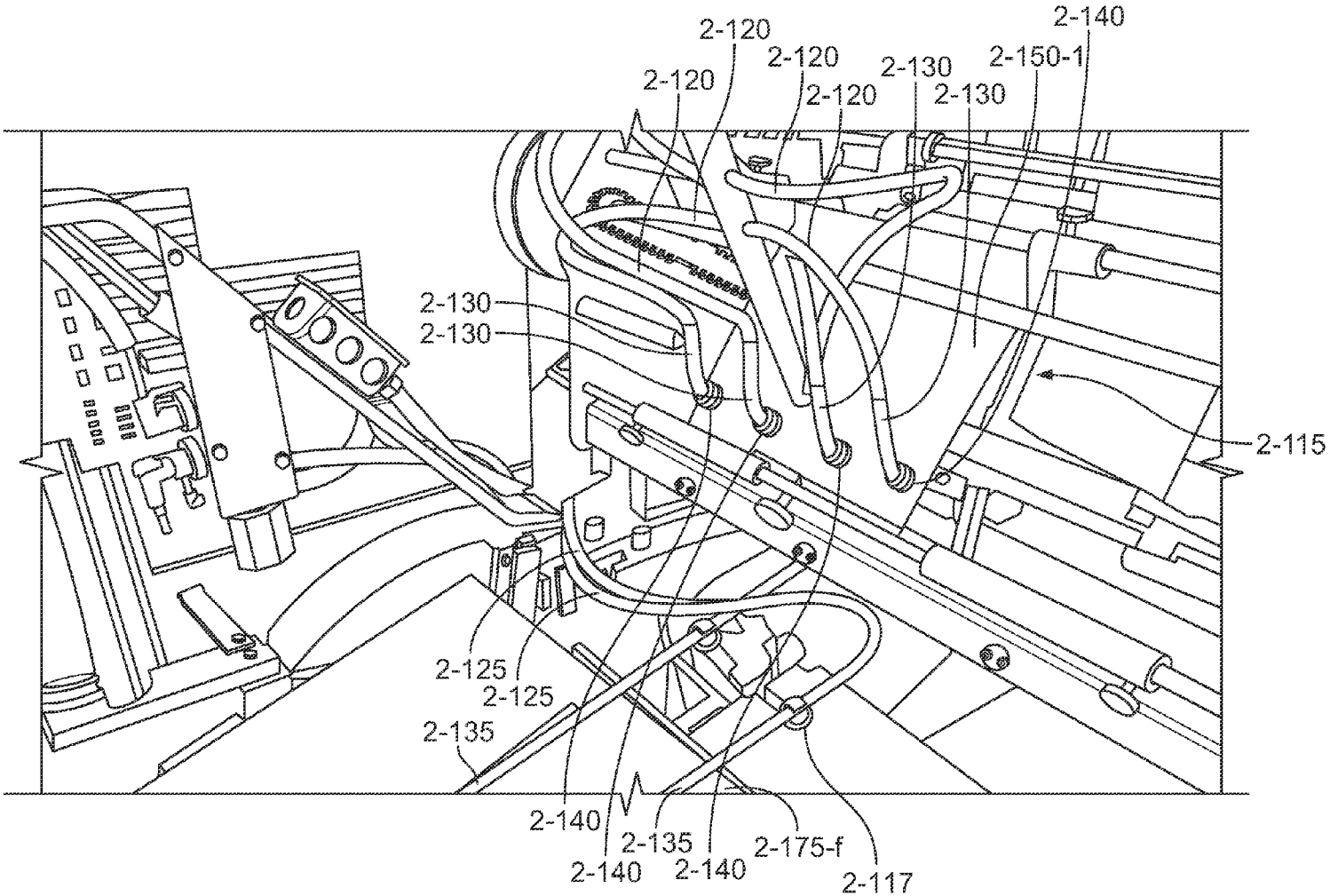
Figure 2C:
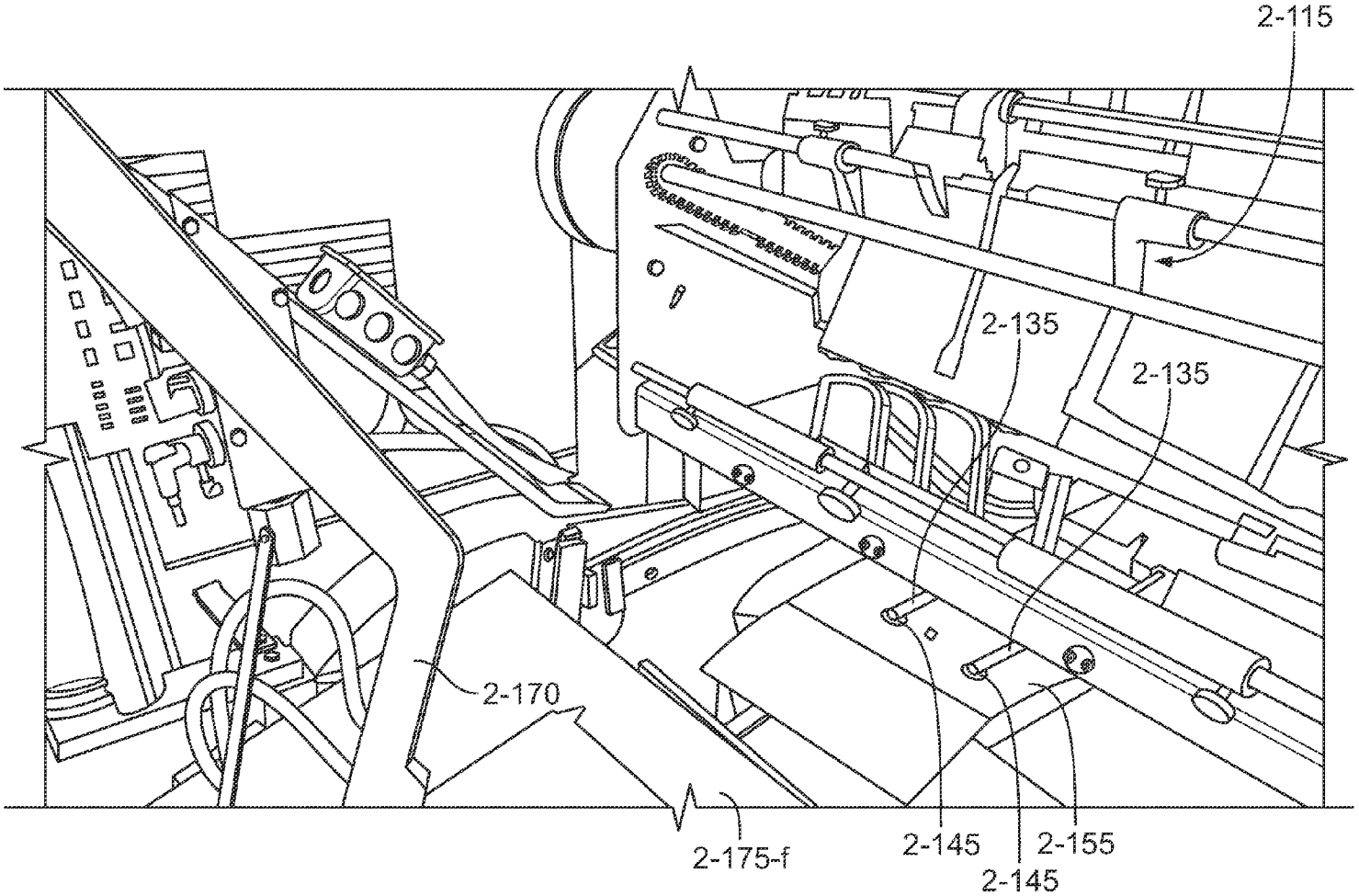
Figure 3A:
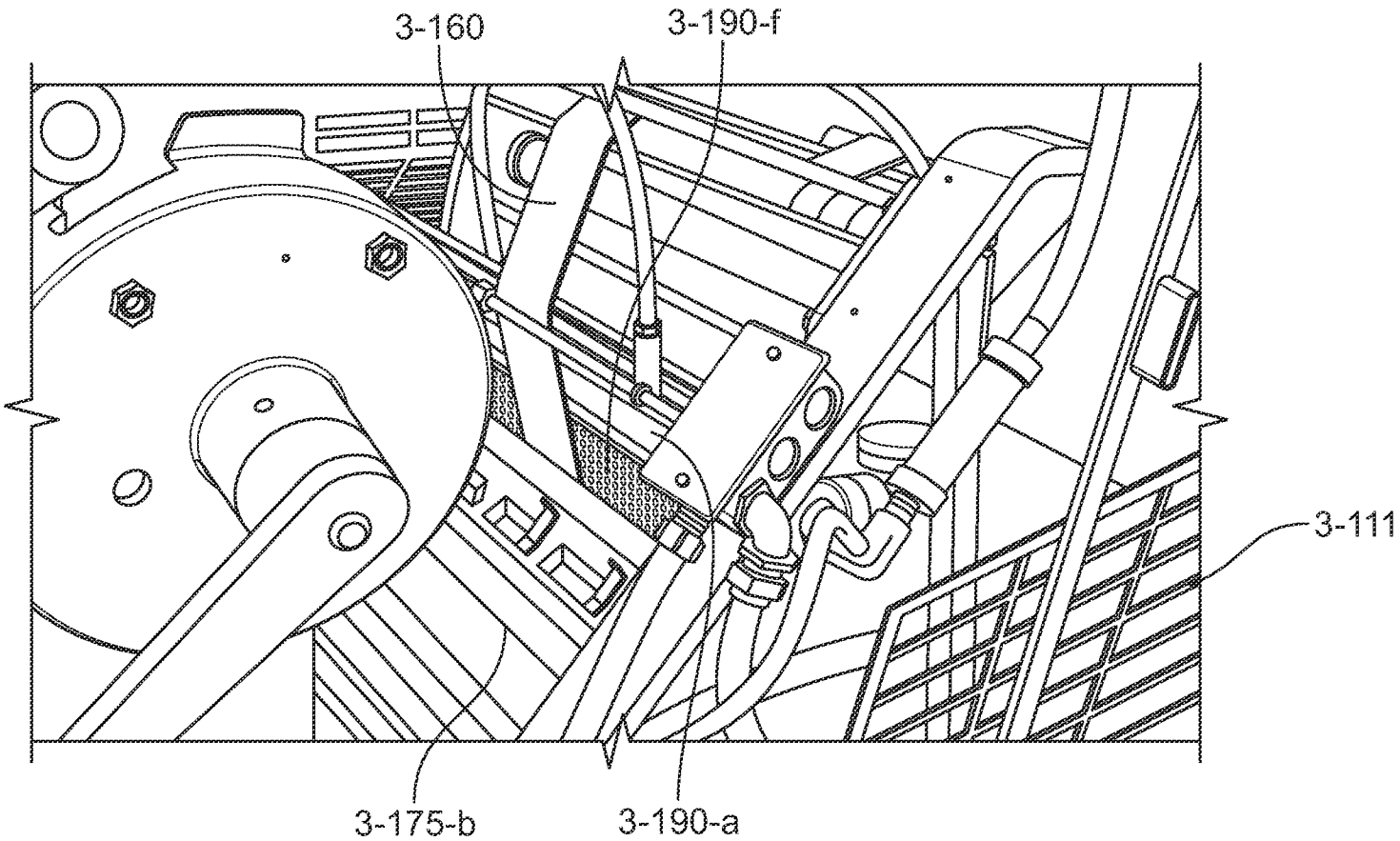
FIGS. 3A-3C show a front perspective view of a conventional press under a foil stamping application, where 3A shows the honeycomb plate just about to close on the platen, 3B shows the honeycomb plate closed on the platen, and 3C shows the honeycomb lifted back off the platen.
Figure 3B:
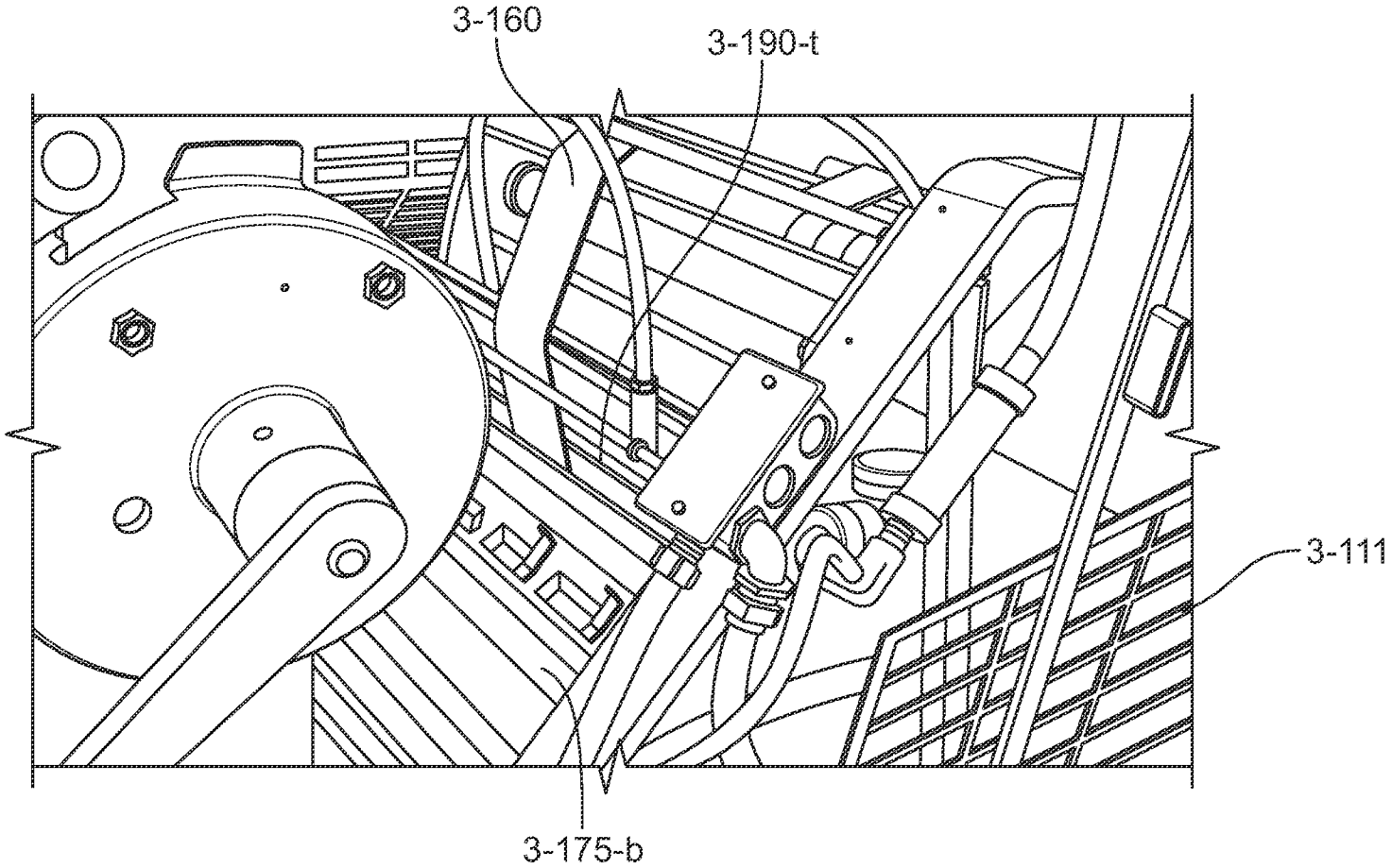
Figure 3C:
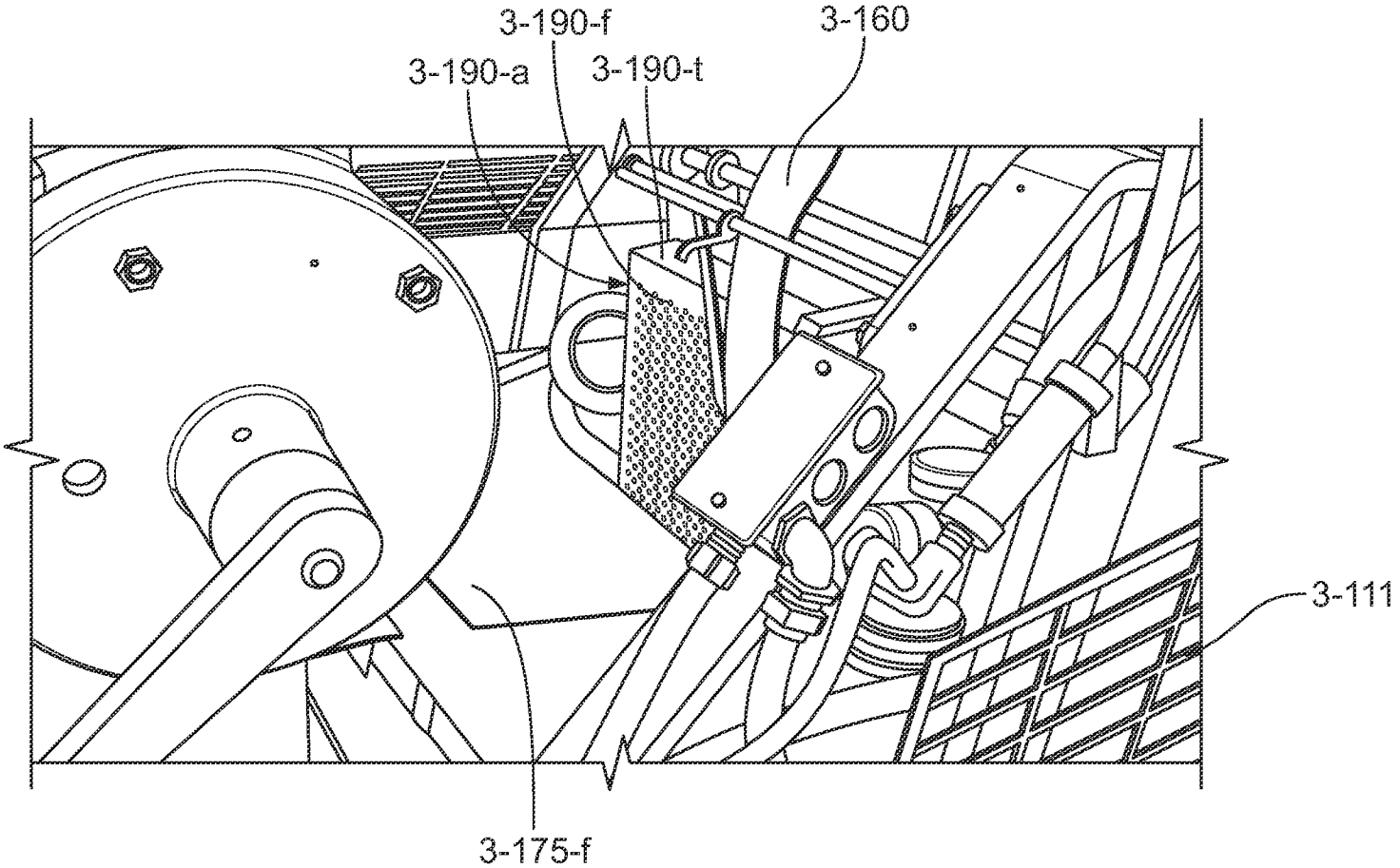

Referring again to FIGS. 22A-22C, the foil stamp image of FIG. 22A is made with a 14×22 EHD at the @1100 IPH without the addition of the spring added dwell, as taught in, for example, (U.S. Pat. No. 6,935,228) to Brandtjen. Then the foil image of FIG. 22B is made at the same temperature and IPH as FIG. 2A but with the addition of the spring dwell of (U.S. Pat. No. 6,935,228) to Brandtjen. Finally, in FIG. 22C the foil stamp image is made with an increased dwell time of 1.5 seconds via an exemplary system and method of the present invention, where 1.5 seconds is the total dwell time as set by timer T2.

Conventionally, a motor brake, shown for example in FIG. 7, 7-710, is not needed for conventional systems that never have a drive flywheel uncoupled from the drive shaft.

Figure 23A:
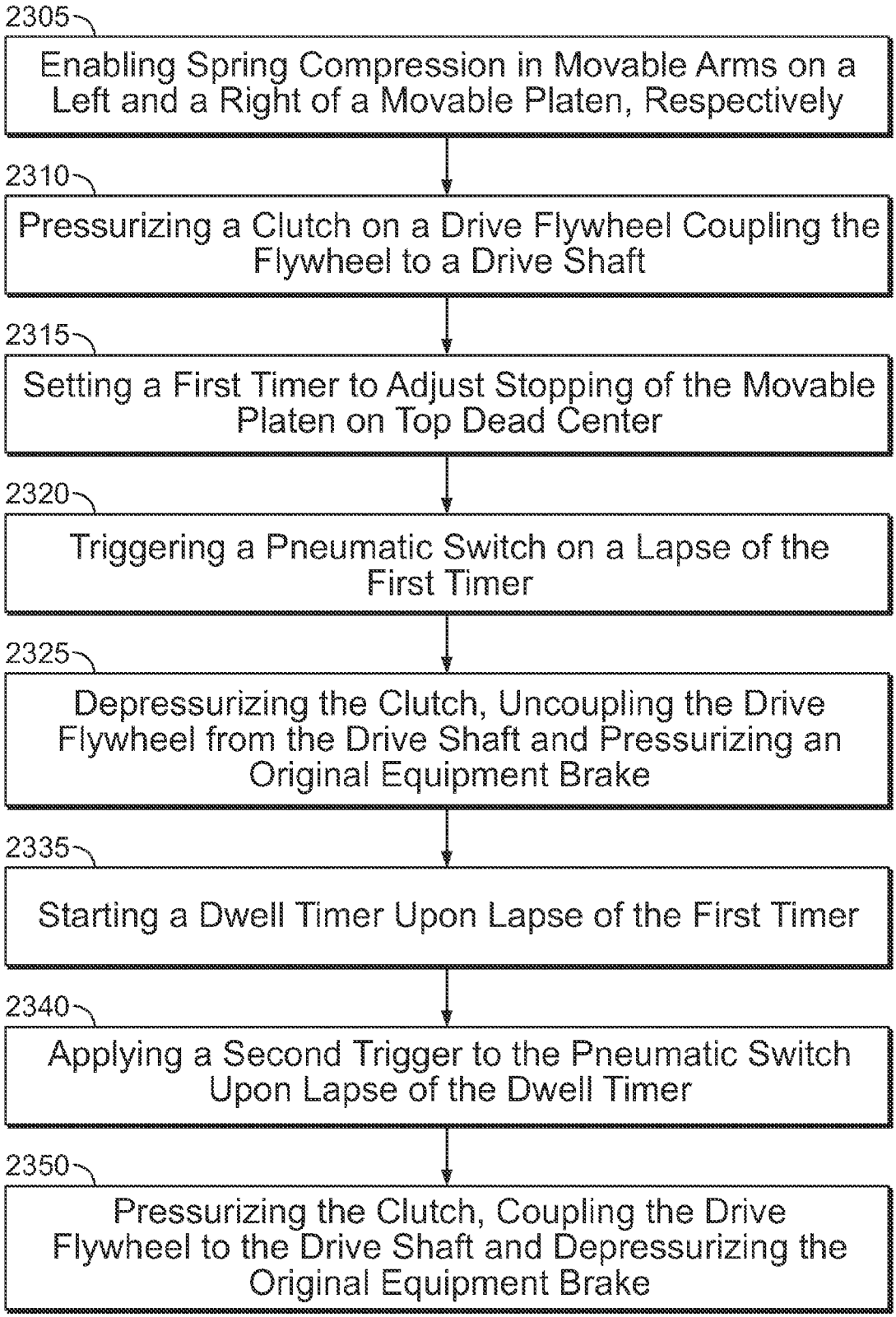
FIG. 23A shows a method of providing a variable dwell time in an automatic foil stamping press, in accordance with an exemplary embodiment of the present invention.
Figure 23B:
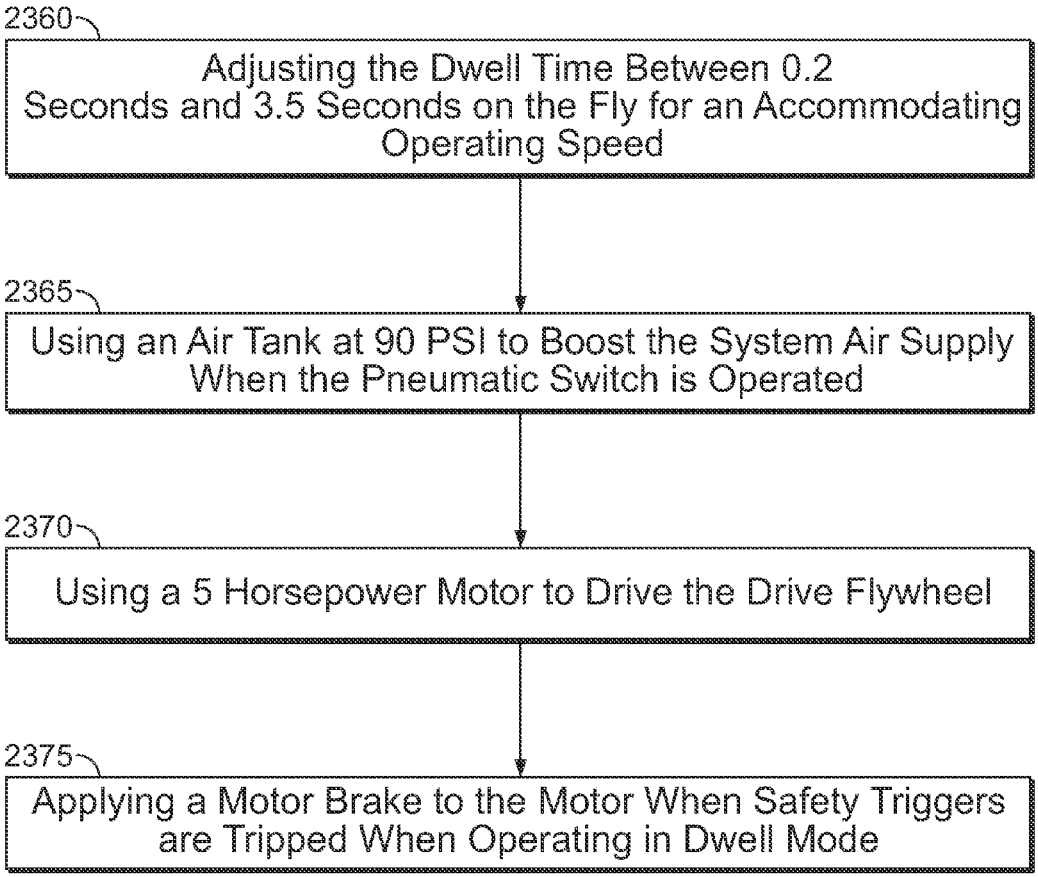
FIG. 23B shows method elements for an adjustable dwell time in the present invention, in accordance with another embodiment.

FIG. 23A shows a method of providing a variable dwell time in an automatic foil stamping press, in accordance with an exemplary embodiment of the present invention. Turning to FIG. 23A, an exemplary method includes: enabling spring compression in movable arms on a left and a right side of a movable platen, respectively 2305; pressurizing a clutch on a drive flywheel, coupling the flywheel to a drive shaft 2310; setting a first timer to adjust stopping of the movable platen on top dead center 2315; triggering a pneumatic switch on a lapse of the first timer 2320; and depressurizing the clutch uncoupling the drive flywheel from the drive shaft and pressurizing an original equipment brake 2325. The exemplary method further includes: starting a dwell timer upon lapse of the first timer 2335; applying a second trigger to the pneumatic switch upon lapse of the dwell timer 2340; and pressurizing the clutch, coupling the drive flywheel to the drive shaft and depressurizing the original equipment brake 2350. FIG. 23B shows method elements of the present invention, in accordance with an alternate embodiment, said alternate embodiment includes: adjusting the dwell time between 0.2 seconds and 3.5 seconds on the fly for an accommodating operating speed 2360; using an air tank at 90 PSA to boost the system air supply when the pneumatic switch is operated 2365; using a 5 horsepower motor to drive the drive flywheel 2370; and applying a motor brake to the motor when safety triggers are tripped when operating in dwell mode 2375. Methods of 23A and 23B may be performed in a given embodiment of the present invention.

Enabling spring compression in movable arms on a left and a right side of a movable platen, respectively 2305 was address above with reference to FIG. 4. Referring again to FIG. 4, configuring the arm 4-400 into a spring compressible 4-421 state by raising 4-422 cylindrical spacer 4-421 while disengaging the clutch changes the function of the springs 4-410. Disengaging the clutch removes the drive from the drive shaft, this is done just as the honeycomb hits the platen. In accordance with an exemplary method embodiment of the present invention, disengaging the clutch, removing drive from the shaft, and using conventional mounted springs in arms, shown for example in FIG. 4, absorbs impact energy of the now non-driven honeycomb onto the die in dwell mode. In contrast, in non-dwell mode and as on a conventional press, if the springs are used, in a compressible configuration, they are employed to absorb compression forces as the honeycomb continues to be driven into the die.

Figure 24:
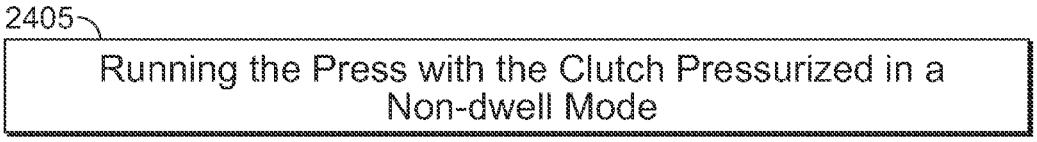
FIG. 24 shows yet another exemplary method of running yet another exemplary embodiment of the present invention in non-dwell mode.

FIG. 24 shows yet another exemplary method of running another exemplary embodiment of the present invention in non-dwell mode. In accordance with another alternate embodiment, the clutch is in a normally unpressurized state when the drive flywheel is coupled to the shaft 2405.

Figure 25A:
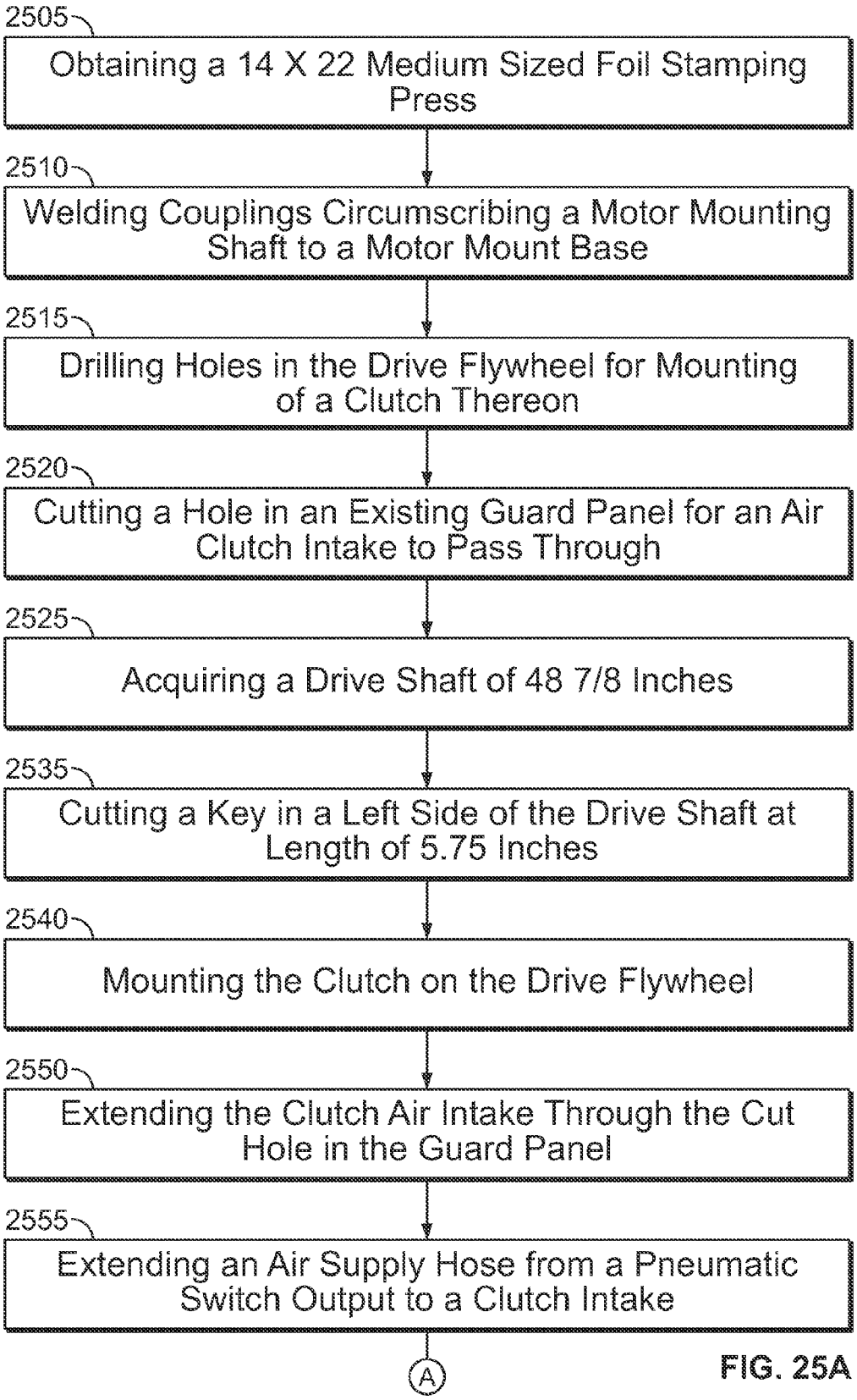
FIG. 25A shows an exemplary method of manufacturing an exemplary embodiment of the present invention.

FIG. 25A shows an exemplary method of manufacturing an exemplary embodiment of the present invention, the method includes: obtaining a 14×22 medium sized foil stamping press 2505; welding couplings circumscribing a motor mounting shaft to a motor mount base 2510; drilling holes in the drive flywheel for mounting of a clutch thereon 2525; cutting a hole in an existing guard panel for an air clutch intake to pass through 2520; and acquiring a drive shaft of 48 and ⅞ inches 2525. In alternate embodiment, an original equipment shaft is acquired. In still an alternate embodiment a customized shaft with slots and diameter steps is acquired. Referring again to FIG. 25A, the method includes: cutting a key in a left side of the drive shaft at a length of 5.75 inches 2535; mounting the clutch on the drive flywheel 2540; extending the clutch air intake through the cut hole in the guard panel 2550; and extending an air supply hose from a pneumatic switch output to a clutch intake 2555.

Figure 25B:
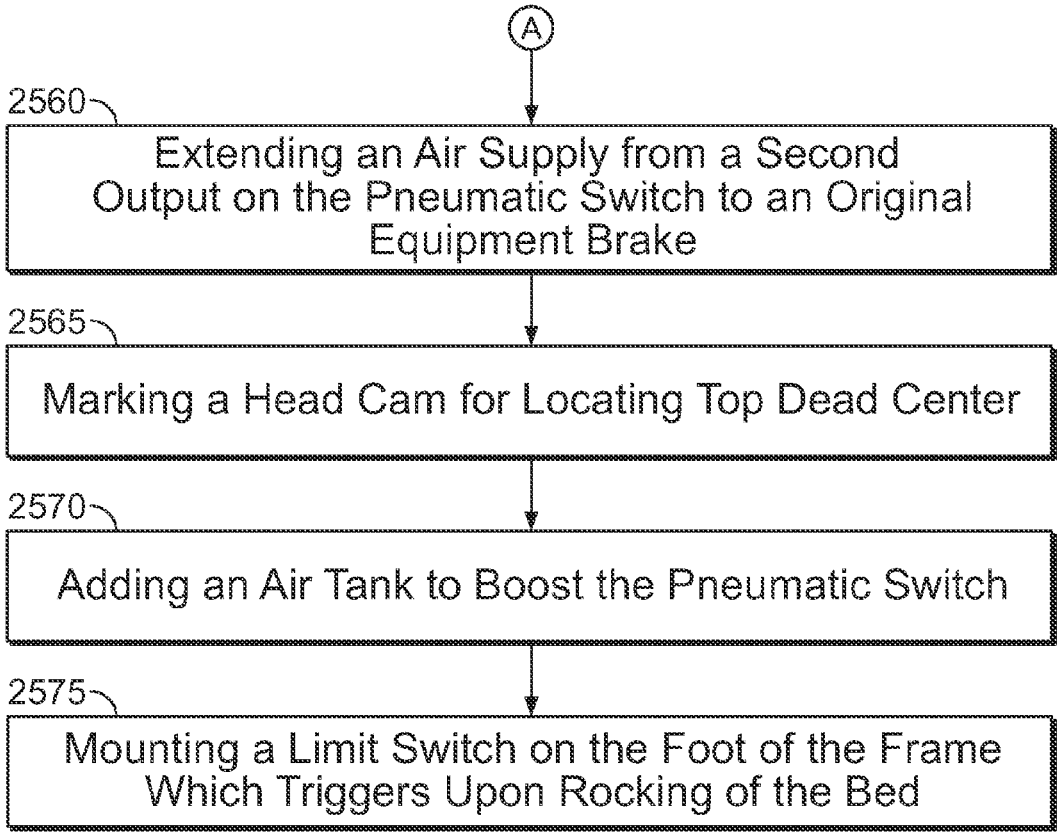
FIG. 25B shows an alternate exemplary manufacturing method embodiment that may include the method elements of FIG. 25A.

FIG. 25B shows an alternate exemplary embodiment that may include the method elements of FIG. 25A. The method includes: extending an air supply from a second output on the pneumatic switch to an original equipment brake 2560; marking a head cam for locating top dead center 2565; adding an air tank to boost the pneumatic switch 2570; and mounting a limit switch on the foot of the press frame which triggers upon rocking of the bed 2575.

In accordance with the present invention, methods may not comprise every element shown in the FIGS. 23A to 25B. In alternate embodiments a longer drive shaft may be obtained for use in the present invention. Slots and keys to mount the clutch on the shaft could be used in an alternative embodiment. For example, perhaps a pair of keys in the shaft may be desired. In still alternate embodiments the original equipment break may be replaced with non-original equipment brake. In alternate embodiments, marking a head cam may include marks on the side or the front of the cam. Markings may be made to be visible from the side or the front of the press or both. Alternatively, an alternate marking for location of top dead center may be desired. An alternate air supply from the main press air supply may be desired in alternate embodiments, and/or omitting an air tank boost. In accordance with alternate embodiments, the limit switch may be mounted on another stable press-frame or frame-type location and set to trigger upon a low impact inflection.

Figure 26:
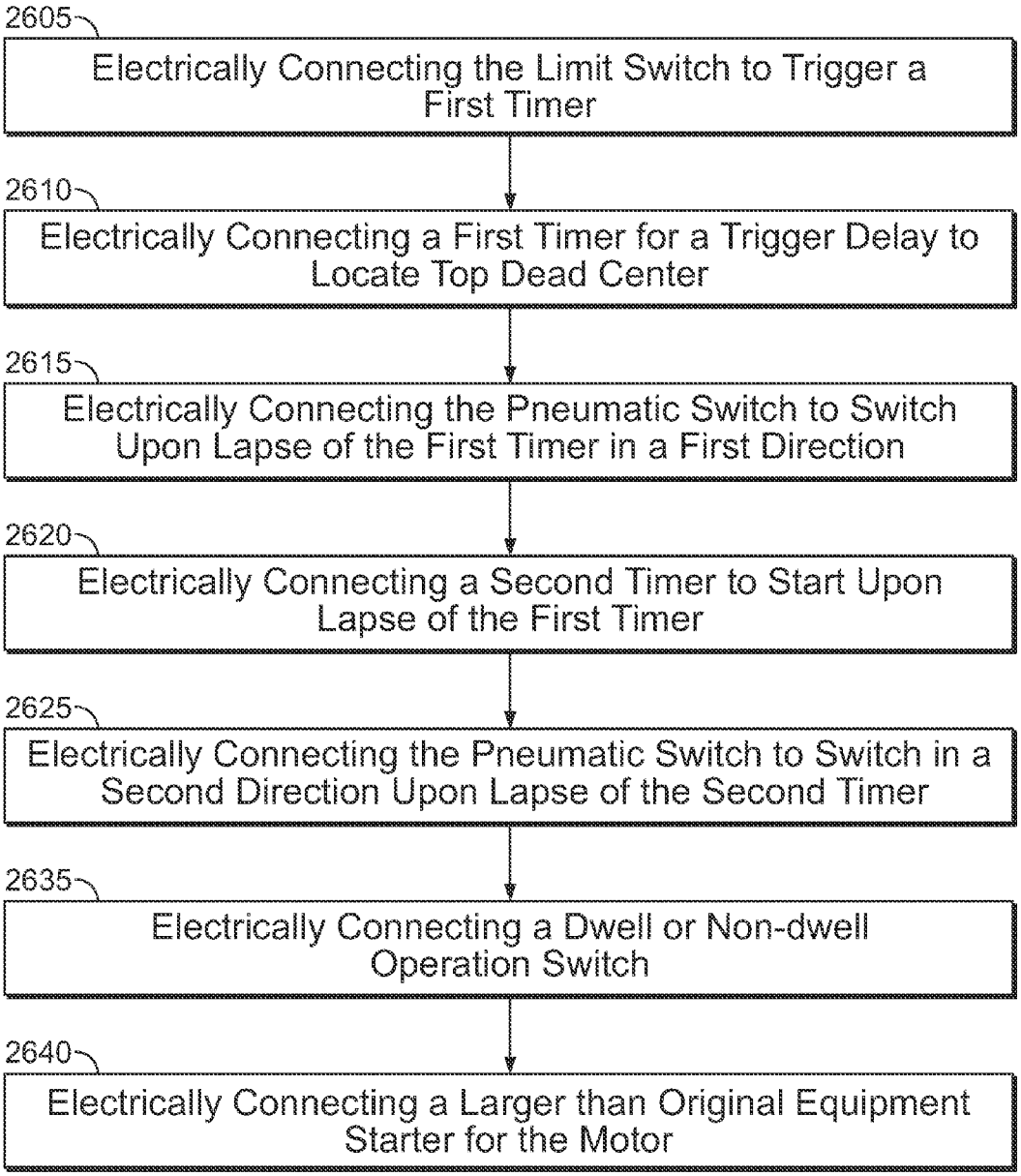
FIG. 26 shows an exemplary electrical methods for manufacturing an exemplary embodiment of the present invention.

FIG. 26 shows an exemplary electrical methods for manufacturing an exemplary embodiment of the present invention. The method includes: electrically connecting the limit switch to trigger a first timer 2605; electrically connecting a first timer for a trigger delay to locate top dead center 2610; electrically connecting the pneumatic switch to switch upon lapse of the first timer in a first direction 2615; electrically connecting a second timer to start upon lapse of the first timer 2620 electrically connecting the pneumatic switch to switch in a second direction upon lapse of the second timer 2625; electrically connecting a dwell or non-dwell operation switch 2635; and electrically connecting a larger than original equipment starter for the motor 2640.

Figure 27A:
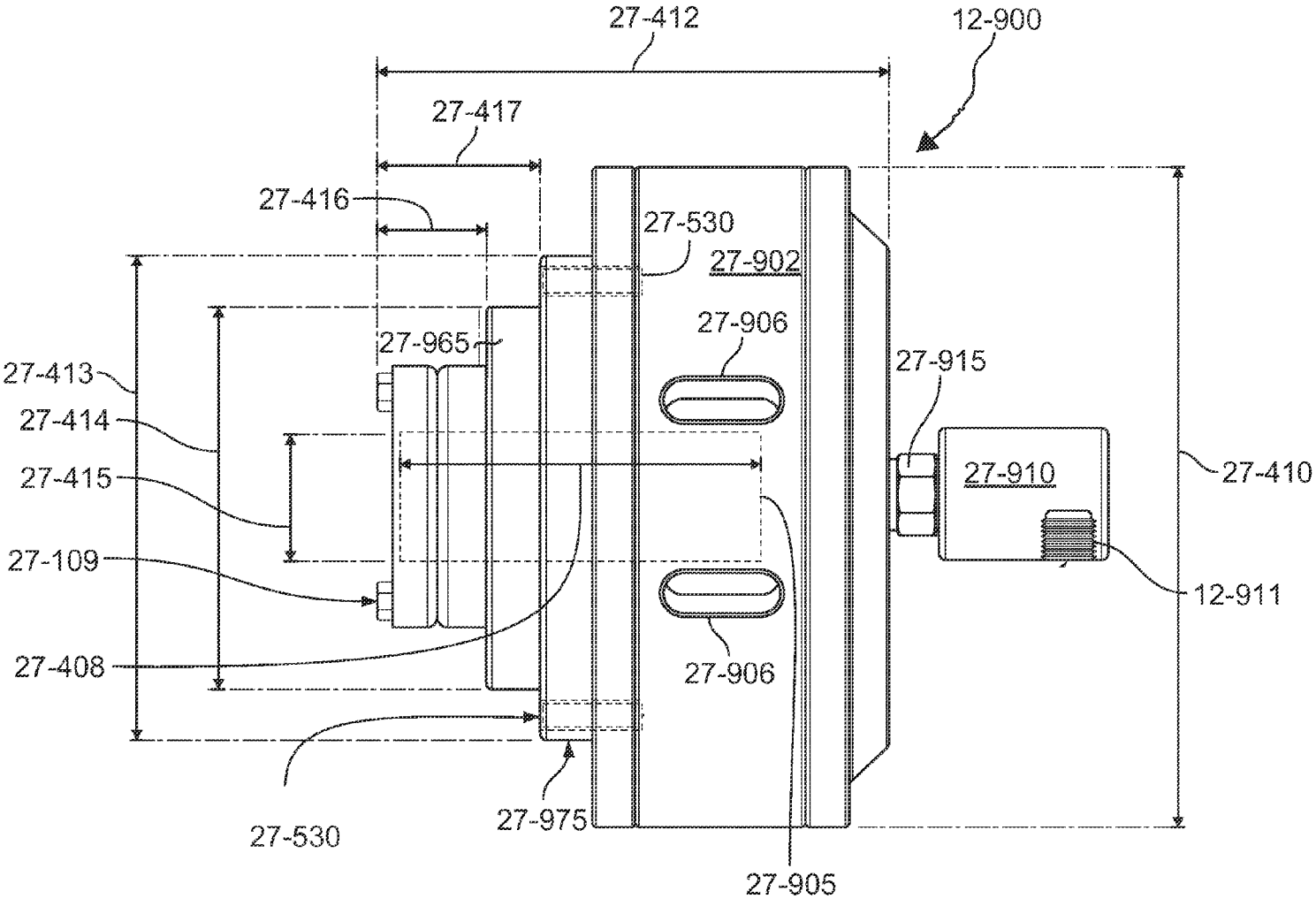
FIG. 27A shows a top perspective view of the clutch secured to the drive shaft with a shrink disc, in accordance with an exemplary embodiment of the present invention.

FIG. 27A shows a top perspective view of the clutch secured to the drive shaft with an off the shelf shrink disc, in accordance with an exemplary embodiment of the present invention. Fitting 27-915 connects the air intake port 27-910 to the clutch 27-900. Shadow line 27-905 shows the cavity for the shaft and the depth 27-408 of said cavity may be 4.8 inches, in accordance with an exemplary embodiment. The shrink disc 27-109 may have a height 27-416 in excess of 1.06 inches. Diameters 415, 414, and 413 may be 2.0, 4.75, and 5.97 inches respectively, in accordance with an exemplary embodiment. Clutch housing 27-902 has vents 27-906 for drawing air when the drive flywheel is coupled to the drive shaft and spinner. Heights of the shrink disc with bolt heads 416, disc with clutch plate 417, and clutch assembly 412, may be 1.2, 1.84, and 6.12 inches, respectively in accordance with an exemplary embodiment.

Figure 27B:
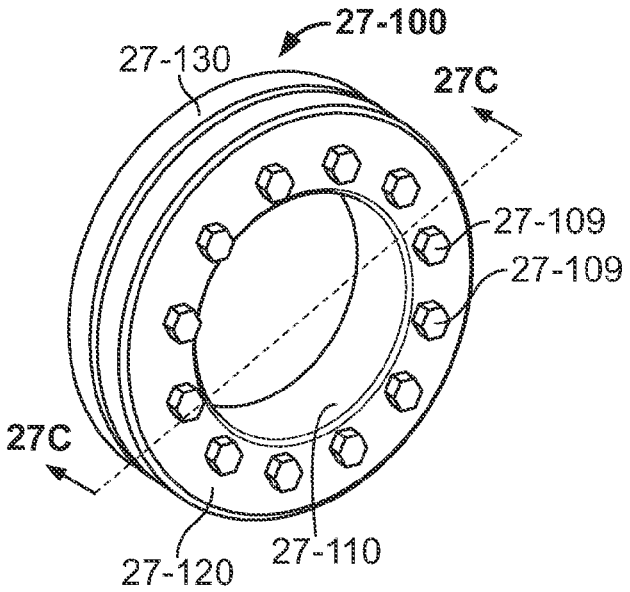
FIG. 27B shows a front perspective view of a shrink disc, in accordance with an exemplary embodiment of the present invention.
Figure 27C:
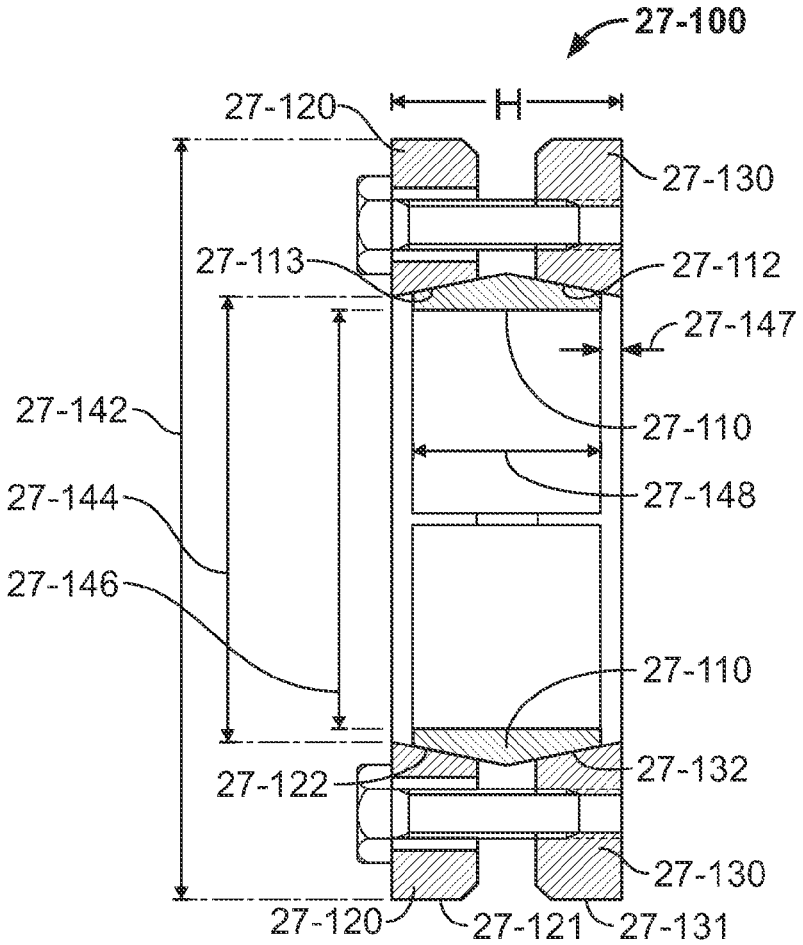
FIG. 27C shows a cross sectional view of the shrink disc in FIG. 2B across a shaft diameter.

FIG. 27B shows a front perspective view of a shrink disc, in accordance with an exemplary embodiment of the present invention. Bolts 27-109 span the circumference of the right 27-100 at even intervals. The cross sectional vies of FIG. 27C is taken along line 27C a front band 27-120 and back band 27-130 are shown and inner surface piece 27-110 is shown in more detail in FIG. 27C. Referring to FIG. 27C, the cross section of inner surface piece 27-110 is five sided with slopes 27-112 and 27-113 interfacing with bands 27-130 and 27-120, respectively at surfaces 27-132 and 27-122. A height H of the two bands 27-120 and 27-130 may be 1.06 inches as mounted on piece 27-110, while a height 27-148 of piece 27-110 may be 0.866 inches. Diameters 27-142, 27-144, and 27-146 may be 1.969, 2.087, and 3.54 inches, respectively, in accordance with an exemplary embodiment. More particularly, the use of a shrink disc to mount the clutch on the drive shaft. A range of off the shelf shrink discs may be employed. FIG. 27A shows an exemplary shrink disc, in accordance with an exemplary embodiment of the present invention (CLIMAX METAL PRODUCTS COMPANY, Mentor, Ohio, USA). An exemplary shrink disc may be series C733M at −50. Yet another exemplary embodiment is a shrink disc at −100 size.

Figure 28A:
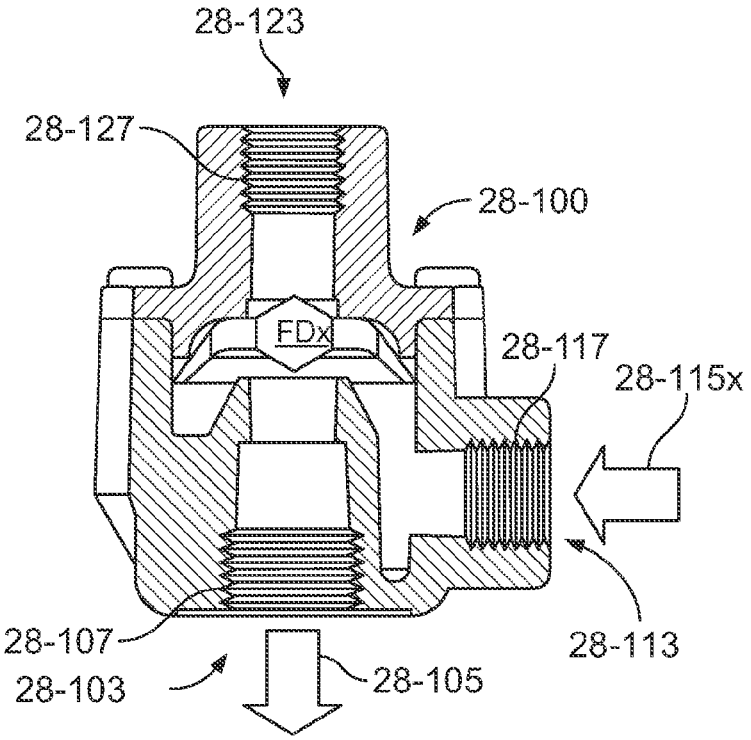
FIGS. 28A and 28B show an exemplary exhaust valve for relief of clutch pressure upon pneumatic switch activation to deactivate the clutch, in accordance with an exemplary embodiment.
Figure 28B:
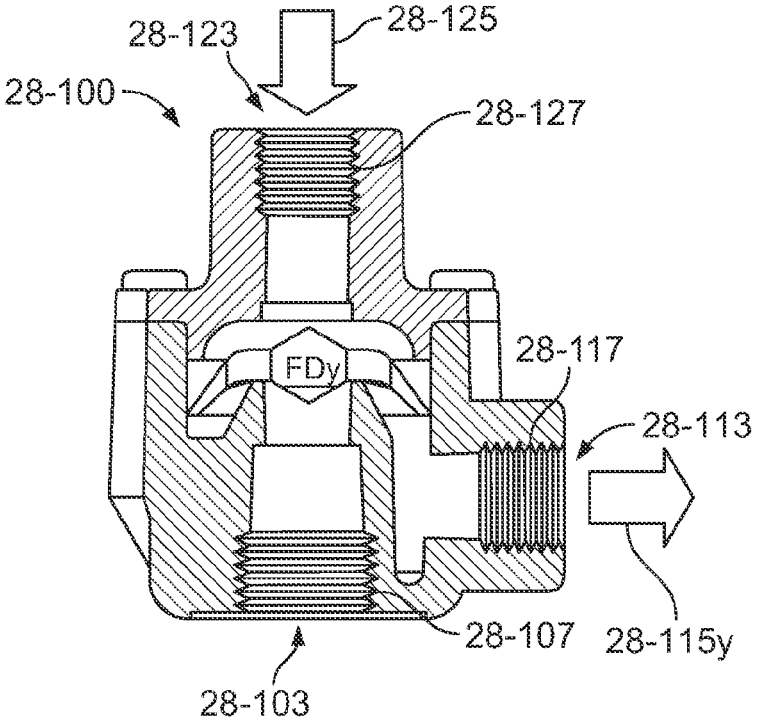

FIGS. 28A and 28B show an exemplary exhaust valve for relief of clutch pressure upon pneumatic switch activation to deactivate the clutch. In accordance with an exemplary embodiment, at least one valve is mounted just next to the clutch air in/out port to quickly depressurize the clutch. In an alternate embodiment, the clutch exhausts at the location of the pneumatic switch, which may be near the front of the press. (HUMPHREY PRODUCTS CO., Kalamazoo, Mich., USA), e.g. Super Quick Exhaust Valves off the shelf SQE1/2, QE1/2/3/4 rated from 30 PSI to 125 PSI. FIG. 28A shows the valve in a first configuration, deactivated; and FIG. 28B, shows the valve in its second, activated configuration. Ports

28-123, 28-113, and 28-103 provide connector points to pneumatic lines and provide the available inlet and outlet ports. In FIG. 28A, flow director FDx is in its first position, in turn, air can flow 28-115*x* into port 28-113 and out of 28-105 port 28-103. Threads at each port 28-127, 28-117, and 28-107 provide a means to secure the valve 28-100 into the pneumatic system of embodiments of the present invention. In FIG. 28A, the top port 28-123 is closed. Turning to FIG. 28B, the flow director FDy is in its second position, in turn, air can flow 28-125 into port 28-123 and out 28-115*y* of port 28-113. In this configuration, port 28-103 is closed.

Figure 1A:
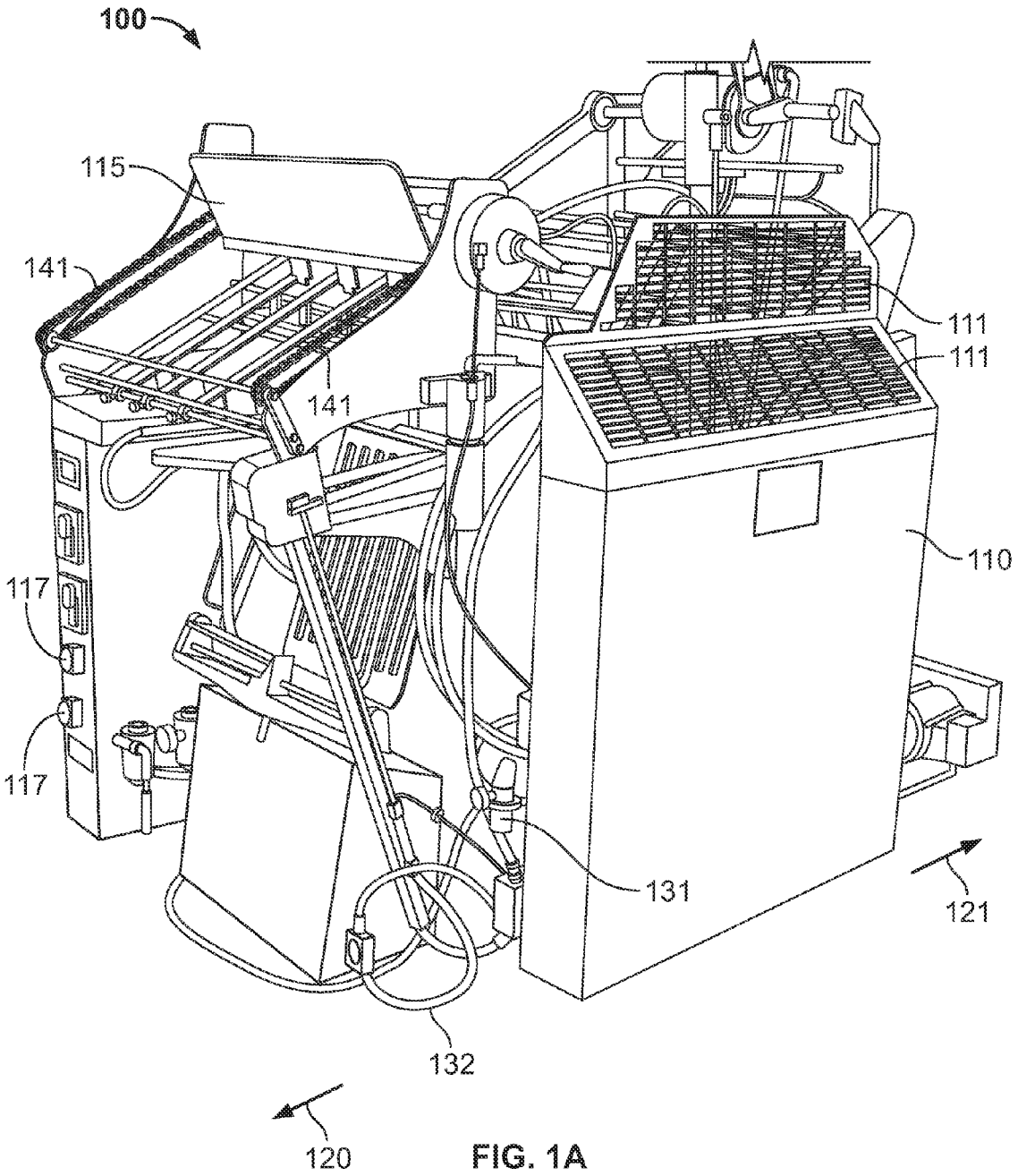
FIG. 1A (Prior Art)
FIGS. 1A-1B show a right front and a left front perspective view of a conventional KLUGE 14×22 EHE machine.
Figure 1B:
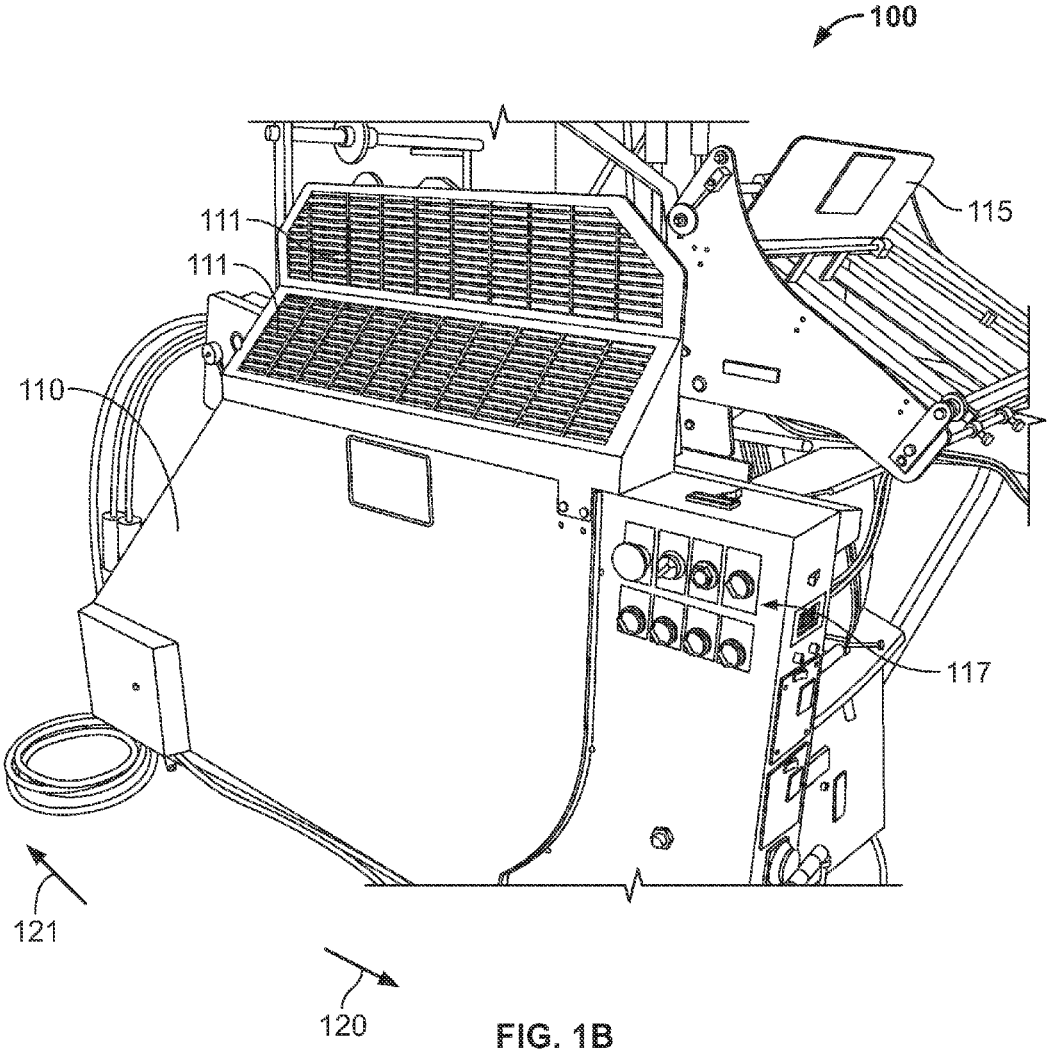
FIG. 1B (Prior Art)
Figure 1C:
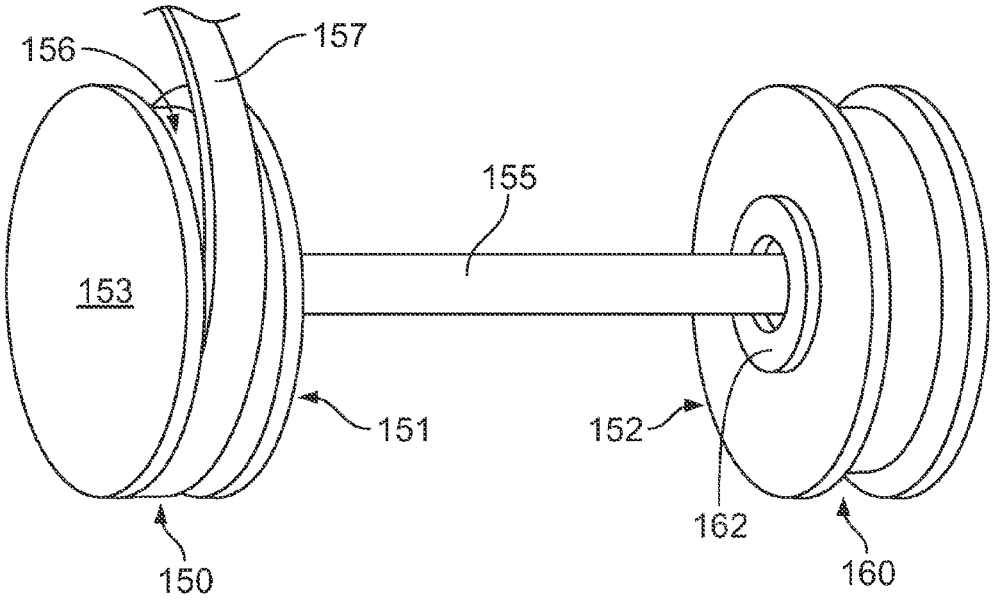
FIG. 1C (Prior Art)
FIG. 1C shows a representative drawing of conventional drive shaft and its two end flywheels, in accordance with a conventional press.

FIG. 1A shows a conventional die press with a clutch and brake system to increase dwell time. Biron (U.S. Pat. No. 3,412,678) teaches a mounting plate 68 to which die 69 is mounted and a platen plate 60 onto which a blank is fed. Mounted on a peripheral edge of the mounting plate 68 is a limit switch 71 and mounted on the platen plate 60 is an adjustable stop 70. Biron teaches moving the mounting plate 68 on bed (arm) 43 about pivot 44 and platen plate 60 moves on platen 29 about platen pivot shaft 28. Biron teaches a pair of magnetic clutches 12, 15 mounted to a respective flywheel corresponding to the mounting plate and the platen plate. This system locates the limit switch atop the moving mounting plate and a corresponding stop on the moving platen plate, the jarring on these devices upon each closing of the mounting plate and platen plate, near 1 ton per die square inch, will likely render the limit function inoperable or off the desired time in a few press cycles. Biron further teaches independent switches activating respective magnetic clutches, which may be a problem if one switch fails. Biron teaches a brake 22 "mounted on the [drive] shaft 9." Separately moving plates and clutches can lead to torque upon the drive shaft. Placing the trigger switch, limit switch, on the moving plates may lead to reliability issues given the high impact associated with die pressing. Biron teaches a single dwell timer 114.

In contrast, to the system in Biron, the present invention employs a drift and delay timer in addition to the dwell timer, enabling ready adjustment to obtain stopping the moveable platen on top dead center, just as the moveable plate hits the stationary plate. Embodiments of the present invention mount a trigger limit switch, triggering the first delay timer, on a stable sturdy surface, the foot of the frame. The switch is within the press housing. The switch triggers by smooth rocking of the press bed. Alternate limit switch locations on a sturdy stable surface placed to trip by a low impact may be desired in alternate embodiments. In contrast, prior art uses a single timer and mounts the trigger switch on a moveable part subjected to high impact. Biron uses a single timer, and in turn, fails to teach a drift or adjustable delay trigger. While exemplary embodiments of the present invention teach a honeycomb plate as the moveable plate, in accordance with alternate embodiments, the moveable plate of the press may be other than honeycomb.

An exemplary system and method of variable dwell time in 14×22 foil stamp press in accordance with the present invention comprises an air clutch which when pressurized couples the drive flywheel to the shaft. A single pole double throw pneumatic switch disengages the clutch and engages a right flywheel to stop a honeycomb plate at top dead center. Markings, for example on a head cam, facilitate user adjustments to locate top dead center via a first timer. The same first timer can accommodate for drift due to ambient conditions. When embodiments of the present invention are used in non-dwell mode, the clutch is continuously engaged, continuously pressurized, coupling the drive wheel to the shaft.

Decreasing the impact of the honeycomb on the die may increase the reliability and service life of press components, of dies, and the press as a whole. Keeping compression forces below corresponding maximum press tensile strength may increase the service life of the press. It may be desirable to foil stamp at or below conventional temperatures; decreased platen/die temperature may increase the service life of press components.

Would further increases in dwell time provide improvements in foil stamped images? Yes, embodiments of the present invention show that increasing the dwell time alone, improves the foil stamped image.

Conventional 14×22 EHx automatic presses do allow for an increase in die image pressure, by for example, adjusting the height of the die upon the platen relative to the honeycomb plate. Conventionally, adjustments are made to obtain the desired foil coverage upon the blank. Raising the striking surface of the die may be achieved, for example, with shims or with make ready of paper-like thickness. The honeycomb maintains a same trajectory and the platen remains at a constant fixed position. This alteration raises the strike surface but does not alter the mass or acceleration of the incoming honeycomb plate, in turn the change in striking impact may be minimal. The impulse, integral of force applied over time applied, increases at least because the initial impact is sooner hence the integration is over a longer duration, all other variables remaining constant. Further, in a conventional press the force applied by the honeycomb on the die may continue to increase past force at impact. Compression pressure, as between the honeycomb and the die, is approximated by the force of the honeycomb divided by the die surface area. Conventional desired image pressure for foil stamping is 1 ton per die square inch. A typical increase of die height on a conventional press may be less than 0.1 inches. Conventionally, a 14×22 EHD press may be able to accommodate 0.062 to 0.340 inches, with 0.250 inches being a typical die thickness. A variable frequency drive motor is available conventionally and a range of image per hour (IPH) operating rates from 900 to 3000 IPH also have a corresponding decrease in dwell time.

Increasing the striking impact and the honeycomb to die-platen pressure can have undesirable effects on the conventional press. The adjustment of the die height is limited. Each conventional press, for example the 14×22 EHD, has a pressure limit rating beyond which the press is not designed to safely and reliably operate. This conventional value approaches 40 tons maximum. At one ton per square inch, the conventional 14×22 EHD yields a maximum die image size of 40 square inches.

Another aspect of the present invention is an apparent increase in a rated maximum tonnage on a conventional machine by at least 1.5 times. Embodiments of the present invention can foil stamp die surface areas in excess of 80 inches squared (8 by 10). In a conventional system, the typical die pressure is 1 ton per square inch and the typical press (14×22 KLUGE EHE/D/F, is rated at 40 tons yielding a 40 square inch die surface, e.g. 4 by 10. For the conventional press to foil stamp an 80 inches squared image, it would have to create and withstand an 80 ton compressive force, past its maximum tensile strength by almost two fold. Reduced impact and compression forces, less than 1 ton per square inch, are needed to stay within original equipment load recommendations if large dies are to be used. By increasing dwell time, see FIG. 15D, and maintaining a given impact, see FIG. 15A, large dies are accommodated, in accordance with embodiments of the present invention.

Embodiments of the present invention do not run in conventional mode per se. Even when in the non-dwell mode, exemplary embodiments, as described above, have the clutch pressurized to grab, couple, the drive flywheel to the drive shaft. In still alternate embodiments of the present invention, the clutch housing has multiple air vents to maintain a desired clutch temperature. Air will be drawn through vents in the outer housing of the clutch when the drive flywheel is coupled to the drive shaft and spinner. Air can be drawn about the clutch pads, cooling a source of heat in the clutch. In accordance with the present invention, an exemplary clutch is a C6D3k air clutch (MACH III CLUTCH INC., Walton, Ky., U.S.) and is designed to hold at a temperature of 150 degrees under operating conditions and to operate at a PSI of 80-90. Tests at an hour of run time at an operating speed of 1100 IPH in dwell mode measured a steady state clutch temperature of 132 degrees. With the addition of air vents the clutch temperature may reach a lower steady state. In accordance with an exemplary embodiment, the clutch is driven by 90 PSI, the same as the press's air supply, and the same as the air PSI driving the brake. In still alternate embodiments, additional cooling of the clutch is employed.

Embodiments of the present invention employ a 5 HP versus a conventional 3 HP motor. The 5 HP may cost 4 times the conventional 3 HP but this increased size readily accommodates motor demands associated with the increased dwell time operation. The larger sized motor adds to the robustness of the invention, contributing to reliability, consistency and serviceable life. In non-dwell mode, the present invention may have a maximum impression strength recommendation of a conventional 14×22 press, about 40 tons.

In accordance with the present invention, the clutch is pressurized in non-dwell mode and in dwell mode unless the flywheel brake is applied. When the clutch is engaged and pressurized the drive flywheel is coupled to the drive shaft. The pneumatic switch, as employed in accordance with exemplary embodiments of the present invention either has air to the clutch or air to the flywheel brake. When there is no air to the clutch, the drive flywheel is uncoupled from the shaft but is still attached to the motor. In accordance with embodiments of the present invention, the motor brake is added to stop the motor when it is tied to the drive flywheel only, hastening the stopping of all moving parts—when stopping is initiated due to safety switches or due to user pushing the stop button.

By use of the motor brake versus a brake on the drive shaft, the left flywheel does not continue to turn when the clutch is disengaged and the drive flywheel is free to turn independent of the shaft and all components attached there to. If the motor loses electricity and the press is in dwell mode, the brake comes online. Conventionally the motor is constantly tied to the drive flywheel via a belt and the drive flywheel is constantly tied to the drive shaft. This combination is a large inertia body. In turn, when the motor on a conventional press loses electricity, the drive flywheel may stop in about one cycle when the press is operating at 1800 IPH and when the original equipment brake is applied.

Another aspect of the present invention is the increased size of the drive motor to accommodate or withstand any coming under load current spikes with dwell time operation. (3 HP was convention and replaced with a 5 HP). Also the 5 HP can readily accommodate startup current spikes associated with stopping and starting the motor at the transition between no dwell and adjustable dwell time, in accordance with an exemplary embodiment. In accordance with the present invention when in dwell mode, the user can increase or decrease the dwell time on the fly, without turning the motor off.

Conventionally, the flywheel brake is just for an emergency stop or a user initiated stop. Both emergency and user-initiated stop by depressing, for example, a stop button, kill power to the motor.

The present invention uses the conventional feed system and the conventional delivery system. Braking the drive shaft and uncoupling the drive flywheel from the drive shaft, maintains the press timing of the different operating systems.

Field testing confirms the desirable increase in pressable die image size on a 14×22 EHD press modified, in accordance with exemplary embodiments of the present invention.

The process of foil stamping and embossing requires a combination of impression strength, heat, and time on die. Conventional foil stamping and embossing 14×22 EHE/D/F have short dwell times less than two-tenths of a second. The present invention enables dwell times that exceed 5 seconds. A less than 3 second dwell time, in accordance with a system and method of an exemplary embodiment of the present invention, can achieve a flawless foil stamp from a die rate at 80 tons by the die manufacturer. Conventional presses are designed to apply one ton per die image square inch. Further, 1 ton per square is the industry standard. By modifying a standard 14×22 EHD KLUGE, in accordance with the exemplary embodiments of the system and method of the present invention, foil stamping a die image size of 8 by 13.25 inches has been achieved. Herein, embodiments of the present invention have shown the increasing foil stamping coverage of a same die with increasing dwell time at a same die heating plate temperature and at a same mechanical force and pressure.

Another aspect of the present invention may be the use of a customized drive shaft, to include an increase in overall length, an increased key length on the drive side to enable attachment of the clutch, and an increase in the diameter of the drive shaft between the bearings for mounting the shaft on the press frame. The conventional material is 41L40. The conventional diameter of 1¾ inches may be increased to 3 inches. Another aspect of the present invention may be, in accordance with an exemplary embodiment, is an additional overall length and additional key length on the drive end as compared to the original shaft on an original diameter shaft.

Another aspect of an exemplary embodiment of the present invention is the use of an external keyless locking device, inherently balanced for high speed applications. More particularly, the use of a shrink disc to mount the clutch on the drive shaft may be used in accordance with an exemplary embodiment of the present invention. A range of off the shelf shrink discs may be employed. FIG. 27A shows an exemplary shrink disc, series C733M at −50, in accordance with an exemplary embodiment of the present invention (CLIMAX METAL PRODUCTS COMPANY, Mentor, Ohio, USA). Yet another exemplary embodiment is a shrink disc at −100 size.

Another aspect is that the bearings still mount at the two diameter step downs from shaft center and remain conventional off the shelf. The length of shaft within the frame remains unchanged.

In contrast to the enlarged EHG with a platen size of 22×30 inches and, in turn, all load bearing or force generation components are enlarged to provide a higher die surface area and corresponding increased tonnage, with the intended purpose of still supporting the standard 1 ton per square inch industry standard, the G enables a tonnage of 125 tons, an aspect of the present invention is to provide an apparent tonnage increase of at least 1.5 times using existing load bearing components, force generating components, and platen size of 14×22.

Another aspect of the present invention is to maintain system air pressure at desired 90 psi with existing original hoses and compressor supply; yet another aspect is the use of a 5 gallon air tank to boost the psi to the pneumatic switch and alleviate the load on the system air pressure during each clutch disengagement and brake activation.

Exemplary embodiments of the present invention provide a press wherein an increased dwell time is enabled. Further, the invention provides a ready and variable dwell time. The present invention may decrease a necessary impact and pressure for a given die size under foil stamp operation. Increasing the dwell time, as compared to increasing the impression pressure load, may increase the service life of these large, heavy, costly presses. The present invention enables foil stamping with a large die size, e.g. greater than 40 inches squared, on a 14×22 press. An apparent increase in a rated maximum tonnage die size on a press in accordance with the present invention exceeds the conventional die size/tonnage by 1.5 times.

In an alternate embodiment, the clutch engages, pressurizes, to uncouple the drive flywheel from the drive shaft in tandem with the application of the brake, where the brake may still be an original equipment brake. In such an embodiment, the clutch will operate as a combined brake/clutch in a same housing. The size of the clutch can expand by six inches. The weight will increase. The heat in the dual device may be double that of the MACH III clutch described above. A longer shaft would be needed, a bigger shaft may be needed, additional support to hold the longer shaft with the additional device weights. The footprint of the press would increase as compared to the embodiment shown in FIG. 9A.

In a still alternate embodiment, a third timer is used between the engaging of the uncoupling clutch and the applying of the brake. In yet another embodiment, a slight constant delay is used with the clutch releasing the drive flywheel from the shaft before the brake is applied.

Exemplary embodiments of the present invention have been well demonstrated on a 14×22 foil stamping KLUGE, however, alternate embodiments of the present invention may be applied to alternate foil stamping presses using a single moving plate and a press that runs off a single motor driven shaft with a pneumatic supply of about 90 psi.

While specific alternatives to aspects of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended provisional claims and drawings.

What is claimed is:

1. A method of providing a variable dwell time in an automatic foil stamping press, the method comprising:

enabling spring compression in movable arms on a left and a right of a moveable platen, respectively;

pressurizing a clutch on a drive flywheel coupling the drive flywheel to a drive shaft;

setting a first timer to adjust stopping of the movable platen on top dead center;

triggering a pneumatic switch on a lapse of the first timer;

depressurizing the clutch, uncoupling the drive flywheel from the drive shaft and pressurizing an original equipment brake;

starting a dwell timer upon lapse of the first timer;

applying a second trigger to the pneumatic switch upon lapse of the dwell timer; and pressurizing the clutch, coupling the drive flywheel to the drive shaft and depressurizing the original equipment brake.

2. The method according to claim 1, further comprising:

adjusting the first timer to align top dead center markings; and re-adjusting the first timer upon increasing or decreasing image per hour operating speed.

3. The method according to claim 1, further comprising:

adjusting the dwell time between 0.2 seconds and 3.5 seconds while the automatic foil stamping press is in its dwell mode and is actively stamping for an accommodating operating speed.

4. The method according to claim 1, further comprising:

using an air tank at 90 PSI to boost the system air supply when the pneumatic switch is operated.

5. The method according to claim 4, further comprising:

enabling a constant 90 PSI press system air supply with a 5 gallon pressurized air tank.

6. The method according to claim 1, further comprising:

running the press with the clutch pressurized in a non-dwell mode.

7. The method according to claim 1, further comprising:

using a 5 horsepower motor to drive the drive flywheel.

8. The method according to claim 7, further comprising:

applying a motor brake to the motor when safety triggers are tripped when operating in a dwell mode.

9. The method according to claim 7, further comprising:

applying a motor brake to the motor when safety triggers are tripped when operating in a non-dwell mode.

* * * * *